US006151049A

United States Patent [19]

Karita et al.

[11] Patent Number: 6,151,049

[45] Date of Patent: Nov. 21, 2000

[54] LIQUID DISCHARGE HEAD, RECOVERY METHOD AND MANUFACTURING METHOD FOR LIQUID DISCHARGE HEAD, AND LIQUID DISCHARGE APPARATUS USING LIQUID DISCHARGE HEAD

[75] Inventors: Seiichiro Karita, Yokohama; Toshio Kashino, Chigasaki; Yoshie Asakawa, Hotaka-machi, all of Japan

[73] Assignee: Canon Kabushiki Kaisha, Tokyo, Japan

[21] Appl. No.: 08/890,567

[22] Filed: Jul. 9, 1997

[30] Foreign Application Priority Data

Jul. 12, 1996 [JP] Japan ..... 8-183038

[51] Int. Cl.[7] ..... B41J 2/05; B41J 2/175

[52] U.S. Cl. ..... 347/65; 347/85

[58] Field of Search ..... 347/65, 63, 85, 347/42

[56] References Cited

U.S. PATENT DOCUMENTS

| | | | |
|---|---|---|---|
| 4,480,259 | 10/1984 | Kruger et al. | 347/63 |
| 4,496,960 | 1/1985 | Fischbeck . | |
| 4,509,063 | 4/1985 | Sugitani et al. . | |
| 4,558,333 | 12/1985 | Sugitani et al. . | |
| 4,559,543 | 12/1985 | Toganoh | 347/42 X |
| 4,568,953 | 2/1986 | Aoki et al. . | |
| 4,611,219 | 9/1986 | Sugitani et al. . | |
| 4,698,645 | 10/1987 | Inamoto . | |
| 4,723,129 | 2/1988 | Endo et al. | 347/56 |
| 4,723,136 | 2/1988 | Suzumura . | |
| 4,752,788 | 6/1988 | Yasuhara et al. . | |
| 4,994,825 | 2/1991 | Saito et al. . | |
| 5,021,809 | 6/1991 | Abe et al. . | |
| 5,066,964 | 11/1991 | Fukuda et al. . | |
| 5,208,604 | 5/1993 | Watanabe et al. . | |
| 5,262,802 | 11/1993 | Karita et al. . | |
| 5,278,585 | 1/1994 | Karz et al. | 347/65 |
| 5,279,410 | 1/1994 | Arashima et al. . | |
| 5,296,875 | 3/1994 | Suda . | |
| 5,389,957 | 2/1995 | Kimura et al. . | |
| 5,485,184 | 1/1996 | Nakagomi et al. . | |
| 5,821,962 | 10/1998 | Kudo | 347/65 |

FOREIGN PATENT DOCUMENTS

| | | | |
|---|---|---|---|
| 2-113950 | 4/1990 | European Pat. Off. . | |
| 0 436 047 | 7/1991 | European Pat. Off. . | |
| 0436047 | 7/1991 | European Pat. Off. | B41J 2/055 |
| 0443798 | 8/1991 | European Pat. Off. . | |
| 0496533 | 7/1992 | European Pat. Off. . | |
| 0538147 | 4/1993 | European Pat. Off. . | |
| 0 721 841 | 7/1996 | European Pat. Off. | B41J 2/05 |
| 0 764 531 | 3/1997 | European Pat. Off. | B41J 2/14 |
| 0 811 498 | 12/1997 | European Pat. Off. | B41J 2/14 |
| 61-59914 | 2/1980 | Japan . | |
| 55-81172 | 6/1980 | Japan . | |
| 61-69467 | 4/1986 | Japan . | |
| 61-110557 | 5/1986 | Japan . | |
| 62-156969 | 7/1987 | Japan . | |
| 62-48585 | 10/1987 | Japan . | |
| 63-197652 | 8/1988 | Japan . | |
| 63-199972 | 8/1988 | Japan | B41J 3/04 |
| 3-81155 | 4/1991 | Japan . | |
| 5-124189 | 5/1993 | Japan | B41J 2/05 |
| 6-31918 | 2/1994 | Japan | B41J 2/05 |
| 6-87214 | 3/1994 | Japan . | |

*Primary Examiner*—John Barlow
*Assistant Examiner*—Juanita Stephens
*Attorney, Agent, or Firm*—Fitzpatrick, Cella, Harper & Scinto

[57] ABSTRACT

According to the present invention, the liquid discharge head comprises a first liquid flow path communicating with a discharge opening for discharging liquid, a second liquid flow path having a bubble-generating region in which bubbles are generated in the liquid by heating the liquid, a movable member located between the first liquid flow path and the bubble-generating region, having a free end on the side of the discharge opening, the free end moving toward the first liquid flow path by pressure exerted by bubbles generated in the bubble-generating region to direct the pressure toward the discharge opening, wherein the first liquid flow is provided in plural, and wherein a first supply path for supplying the liquid to a first liquid chamber communicating with in common the plurality of first liquid flow paths communicates with the first liquid chamber through a plurality of first supply ports.

28 Claims, 32 Drawing Sheets

LIQUID DISCHARGE HEAD, RECOVERY METHOD AND MANUFACTURING METHOD FOR LIQUID DISCHARGE HEAD, AND LIQUID DISCHARGE APPARATUS USING LIQUID DISCHARGE HEAD

BACKGROUND OF THE INVENTION

1. Field of the Invention

The present invention relates to a liquid discharge head for discharging a desired liquid by generation of bubbles formed by applying thermal energy to the liquid, and a head cartridge and a liquid discharge apparatus that employ such a liquid discharge head. In particular, the present invention relates to a liquid discharge head comprising a movable member that is displaced (moved) by utilizing bubble generation, a head cartridge and a liquid discharge apparatus employing such a liquid discharge head.

In addition, the present invention can be applied for an apparatus such as a printer that performs recording on a recording medium such as paper, thread, fiber, fabric, leather, metal, plastic, glass, wood or ceramics, a copy machine, a facsimile machine that has a communication system, and a word processor having a printing unit and for an industrial recording apparatus compositely combined with various processing apparatuses.

The "recording" in this invention involves not only the transfer of a meaningful image, such as a character or a graphic figure, to a recording medium, but also the transfer of a meaningless image, such as a pattern.

2. Related Background Art

The ink-jet recording method is well known as the so-called bubble-jet recording method which comprises applying thermal energy to ink, to generate a conditional change in the ink, which is accompanied by a drastic volume change (the generation of bubbles), discharging the ink through a discharge opening, by the energy generated due to the conditional change, and landing the ink on the surface of a recording medium to form an image. As is disclosed in U.S. Pat. No. 4,723,129, a recording apparatus employing the bubble-jet recording method generally comprises a discharge opening through which ink is discharged, an ink flow path that communicates with the discharge opening, and an electro-thermal converting member that serves as energy generation means for discharging the ink in the ink flow path.

By employing this recording method, an image having a high quality can be recorded rapidly, with reduced noise, and in a head for discharging ink discharge openings can be arranged at a high density.

For these reasons, this recording method has proven to be superior, in that when it is employed, high resolution images, and even color images can be easily produced by compact devices. As a result, the bubble-jet recording method has recently come to be employed in various types of office equipment, such as printers, copy machines and facsimile machines, and also in industrial system equipment, such as textile printing machines.

As the bubble-jet technique has come to be used for products in a number of different fields, there has been an increase in various demands such as the following.

As an example, there is the demand that energy efficiency be enhanced, and the demand is solved by the optimization of the function of a heat generating member i.e., the adjustment of the thickness of a protective film, that effectively improves the efficiency for the transmission of generated heat to liquid.

In addition, to acquire high quality images, proposed are driving conditions that will provide a liquid discharge method, based on the stable generation of bubbles, whereby ink can be preferably discharged at a high speed. Further, from a viewpoint of high rapid recording, proposed are liquid discharge heads having improved flow path shapes that will provide for the high speed refilling of flow paths after the discharge of liquid.

Of such flow paths, the flow path structure shown in FIGS. 42A and 42B is described in Japanese Patent Application Laid-open No. 63-199972. The flow path structure and the head manufacturing method, which are described in this application, are provided by focusing on a backflow wave that occurs in association with the generation of bubbles (the pressure directed in a direction opposite to the direction of a discharge opening, i.e., pressure applied in the direction of a liquid chamber 1012). The energy used to produce this backflow wave is considered to be a lost energy, since the energy is not directed, in the discharge direction.

The invention shown in FIGS. 42A and 42B discloses a valve 1010, which is separated from a bubble-generating region that is defined by a heat-generating member 1002, and which is positioned opposite to a discharge opening 1011 with the heat-generating member 1002 positioned between them.

In FIG. 42B, the valve 1010 is initially positioned such that it is attached to the ceiling of a flow path 1003, and it is bent down into the flow path 1003 when bubbles are generated. This invention discloses that the backflow wave is partially controlled by the valve 1010 to restrict energy loss.

However, as is apparent in the above arrangement, when bubbles are generated in the flow path 1003 for holding liquid to be discharged, the partial restriction of a backflow wave by the valve 1010 is not practical in the discharge of the liquid.

The backflow wave is not directly related to the discharge of the liquid. When the backflow wave occurs in the flow path 1003, as is shown in FIG. 42A, the bubble pressure that directly affects the discharge has already enabled the liquid to be discharged from the flow path 1003. Therefore, apparently, even when a part of the backflow wave is restricted, this has not great effect on the discharge of the liquid.

In the above conventional liquid discharge head, however, since heating is repeated while the heat-generating member is in contact with ink, precipitate due to ink scorching is deposited on the surface of the heat-generating member. Depending on the ink type, more precipitate is generated and deposited, which can result in unstable bubble generation and make the preferable discharge of ink difficult. In particular, since driving frequencies have been increased in accordance with recent requests that recording speeds be further increased, multiple discharge openings have been provided and print heads have been elongated, it is difficult to smoothly, uniformly and stably effect the rapid refilling of a flow path with ink in the direction of a discharge opening. As a result, the recording quality has also been deteriorated.

In addition, preferable ink discharge is difficult when a liquid to be discharged is easily deteriorated by heat or when sufficient bubbles can not be generated in a liquid to be discharged.

SUMMARY OF THE INVENTION

To solve the problems of the prior art as described above, it is one object of the present invention to provide a liquid discharge head, in which uniform and stable refilling can be performed even though the head is elongated, and in which the free degree of an ink to be discharged can be broadened while improving the efficiency of the liquid discharge, and to provide a recovery method and a manufacturing method for such a liquid discharge head and a liquid discharge apparatus that employs such a liquid discharge head.

To achieve the above object, according to the present invention, a liquid discharge head comprises:

a first liquid flow path, communicating with a discharge opening for discharging (or ejecting) liquid;

a second liquid flow path having a bubble-generating region in which bubbles are generated in the liquid by heating the liquid; and a movable member positioned between the first liquid flow path and the bubble-generating region, and having a free end on the discharge opening side, the free end moving toward the first liquid flow path by pressure of bubbles generated in the bubble-generating region to direct the pressure toward the discharge opening;

wherein the first liquid flow path is provided in plural, and wherein a first supply path for supplying the liquid to a first liquid chamber communicating in common with the plurality of the first liquid flow paths communicates with the first liquid chamber via a plurality of first supply ports.

The second flow path is further preferably provided in plural. In addition, a second liquid chamber which communicates with the plurality of the second flow paths in common, and a second supply path for supplying the liquid to the second liquid chamber are preferably provided.

A heat-generating member for generating heat is preferably provided corresponding to the bubble-generating region of the second flow paths.

The heat-generating member is preferably provided in a device substrate (member-supporting substrate).

Preferably, a support member for supporting the device substrate is further provided.

Preferably, the first supply path and the second supply path are integrally formed.

The thermal expansion coefficient of a member for forming the second supply path is preferably almost equal to the thermal expansion coefficient of the support member.

A member for forming the first supply path is preferably made of stainless steel.

The support member is preferably composed of aluminum.

Preferably, a plurality of the device substrates are provided on the support member, and a separate wall on which the movable member is formed extends over the plurality of device substrates.

Preferably, a plurality of the device substrates are provided on the support member, and a separate wall having the movable member is provided in plural each corresponding to the plurality of device substrates.

The plurality of the first supply ports preferably communicate with the first liquid chamber near both ends of the first liquid chamber.

In addition, preferably, the device substrate is provided in plural, and the first supply path, which has a pipe shape, is provided over the plurality of device substrates, and along the first supply path, a liquid to be discharged is supplied to the first liquid flow path of each of the device substrates.

The second supply path has a pipe shape and is provided over the plurality of device substrates, and along the second supply path, a bubble generation liquid is supplied to the second liquid flow paths of the device substrates.

The second flow path preferably ends at the location of the free end of the movable member, opposite to the side on which the second flow path communicates with the second supply path.

The second flow path preferably ends at the location of a lower portion of the movable member, opposite to the side on which the second flow path communicates with the second supply path.

A method for recovering the liquid discharge head comprises the steps of:

supplying liquid to the second supply path while both ends of the first supply path are closed;

applying pressure to the second supply path from both ends thereof while both of the ends of the first supply path are closed;

supplying the liquid to the first supply path while both ends of the second supply path are closed; and applying pressure to the first supply path from both ends thereof while both of the ends of the second supply path are closed, thereby recovering for the first supply path and the second supply path.

Further, in a method for manufacturing the liquid discharge head, the incorporation of the first and the second supply paths to the liquid discharge head is performed by insert molding.

Further, a liquid discharge apparatus comprises the liquid discharge head and driving signal supply means for supplying a driving signal for discharging (or ejecting) liquid from the liquid discharge head.

In addition, a liquid discharge apparatus comprises the liquid discharge head and recording medium transfer means for transferring a recording medium onto which liquid is discharged (or ejected) from the liquid discharge head.

Recording is performed by ejecting ink from the liquid discharge head and landing the ink on a recording sheet.

Recording is performed by ejecting ink from the liquid discharge head and landing the ink on a fabric.

Recording is performed by ejecting ink from the liquid discharge head and landing the ink on plastic.

Recording is performed by ejecting ink from the liquid discharge head and landing the ink on a metal.

Recording is performed by ejecting ink from the liquid discharge head and landing the ink on wood.

Recording is performed by ejecting ink from the liquid discharge head and landing the ink on a leather.

Color recording is performed by ejecting a plurality of color liquids from the liquid discharge head and by landing the plurality of color liquid on a recording medium.

A plurality of discharge openings are preferably arranged so that they can cover all of a region on a recording medium in which recording is permitted.

According to the thus structure of the present invention, the liquid to be discharged is introduced from the first liquid chamber to a discharge opening via the first supply path and the first flow path, and the bubble generation liquid is introduced from the second liquid chamber via the second supply path and the second liquid flow path to the bubble-generating region that is formed on the heat-generating member. Since the liquid to be discharged and the bubble generation liquid are separated, the liquid to be discharged is not brought into contact with the heat-generating member. Therefore, when liquid that is easily damaged by heat is to be discharged, no precipitate due to burning is deposited on the heat-generating member.

Thus, even with an elongated head, rapid refilling can be effected uniformly and stably.

For the integral formation of the first and the second supply paths in a pipe shape, a conventional manufacturing method can be employed, even when a liquid discharge head is an elongated type and a plurality of device substrates are provided.

DETAILED DESCRIPTION OF THE PREFERRED EMBODIMENTS

Before the explanation for the present invention, the liquid discharging principle for a liquid discharge head according to the present invention will be described, while referring to the accompanying drawings.

(First Embodiment)

In this embodiment, first, an explanation will be given for an example wherein the direction in which pressure exerted by bubbles is transmitted and the direction in which bubbles grow are controlled in order to discharge liquid, so that the liquid discharge force and thereby the discharge efficiency are enhanced.

Figure 1A:
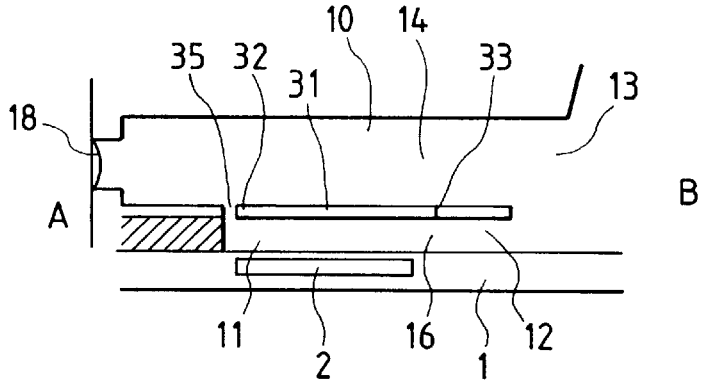
FIGS. 1A, 1B, 1C and 1D are specific cross-sectional views of a liquid discharge head according to the first embodiment of the present invention.
Figure 1B:
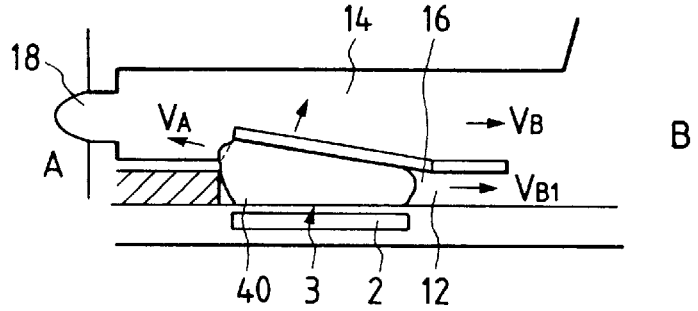
Figure 1C:
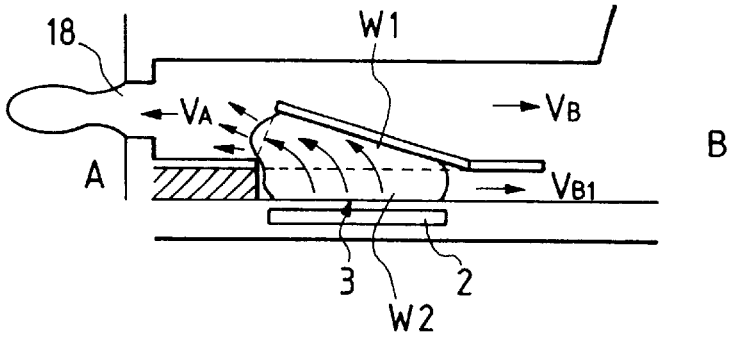
Figure 1D:
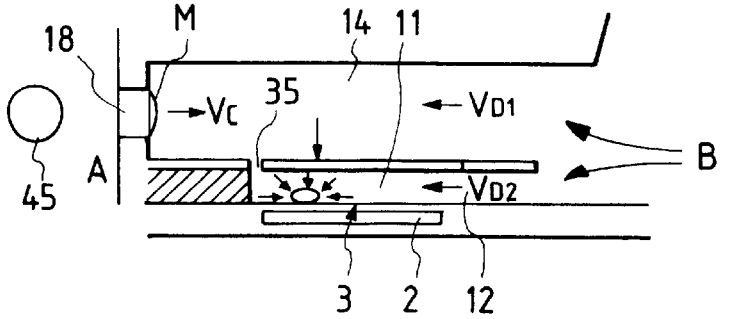
Figure 2:
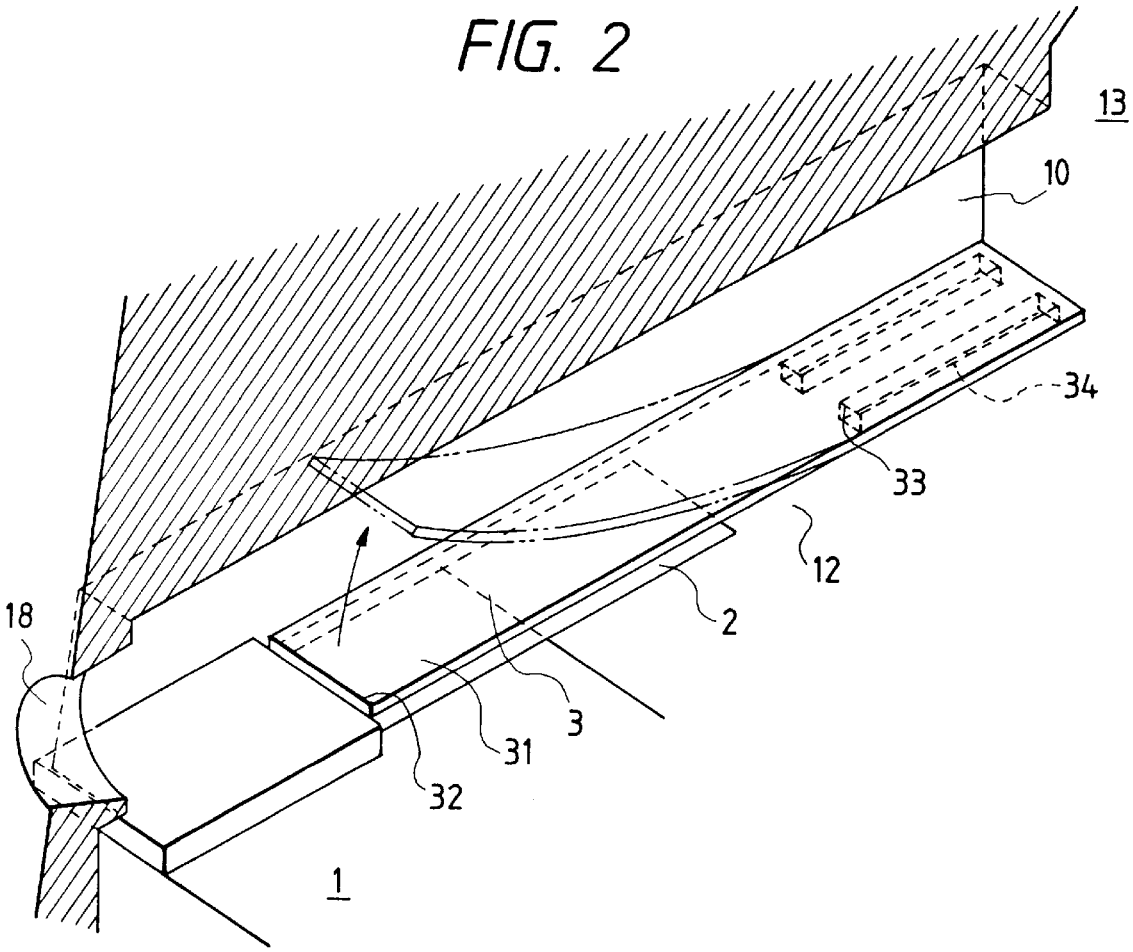
FIG. 2 is a partially cutaway perspective view of the liquid discharge head according to the present invention.

FIGS. 1A to 1D are specific cross-sectional views of one example of the liquid discharge head according to the present invention, and FIG. 2 is a partially cutaway perspective view of the liquid discharge head of the present invention.

In the liquid discharge head of the present invention, a heat-generating member 2 (having a heat-generating resistor of 40 $\mu$m×105 $\mu$m in this embodiment) for applying thermal energy to liquid is provided in a device substrate 1, and serves as a discharge energy generating member for discharging liquid. A liquid flow path 10 is arranged above the device substrate 1 corresponding to the heat-generating member 2. The liquid flow path 10 communicates with a discharge opening 18, and also with a common liquid chamber 13 from which liquid is supplied to a plurality of the liquid flow paths 10. Liquid, in a quantity that is equivalent to that discharged through the discharge opening 18, is supplied from the common chamber 13.

A cantilevered, plate movable member 31, which is made of an elastic metal and has a flat portion, is provided above the device substrate 1 in the liquid flow path 10 and facing the heat-generating member 2. One end of the movable member 31 is fixed to the wall of the liquid flow path 10 and to a base (support member) 34 that is formed by patterning a photosensitive resin on the device substrate 1. A part of the movable member 31 is fixed at the one end and serves as a fulcrum 33.

The movable member 31 is positioned so that it faces and covers the heat-generating member 2 at a distance of 15 $\mu$m, and so that its fulcrum (fixed end) 33 is upstream along a path by which a large liquid flow passes from the common liquid chamber 13 past the movable member 31 to the discharge opening 18 during the liquid discharge operation, and so that its free end 32 is downstream relative to the fulcrum 33. A region between the heat-generating member 2 and the movable member 31 is a bubble-generating region 11. The types and shapes, and the locations of the heat-generating member 2 and the movable member 31 are not limited to those described above, and may be others that provide control for the growth of a bubble and the transmission of pressure, as will be described later. For an explanation of the liquid flow that will be given later, the liquid flow path 10 is divided, with the movable member 31 acting as a border, into a first liquid flow path 14, which communicates directly with the discharge opening 18, and a second liquid flow path 16, which includes the bubble-generating region 11 and a liquid supply path 12.

When the heat-generating member 2 generates heat, the heat reacts with the liquid in the bubble-generating region 11, between the movable member 31 and the heat-generating member 2, and a bubble 40 is generated in the liquid, based on a film boiling phenomenon described in U.S. Pat. No. 4,723,129. The bubble 40 and the pressure, built up due to the generation of the bubble 40, act first of all on the movable member 31, whereby the movable member 31 is displaced to rotate at the fulcrum 33 and open in the direction toward the discharge opening 18, as is shown in FIG. 1B or 1C, or FIG. 2. As the movable member 31 is displaced, or in accordance with the degree of displacement of the movable member 31, the pressure which is built up due to the generation of the bubble 40, and growth of the bubble 40 are extended to the side of the discharge opening 18.

One of the discharge principles according to the present invention will now be explained.

One of the important principles inherent to this invention is that the movable member 31, which is positioned facing the bubble 40, is displaced from its first normal position to its second displacement position by the pressure exerted by the bubble 40 or by the bubble 40 itself, and in accordance with the displacement of the movable member 31, the pressure, which accompanies the generation of the bubble 40, and the growing bubble 40 are transmitted downstream to the location of the discharge opening 18.

The principle will be described in further detail by comparing it with the conventional liquid flow path structure.

Figure 3:
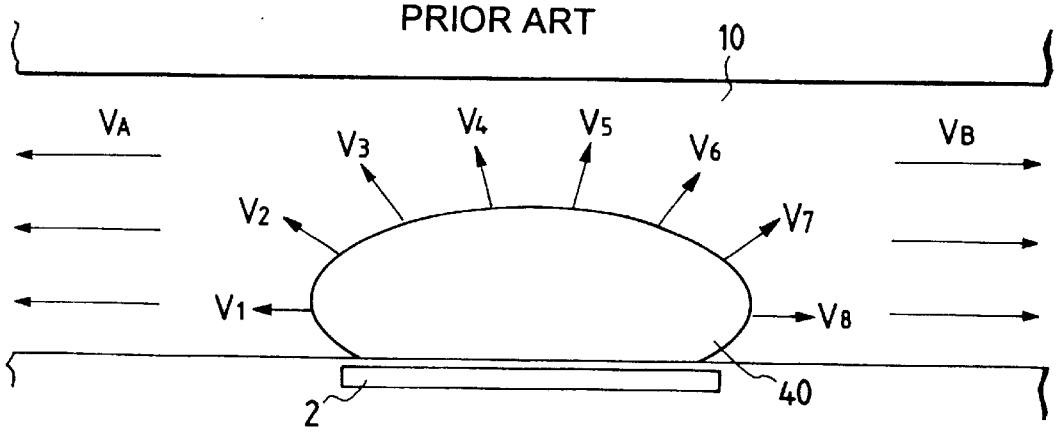
FIG. 3 PRIOR ART
FIG. 3 is a specific diagram showing transmission of pressure from a bubble in a conventional liquid discharge head.
Figure 4:
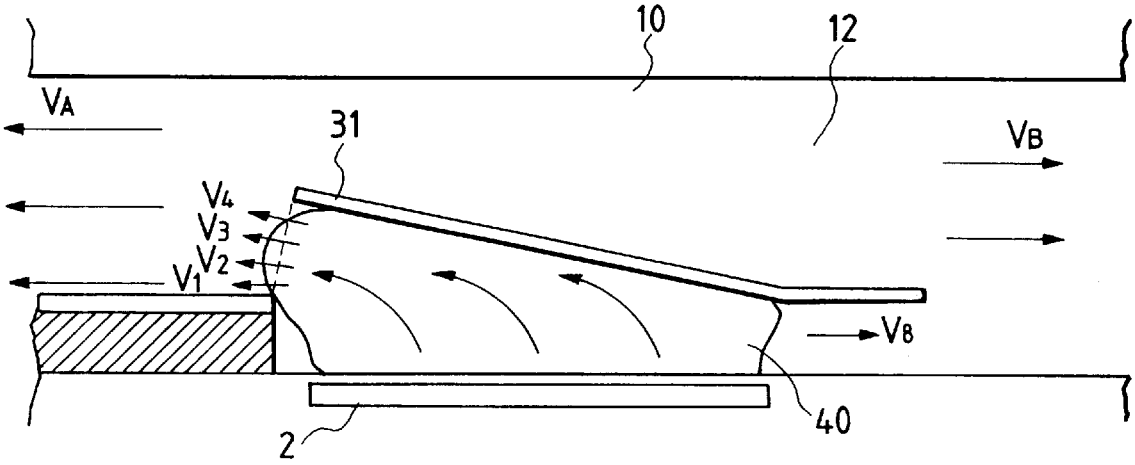
FIG. 4 is a specific diagram showing transmission of pressure from a bubble in a liquid discharge head according to the present invention.

FIG. 3 is a specific diagram illustrating the pressure transmission pattern for a bubble in the conventional head, and FIG. 4 is a specific diagram illustrating the pressure transmission pattern for a bubble formed in the head of the present invention. Arrow $V_A$ is used to designate the pressure transmission direction of downstream toward the discharge opening, while arrow $V_B$ is used to designate the pressure transmission direction toward the upstream.

The structure of the conventional head shown in FIG. 3 provides no control over the direction in which the pressure built during the generation of the bubble 40 is transmitted. The pressure attributable to the bubble 40 is transmitted in various directions, i.e., directions perpendicular to the surface of the bubble, as is indicted by arrows $V_1$ through $V_8$. The directions of the arrows $V_1$ to $V_4$, especially, relate to the transmission of pressure in the direction of the arrow $V_A$, which has the greatest effect on the discharge of liquid, i.e., the directional components for the transmission of pressure between portions closer to the discharge opening to the middle of the bubble 40. These are important and directly contribute to the efficiency of the liquid discharge, the liquid discharge output, and the discharge speed. Since the directional component $V_1$ is closer to the discharge direction $V_A$, it provides the most efficient transfer of pressure while the directional component $V_4$ is comparatively less efficient in transferring pressure in the direction $V_A$.

On the other hand, according to the invention shown in FIG. 4, by the movable member 31, the various pressure transmission directions of arrows $V_1$ to $V_4$ shown in FIG. 3 are directed to the downstream (toward the discharge opening), whereby pressure attributable to the bubble 40 is directed to the pressure transmission direction $V_A$. Thus, the pressure attributable to the bubble 40 can efficiently and directly contribute to the discharge of liquid. The direction in which the bubble 40 grows is also downstream, similarly to the pressure transmission directions $V_1$ to $V_4$, and the growth of the bubble 40 is greater downstream than upstream. The direction in which the bubble 40 grows is controlled by the movable member 31, and the transmission direction of bubble pressure is also controlled, so that basic improvements in discharge efficiency, discharge output and discharge speed, can be implemented.

The discharge operation of the liquid discharge head in this embodiment will be described in detail while again referring to FIGS. 1A to 1D.

In FIG. 1A is shown the condition before electric energy is applied to the heat-generating member 2, i.e., the condition before heat is generated by the heat-generating member 2.

It is important here for the movable member 31 at least to be located at a position facing the downstream portion where a bubble is generated by heating with the heat-generating member 2. That is, at least the movable member 31 is arranged at a position downstream from a center 3 of the area of the heat-generating member 2 (downstream from a line that runs through the center 3 of the area of the heat generating member 2 and is perpendicular to the longitudinal direction of the flow path), so that the downstream portion of the bubble can act on the movable member 31.

In FIG. 1B is shown the condition where, upon the application of electric energy to the heat-generating member 2, heat is generated so that the liquid filling the bubble-generating region 11 is heated and the bubble 40 is generated by film boiling.

The movable member 31 is displaced from the first position to the second position by the pressure generated by the formation of the bubble 40, so that the transmission of pressure by the bubble 40 is directed toward the discharge opening 18. As is described above, it is important here for the free end 32 of the movable member 31 to be located downstream (at the discharge opening 18 side) and for the fulcrum 33 to be located upstream (on the common liquid chamber side), so that at least one part of the movable member 31 faces the downstream portion of the heat-generating member 2, i.e., the downstream portion of the bubble 40.

FIG. 1C shows the condition where greater growth of the bubble 40 has occurred. The movable member 31 is further displaced in accordance with the pressure generated by the growth of the bubble 40. The generated bubble 40 becomes larger downstream than upstream and further becomes larger from its first position (indicated by the broken line) of the movable member 31. Since the movable member 31 is displaced gradually, the direction in which the pressure attributable to the bubble 40 is transmitted and the direction in which shifting of volume is easy, i.e., the direction in which the bubble 40 grows toward the free end, can be uniformly set to correspond to the direction toward the discharge opening 18. This can also enhance the discharge efficiency. When the bubble 40 and the pressure generated by bubbling are transmitted to the discharge opening 18, the movable member 31 does not hinder this transmission, and can efficiently control the direction in which the pressure is transmitted and the direction in which the bubble grows in accordance with the magnitude of the pressure to be transmitted.

FIG. 1D shows the condition where, when the internal pressure of the bubble 40 has been reduced after the completion of the film boiling, the bubble 40 has shrunk and has disappeared.

The movable member 31, which is located at the second position, is returned to the original position (first position) in FIG. 1A by negative pressure produced by the shrinking of the bubble 40, and by the recovery force of the movable member 31 itself. In addition, when the bubble 40 disappears, liquid flows in the directions of streams $V_{D1}$ and $V_{D2}$, from upstream side (B), i.e., from the common liquid chamber 13, and in the direction $V_C$ from the discharge opening 18, so that the reduced volume of the bubble 40 is compensated for in the bubble-generating region 11, and so that the volume of the discharged liquid is also compensated for.

The movement of the movable member 31, which occurs as a result of the generation of the bubble 40, and the liquid discharge operation have been described above. Refilling characteristic of liquid in the liquid discharge head of the present invention will now be described in detail.

A liquid supply mechanism will be described in detail while referring to FIGS. 1C and 1D.

When, after the condition in FIG. 1C that the volume of the bubble 40 increases to the maximum and the bubble is then ready to disappear, liquid to compensate for the disappearing volume flows into the bubble-generating region 11 along the first liquid flow path 14, from the side of the discharge opening 18, and along the second liquid flow path 16, from the side of the common liquid chamber 13. For a conventional liquid flow path structure in which the movable member 31 is not provided, the quantity of liquid that flows from the discharge opening side to the position where the bubble disappears, and the quantity of liquid that flows from the common liquid chamber depend on flow resistances at the portion closer to the discharge opening 18 than the bubble-generating region and on the portion closer to the common liquid chamber. This occurs because of the resistance of the flow paths and the inertia of liquid.

When the flow resistance at the portion close to the discharge opening 18 is small, a large quantity of liquid flows from the discharge opening 18 side to the bubble disappearing position, and the distance of a meniscus M to be moved back is lengthened. Especially when the flow resistance closer to the discharge opening 18 side is reduced to increase the discharge efficiency, the meniscus M to be moved back becomes longer after the bubble disappears, and the time period required for refilling is extended, which adversely affects the printing speed.

On the other hand, in this embodiment, the movable member 31 is provided. When a bubble has a volume of W, the portion above than the first position of the movable member 31 is defined as W1, and the portion in the bubble-generating area 11 is defined as W2. When the movable member 31 is returned to the original position after the bubble has disappeared, the regression of the meniscus M is halted, and then, an amount of liquid equal to the volume W2 is supplied primarily along the stream $V_{D2}$ in the second flow path 16. While the quantity that corresponds to half of the volume W of the bubble is determined as the conventional regression distance for the meniscus, the regression of the meniscus in the present invention can be reduced to merely half of the volume W1, which is smaller than the conventional volume.

Liquid in an amount equal to volume W2 can be forcibly supplied by the pressure generated when the bubble disappears, primarily from the upstream ($V_{D2}$) portion of the second liquid flow path 16 and along the surface of the movable member 31, at the near side of the heat-generating member 2. Therefore, rapid liquid refilling can be performed.

Liquid refilling is performed in the conventional head by using the pressure acquired when the bubble disappears to increase vibration of the meniscus, whereby deterioration of an image quality occurs. On the other hand, as the feature of the present invention, since in the rapid liquid refilling of this embodiment the movable member 31 can inhibit the stream of liquid between the first liquid flow path near the discharge opening 18 and the bubble-generating region 11 near the discharge opening 18, the vibration of the meniscus can be drastically reduced.

The present invention accomplishes rapid refilling by forcibly refilling liquid in the bubble-generating region via the liquid supply path 12 of the second liquid flow path 16, and by controlling the regression and vibration of the meniscus as described above. Therefore, stable discharge and rapid, repeated discharge of liquid, and, for recording, high quality of images and rapid recording can be provided.

The structure of the present invention also includes the following effective function.

This function is used to control the transmission in the upstream direction (as a backflow wave) of pressure exerted during the generation of a bubble. The pressure generated by a bubble that is produced near the common liquid chamber 13 (upstream) on the heat-generating member 2 acts as a force (a backflow wave) to push liquid back upstream. This backflow wave produces the pressure on the upstream side to generate liquid movement due to the pressure, and the inertial force that accompanies the movement of liquid, thereby causing deterioration of the speed at which the liquid flow path is refilled with liquid, and also adversely affecting the driving speed.

In this invention, the refilling with liquid can be improved by using the movable member 31 to control these actions on the upstream side.

An additional characteristic structure and effect provided with this embodiment will now be described.

The second liquid flow path 16 in this embodiment includes a liquid supply path 12 having an internal wall, upstream of the heat-generating member 2, that is connected to the heat-generating member 2 and that substantially is flat (provided that the surface of the heat-generating member 2 does not fall far). With this structure, as is shown by $V_{D2}$, liquid is supplied to the surfaces of the bubble-generating region 11 and the heat-generating member 2 along the surface of the movable member 31, which is near the bubble-generating region 11. The precipitation of liquid on the surface of the heat-generating member 2 can be retarded, the separation of air dissolved in the liquid and the removal of a remaining bubble that does not disappear are easily carried out, and the cumulative heat absorbed by the liquid is not too great. Therefore, a more stable bubble generation can be performed repeatedly and rapidly. In this embodiment, an explanation has been given for a liquid discharge head having the liquid supply path 12 with a substantially flat internal wall. A liquid supply path that is smoothly connected to the surface of the heat-generating member 2 and that has a smooth internal wall may be employed, and the liquid supply path may have any shape so that liquid precipitate is not deposited on the heat-generating member 2 and a large turbulent flow does not occur while liquid is being supplied.

The liquid may be supplied from the stream $V_{D1}$ to the bubble-generating region 11 along the side (slit 35) of the movable member 31. However, the large movable member 31 is used to cover the entire bubble-generating member 11 shown in FIG. 1D (i.e., the entire surface of the heat-generating member) in order to effectively transmit pressure attributable to the bubble generation to the discharge opening 18. When the movable member 31 is returned to the first position, the flow resistances of the liquid are increased in the bubble-generating region 11 and in the region of the first flow path 14 near the discharge opening 18, whereby a stream of liquid from $V_{D1}$ toward the bubble-generating region 11 would be interrupted. In the head structure of the present invention, since there is a stream $V_{D1}$ for supplying liquid to the bubble-generating region 11, the liquid supply function performance is very high. Even in the structure for which the enhancement of the discharge efficiency is sought, such as the one where the bubble-generating region 11 is covered by the movable member 31, there is no deterioration of the liquid supply performance.

Figure 5:
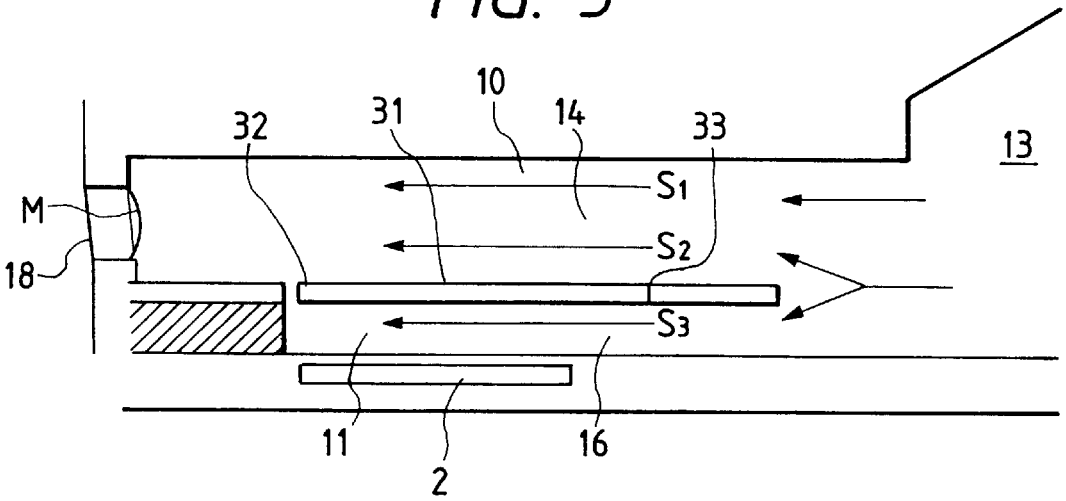
FIG. 5 is a specific diagram for explaining the flow of liquid according to the present invention.

FIG. 5 is a specific diagram for explaining the stream of liquid according to the present invention.

The free end of the movable member 31, for example, is positioned relatively downstream the fulcrum 33, as is shown in FIG. 5. With this structure, the function and the effect can be efficiently provided, so that, when the above described bubble is generated, the pressure transmission direction and the bubble growing direction can be directed to the side of the discharge orifice 18. The positional relationship between the free end 32 and the fulcrum 33 provides not only the discharge function and effect, but also can reduce the flow resistance for liquid that flows through the liquid flow path 10 while liquid is refilled with liquid rapidly. This is because, as is shown in FIG. 5, when capillary attraction in the discharge opening 18 causes the meniscus M that is retracted by a discharge to recovery, or when liquid is supplied after a bubble disappears, the free end 32 and the fulcrum 33 are not located so that they hinder the flow of the streams $S_1$, $S_2$ and $S_3$ along the liquid flow path 10 (which includes the first liquid flow path 14 and the second liquid flow path 16).

More specifically, in FIGS. 1A to 1D in this embodiment, as previously described above, the free end 32 of the movable member 31 is extended along the heat-generating member 2, so that the free end 32 faces the position downstream of the center 3 of the area (a line that runs through the center (middle) of the area of the heat-generating member 2 and is perpendicular to the longitudinal direction of the liquid flow path) that divides the heat-generating member 2 into an upstream region and a downstream region. The movable member 31 receives pressure which occurs downstream from the center position of the heat-generating member 2 and which greatly affects the discharge of liquid, and can direct the pressure attributable to the bubble 40 toward the discharge opening 18. As a result, the discharge efficiency and discharge force can basically be improved.

In addition, many effects can be obtained by using the upstream side of the bubble 40.

In the structure in this embodiment, the momentary mechanical displacement of the free end 32 of the movable member 31 also effectively affects the discharge of liquid.

(Second Embodiment)

Figure 6:
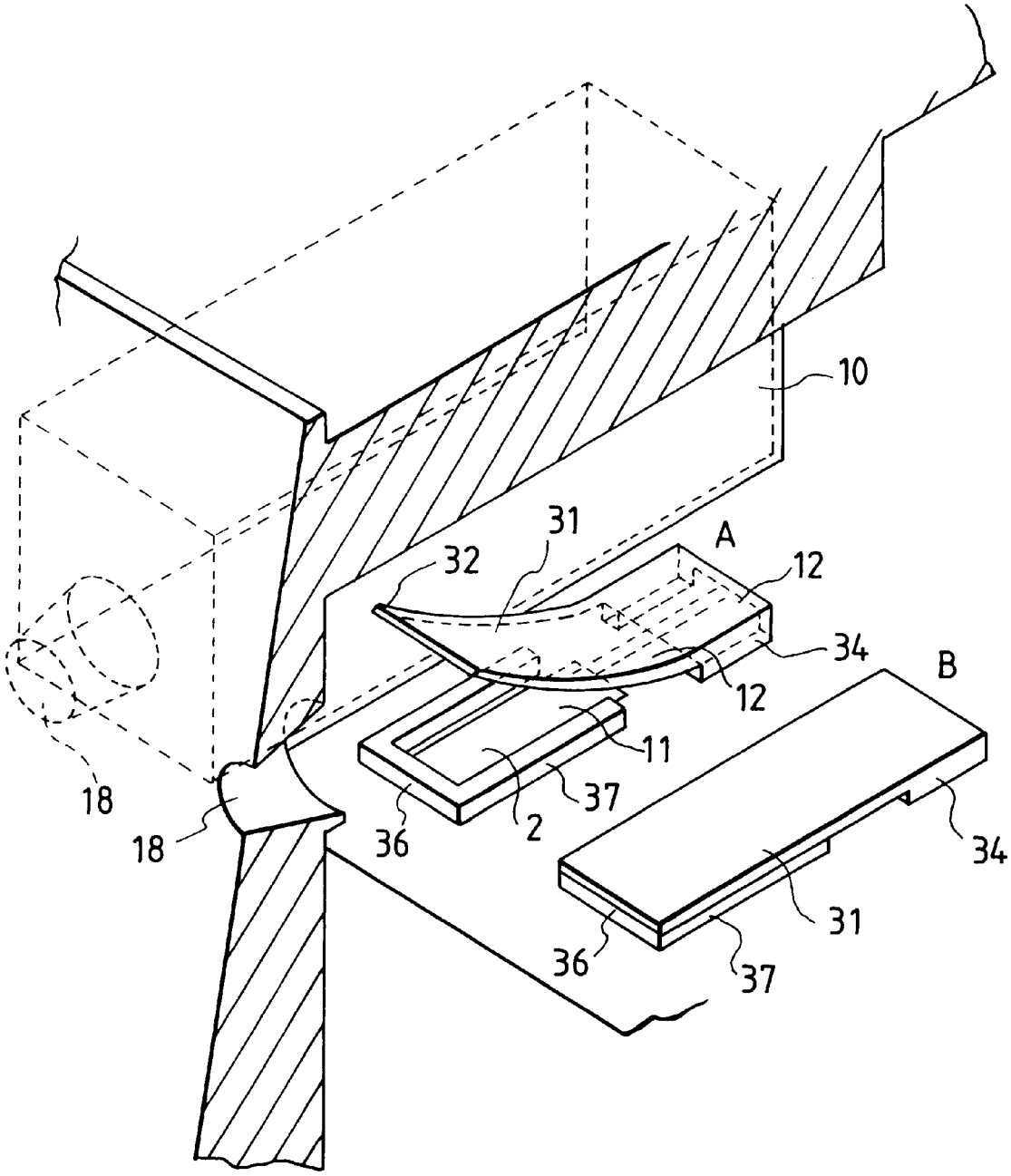
FIG. 6 is a partially cutaway perspective view of a liquid discharge head according to the second embodiment of the present invention.

FIG. 6 is a partially cutaway perspective view of a liquid discharge head according to a second embodiment of the present invention.

In FIG. 6, A indicates the condition where a movable member 31 is displaced (no bubble shown), and B indicates the condition where the movable member 31 is in its initial position (first position). It is assumed that in condition B, a bubble-generating region 11 is substantially sealed off from a discharge opening 18 (though not shown, a flow path wall is positioned between A and B to separate the flow paths).

The movable member 31 has two bases 34 at both sides, with a liquid supply path 12 running between them. The liquid supply path can have a face that is substantially flat or that is smoothly connected to the face of a heat-generating member 2. And liquid can be supplied from such a liquid supply path along the face of the movable member 31, near the heat-generating member 2.

At the initial position (first position), the movable member 31 is located near, or contacted with a heat-generating member downstream wall 36 and heat-generating member side walls 37, which are arranged downstream and alongside the heat-generating member 2, and forms a substantially closed bubble-generating region 11 near the discharge opening 18. The pressure exerted by a bubble, especially the downstream pressure of a bubble, can be captured and employed mainly to displace the free end of the movable member 33.

When the bubble disappears, the movable member 31 is returned to the first position and the bubble-generating region 11 near the discharge opening 18 is substantially tightly closed for the supply of liquid to the heat-generating member 2. Therefore, various effects described in the previous embodiment, such as the restriction of the retraction of the meniscus, can be provided. The effects concerning refilling with liquid, which were afforded by the first embodiment, can also be obtained.

In the second embodiment, as is shown in FIGS. 2 and 6, the bases 34 for securing the movable member 31 are arranged upstream, apart from the heat-generating member 2, and have a width smaller than that of the liquid flow path 10 for supplying liquid to the liquid supply path 12. The shape of the base 34 is not limited to the example shown in FIG. 6; any shape that can provide for the smooth refilling with liquid is acceptable.

Although, in this embodiment, the interval between the movable member 31 and the heat-generating member 2 is about 15 $\mu$m, the interval may be one in a range within which pressure produced by the generation of a bubble can be satisfactorily transmitted to the movable member 31.

(Third Embodiment)

Figure 7:
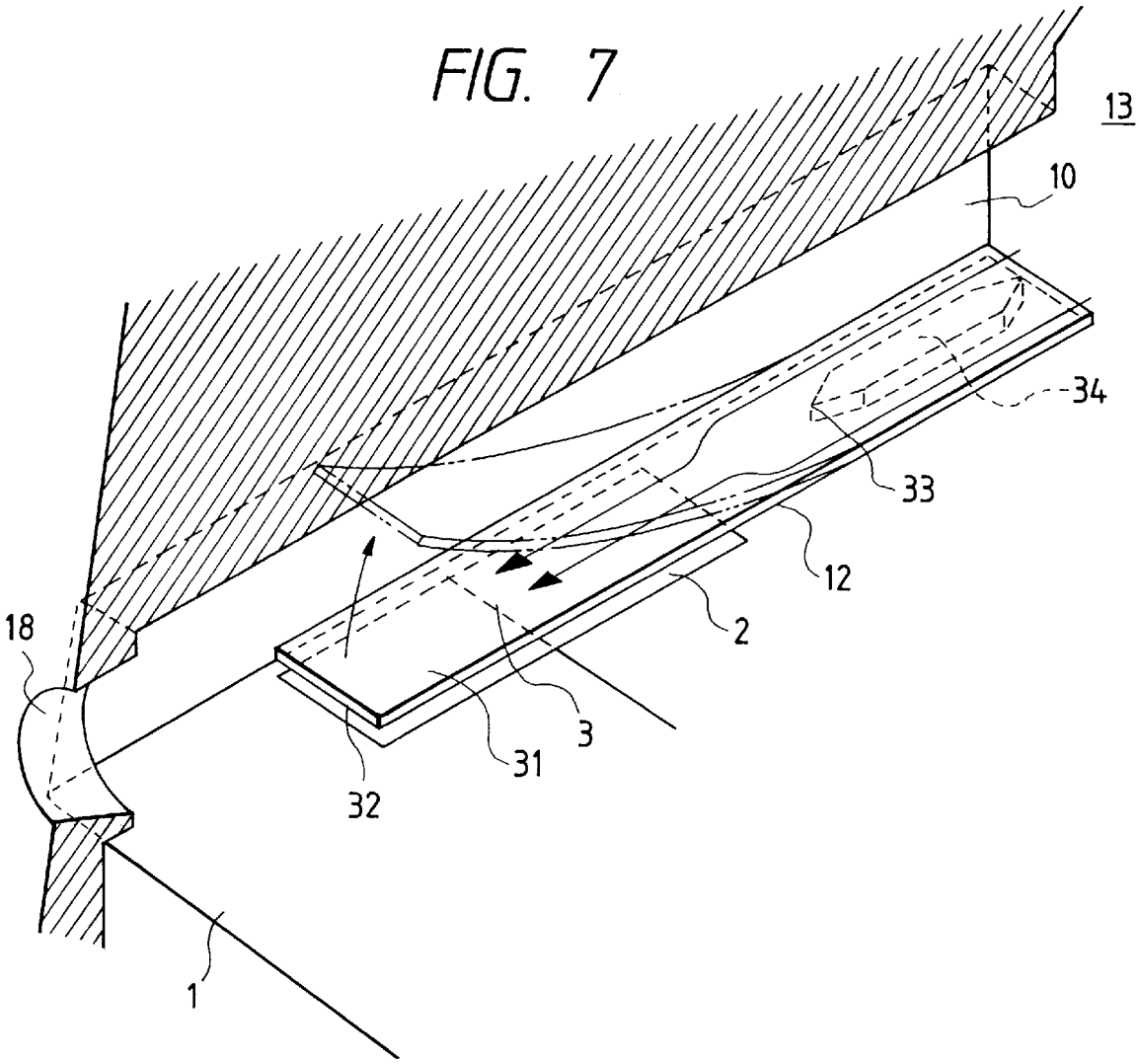
FIG. 7 is a partially cutaway perspective view of a liquid discharge head according to the third embodiment of the present invention.

FIG. 7 is a partial cutaway perspective view of a liquid discharge head according to the third embodiment of the present invention.

In both of the above embodiments, pressure exerted by a generated bubble is concentrated on the free end of the movable member 31, so that a drastic movement of the movable member 31 and the movement of the bubble are directed toward the discharge opening 18.

On the other hand, in the third embodiment, while a degree of freedom is provided for a generated bubble, the downstream portion of a bubble, near the discharge opening 18, that has a direct affect on the discharge of a droplet is restricted by the free end of the movable member 31.

In the structure shown in FIG. 7, compared with that in FIG. 2 (first embodiment), a convex portion which serves as a barrier that is positioned at the downstream end in the bubble-generating region on the device substrate 1, is not provided in this embodiment. In other words, the free end and the side end portions of the movable member 31 open the bubble-generating region relative to the discharge opening region, and do not substantially close it. This structure is employed for the third embodiment.

In this embodiment, since the distal end portion in the downstream portion of a bubble, which directly affects the discharge of a liquid droplet, is permitted to grow, the pressure components can be fully used for a discharge. In addition, the discharge efficiency is enhanced as in the above embodiments because the free end of the movable member 31 acts on the upward pressure in the downstream portion (partial pressures $V_2$, $V_3$ and $V_4$ in FIG. 3), so that the pressure is at least added to the growth of the downstream distal end portion of the bubble. Compared with the previous embodiments, this embodiment is superior in its response to the driving of the heat-generating member 2.

Since the structure in this embodiment is simple, this is an advantage in the manufacturing process.

The fulcrum of the movable member 31 in this embodiment is fixed to one base 34, which has a width that is smaller than that of the face of the movable member 31. Therefore, when a bubble disappears, liquid is supplied along both sides of the base 34 to the bubble-generating region 11 (see arrows in FIG. 7). This base 34 can have any structural shape so long as the supply of liquid is not hindered.

In the third embodiment, since a stream from upward to the bubble-generating region, which accompanies the disappearance of a bubble, is controlled by the presence of the movable member 31, the refilling with liquid during the supply is superior to that in a conventional bubble-generation structure that employs only a heat-generating member. The distance the meniscus is retracted can also be reduced.

As a modification of this embodiment, it is preferable that, while having the free end, the movable member 31 be substantially tightly closed from the bubble-generating region 11 only at both side ends (or one side end). With this structure, pressure that is directed toward the sides of the movable member 31 can also be redirected and employed for the growth of the bubble toward the end at which the discharge opening 18 is located. As a result, the discharge efficiency is further improved.

(Fourth Embodiment)

An explanation will now be given according to the fourth embodiment, in which a liquid discharge force by the above described mechanical displacement is further developed.

Figure 8:
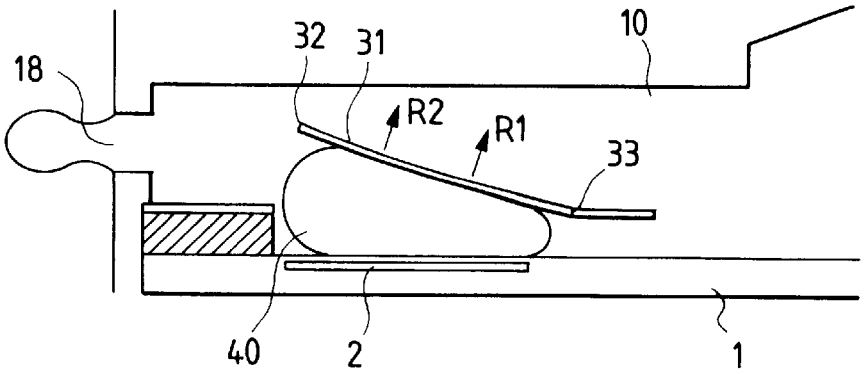
FIG. 8 is a cross-sectional view of a liquid discharge head according to the fourth embodiment of the present invention.

FIG. 8 is a cross-sectional view of a liquid discharge head according to the fourth embodiment of the present invention.

In FIG. 8, a movable member 31 is so extended that its free end 32 is positioned downstream from a heat-generating member 2. With this structure, the displacement speed of the movable member 31 at the position of the free end 32 can be increased, and the generation of a discharge force resulting from the displacement of the movable member 31 can be improved.

In addition, since the free end 32 is closer to the discharge opening 18 than are those in the previous embodiments, a bubble can grow mainly in a more stable direction, and accordingly, a more superior liquid discharge can be performed.

In accordance with the bubble growth speed in the pressure center of the bubble 40, the movable member 31 is displaced from a certain position at speed R1. The free end 32, which is farther from the fulcrum 33 than the certain position, is displaced at a higher speed R2. Thus, the free end 32 mechanically acts to displace liquid at a high speed and causes the movement of the liquid to enhance the discharge efficiency.

When the free end is so formed that it is perpendicular to the liquid stream, as in FIG. 7, the pressure from the bubble 40 and the mechanical operation of the movable member 31 can efficiently affect the discharge.

(Fifth Embodiment)

Figure 9A:
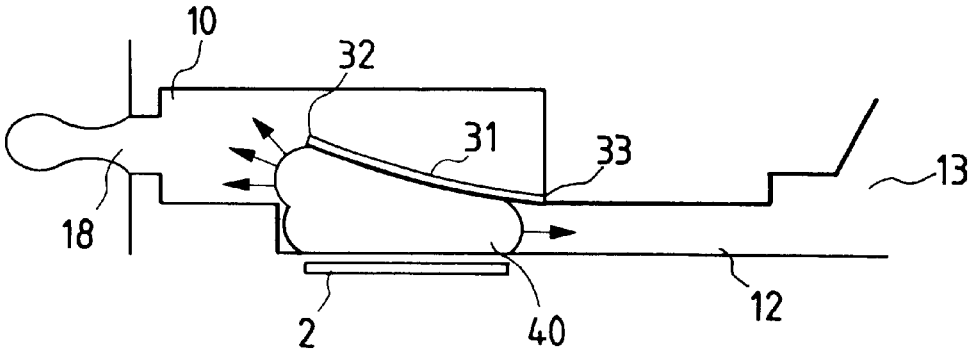
FIGS. 9A, 9B and 9C are specific cross-sectional views of a liquid discharge head according to the fifth embodiment of the present invention.
Figure 9B:
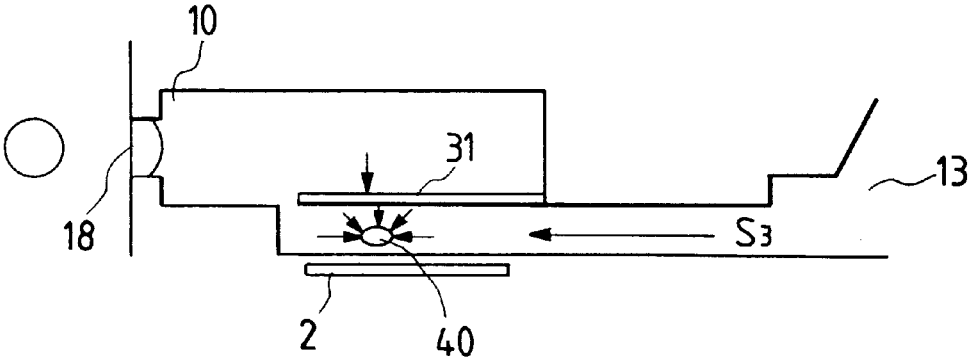
Figure 9C:
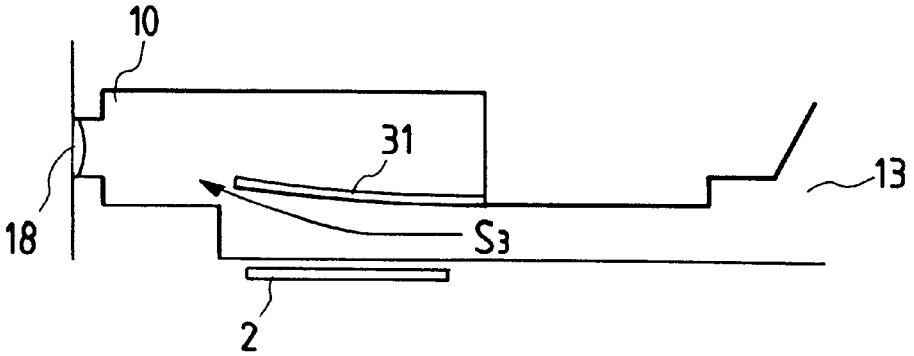

FIGS. 9A to 9C are specific cross-sectional views of a liquid discharge head according to the fifth embodiment of the present invention.

The structure in this embodiment differs from those in the previous embodiments. A region that directly communicates with a discharge opening 18 does not have a flow path shape that communicates with a liquid chamber, and the structure can be simplified.

Liquid is supplied only via a liquid supply path 12 along the face of a movable member 31 that is nearer a bubble-generating region. The positions of a free end 32 and a fulcrum 33 relative to the discharge opening 18, and the structure that faces a heat-generating member 2 are the same as those in the previous embodiments.

In this embodiment, the above described effects, such as discharge efficiency and the supply of liquid, are also achieved. In particular, the retraction of a meniscus is restricted, and for almost all liquid supply process, forcible refilling is performed by using pressure obtained when a bubble disappears.

In FIG. 9A is shown the condition where a bubble is generated in liquid by the heat-generating member 2. In FIG.

9B is shown the condition where the bubble is being shrunk. At this time, the movable member 31 is recovered to the initial position and liquid is supplied from the direction of arrow $S_3$.

In FIG. 9C is shown the condition after a bubble disappeared where the recovery of a meniscus M, which was slightly retracted when the movable member 31 was returned to its initial position, is effected by the capillary action near the discharge opening 18.

(Sixth Embodiment)

In this embodiment, the primary liquid discharge principle is the same as that in the previous embodiments. Since this embodiment provides a dual flow path structure, two liquid can be separately used as a liquid (bubble formation liquid) in which bubbles are generated by heating and a liquid (discharge liquid) mainly used for discharge.

Figure 10:
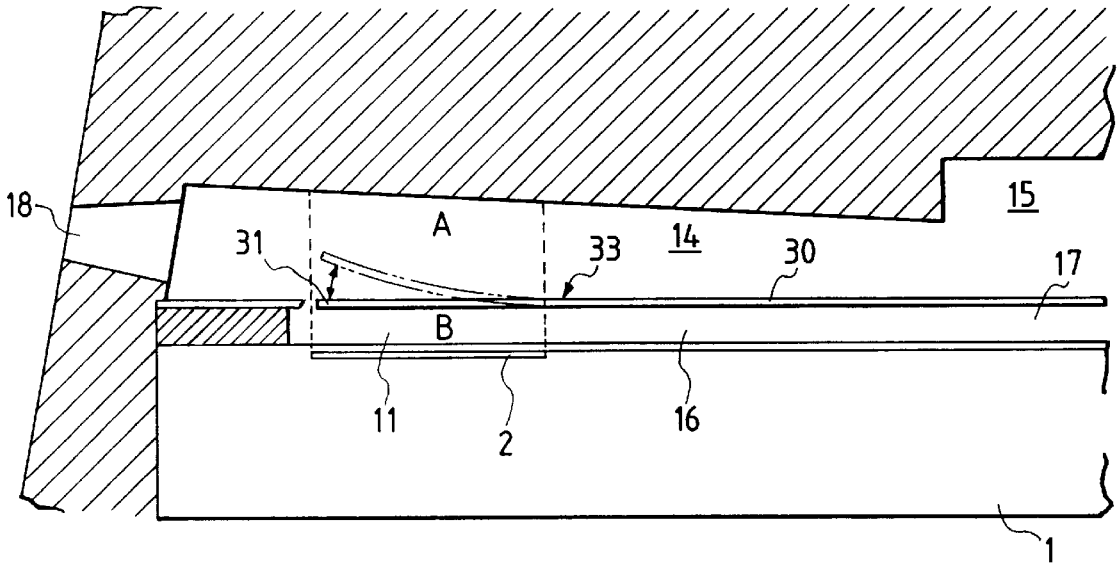
FIG. 10 is a cross-sectional view of a liquid discharge head (dual flow paths) according to the sixth embodiment of the present invention.
Figure 11:
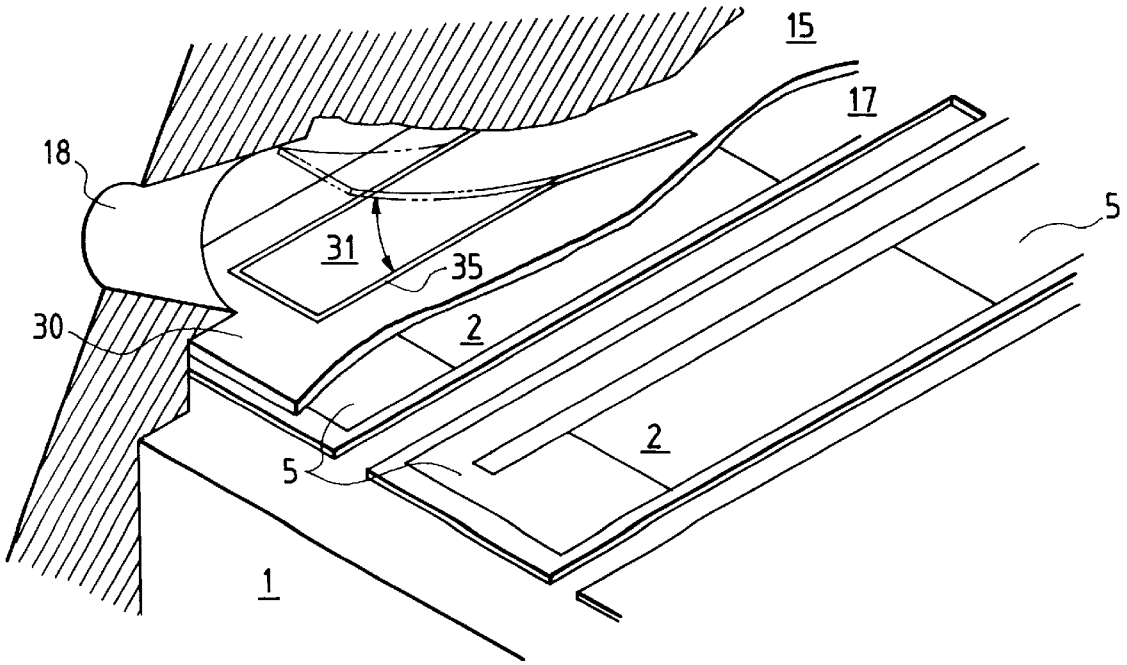
FIG. 11 is a partially cutaway perspective view of a liquid discharge head according to the sixth embodiment of the present invention.

FIG. 10 is a cross-sectional view of a liquid discharge head according to the sixth embodiment of the present invention, and FIG. 11 is a partial cutaway perspective view of the liquid discharge head according to the sixth embodiment of the present invention.

In the liquid discharge head of the present invention, a heat-generating member 2 is mounted on a device substrate 1 that provides thermal energy to liquid to generate bubbles. A second liquid flow path 16 for a bubble generation liquid is arranged on the device substrate 1, and above it, a first liquid flow path 14 for the discharge liquid is so arranged that it communicates directly with a discharge opening 18.

The upstream portion of the first liquid flow path 14 communicates with a first common liquid chamber 15 for supplying a discharge liquid to a plurality of first liquid flow paths 14. The upstream portion of the second liquid flow path 16 communicates with a second common liquid chamber 17 for supplying a bubble generation liquid to a plurality of second liquid flow paths 16.

When the bubble generation liquid and the discharge liquid are identical, only one common liquid chamber may be provided for use.

A partition wall 30, which is made of an elastic metal, is located between the first and the second liquid flow paths 14 and 16 to separate them. In the case of using the bubble generation liquid and the discharge liquid that should not be mixed, the distribution of the liquid along the first liquid flow path 14 and of the liquid along the second liquid flow path 16 should be separated as much as possible by the partition wall 30. If no problem occurs even when a bubble liquid and a discharge liquid are mixed to a degree, the partition wall 30 may not need to ensure a complete separation.

The portion of the partition wall 30 that is positioned in projection space above the face of the heat-generating member 2 (hereinafter referred to as discharge pressure generating region; a region A and a bubble-generating region 11 of a region B in FIG. 10) is a cantilever movable member 31. The movable member 31 has a free end extending toward the discharge opening 18 (downstream of the liquid flow) defined by a slit 35, and a fulcrum 33 positioned nearer the common liquid chambers 15 and 17. Since the movable member 31 is positioned facing to the bubble generating region 11 (B), when a bubble is generated in liquid, the movable member 31 is opened toward the discharge opening 18 at the side of the first liquid flow path 14, as is indicated by arrows in FIGS. 10 and 11). In FIG. 11, a heat resistance member, which serves as the heat-generating member 2, and a wire electrode 5 for applying an electric signal to the heat resistance member, are provided on the device substrate 1, and the partition wall 30 is also located on the substrate 1 via a space defining the second liquid flow path 16.

The positional relationship between the fulcrum 33 and the free end 32 of the movable member 31, and the heat-generating member 2 is the same as that in the previous embodiments.

While the structural relationship between the liquid supply path 12 and the heat-generating member 2 was explained in the previous embodiments, the same relationship is employed for the second liquid flow path 16 and the heat-generating member 2 in this embodiment.

The operation of the liquid discharge head in this embodiment will now be explained.

Figure 12A:
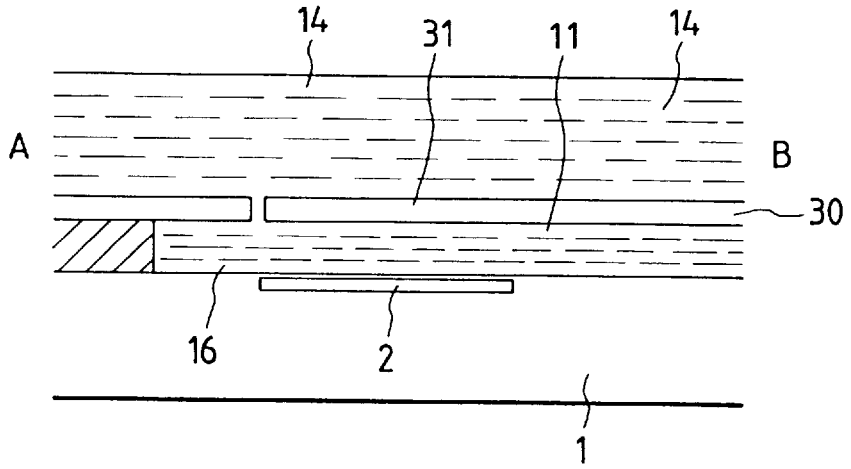
FIGS. 12A and 12B are diagrams for explaining the movement of a movable member.
Figure 12B:
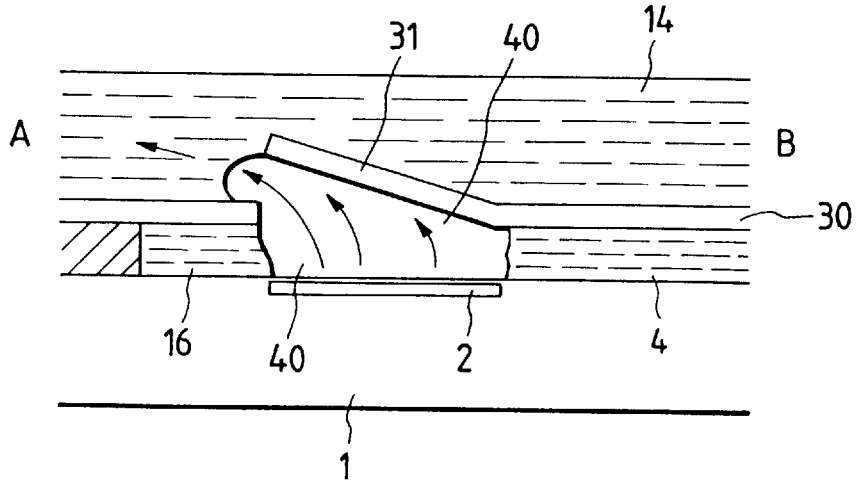

FIGS. 12A and 12B are diagrams for explaining the operation for the movable member 31.

To drive the head, the same aqueous ink is employed for the discharge liquid that is supplied to the first liquid flow path 14 and the bubble generation liquid that is supplied to the second liquid flow path 16.

When heat generated by the heat-generating member 2 acts on the bubble generation liquid in the bubble-generating region of the second liquid flow path 16, a bubble 40 is generated based on a film boiling phenomenon described in U.S. Pat. No. 4,723,129, as is described in the previous embodiments.

In this embodiment, bubble pressure does not escape in three directions, except for upstream in the bubble-generating region 11. Pressure attributable to bubble generation is transmitted mainly to the movable member 31, which is located in the discharge pressure generation section. With the growth of the bubble 40, the movable member 31 is displaced upward from the state in FIG. 12A toward the first liquid flow path 14 in FIG. 12B. Because of this displacement of the movable member 31, there is extensive communication between the first liquid flow path 14 and the second liquid flow path 16, and pressure due to the generation of the bubble 40 is transmitted mainly toward the discharge opening 18 (direction A) along the first liquid flow path 14. The transmission of pressure and the mechanical displacement of the movable member 31 discharges liquid from the discharge opening 18.

As the bubble 40 is shrunk, the movable member 31 is returned to the position shown in FIG. 12A and the quantity of the liquid equal to that of the discharged liquid, is supplied from upstream to the first liquid flow path 14. In this embodiment as well as the previous embodiments, the liquid is supplied in the direction in which the movable member 31 is closed, so that the refilling with the discharge liquid is not hindered by the movable member 31.

In this embodiment, the main action and the effects related to the transmission of bubble pressure accompanying the displacement of the movable member 31, the bubble growing direction, and the prevention of a backflow wave are the same as those in the first embodiment. The dual flow path structure shown in this embodiment provides an additional benefit as follows.

According to the above structure in this embodiment, the discharge liquid and the bubble generation liquid are separately used as different liquids, and the discharge liquid can be discharged by pressure generated by the production of a bubble in the bubble formation liquid. Therefore, even when a highly viscous liquid such as a polyethyleneglycol is employed in which bubble generation is inadequately performed by the application of heat and the discharge force is also unsatisfactory, this liquid can be supplied to the first liquid flow path 14 and discharged by supplying a liquid (about 1 to 2 cp of a mixture of ethanol and water at ratio of 4:6) in which bubble formation can be preferably generated, or a liquid having a low boiling point, to the second liquid flow path 16.

When a liquid that even upon the application of heat, does not cause scorching precipitate on the surface of the heat-generating member is selected as a bubble formation liquid, the generation of a bubble is stabilized and a preferable discharge can be performed.

Since the effects obtained by the previous embodiments are also acquired with the structure of the head of the present invention, a highly viscous liquid can be discharged with high discharge efficiency and a high discharge force.

In addition, when a liquid that is easily damaged by heat is supplied as the discharge liquid to the first liquid flow path 14, and when a liquid that is not easily affected by heat and can adequately generate a bubble is supplied to the second liquid flow path 16, the liquid that is easily damaged by heat will not suffer thermal damage and can be discharged with high discharge efficiency and with a high discharge force.

(Other Embodiment)

The liquid discharge head and the liquid discharge method of the present invention and the embodiments for the main portion have been explained. Other embodiments that the present invention can be adequately applied for will now be explained while referring to the drawings. In the following explanation, either the single flow path structure or the dual flow path structure described above is employed for the following embodiments. If which is employed is not specifically mentioned, the embodiments can be applied to both structures.

<Ceiling shape of liquid flow path>

Figure 13:
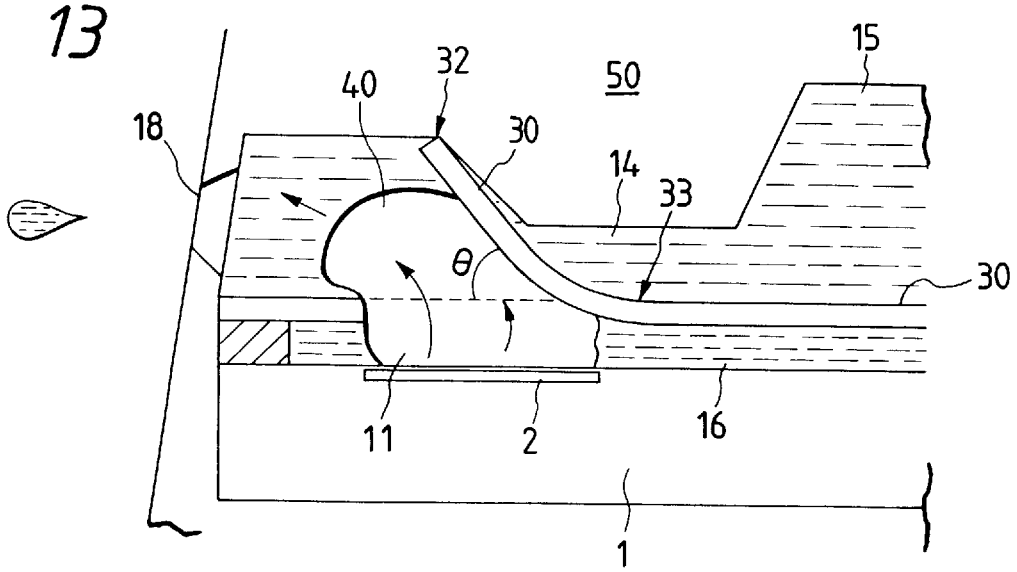
FIG. 13 is a diagram for explaining the structure of the movable member and the first flow path.

FIG. 13 is a diagram for explaining the arrangement for a movable member and the first liquid flow path.

As is shown in FIG. 13, a grooved member 50 is formed above a partition wall 30, and has a groove that serves as a first liquid flow path 13 (or a liquid flow path 10 in FIG. 1A). In this embodiment, the ceiling of the flow path near a free end 32 of the movable member 31 is higher, so that a large movement angle 0 for the movable member 31 can be obtained. The movement range of the movable member 31 can be determined by considering the structure of a liquid flow path, the durability of the movable member and the bubble generation force. It is preferable that the movable member 31 be moved at an angle that includes an angle in the axial direction of a discharge opening 18.

In addition, as is shown in FIG. 13, when the height of a position where the free end 32 of the movable member 31 is displaced is greater than the diameter of the discharge opening 18, a more adequate discharge force can be transmitted. Further, since the ceiling of the liquid flow path is lower at the fulcrum 33 of the movable member than at the free end 32, the escape of a pressure wave toward upstream, which is caused by the displacement of the movable member, can be more effectively prevented.

<Positional relationship of second liquid flow path and movable member>

Figure 14A:
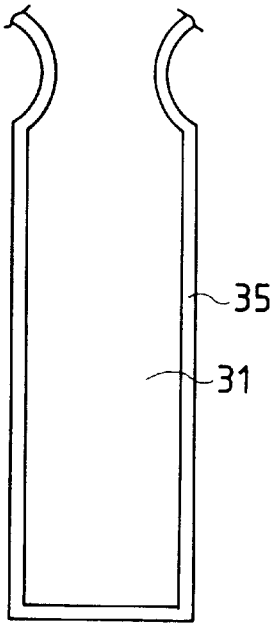
FIGS. 14A, 14B and 14C are diagrams for explaining the structures of the movable member and the flow path.
Figure 14B:
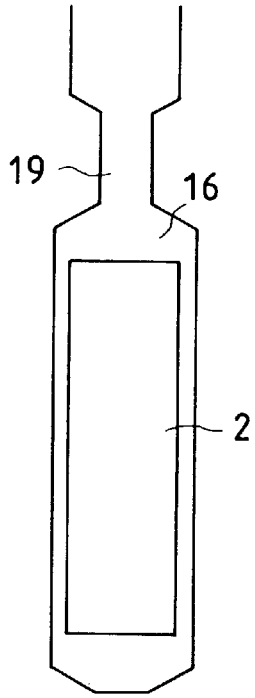
Figure 14C:
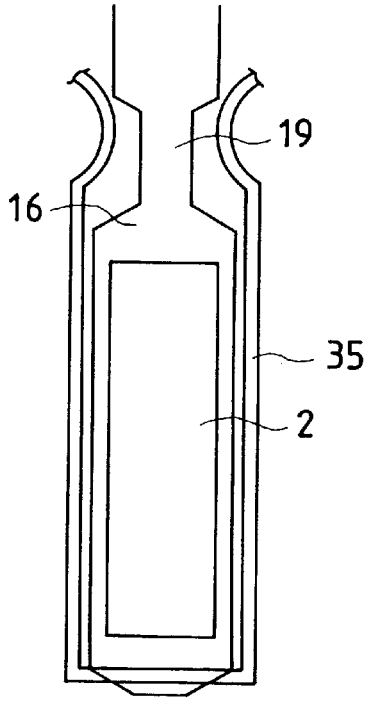

FIGS. 14A to 14C are diagrams for explaining the structure for a movable member and a liquid flow path. FIG. 14A is a top view of a partition wall 30 and a movable member 31; FIG. 14B is a top view of a second liquid flow path 16 with the partition wall 30 removed; and FIG. 14C is a specific diagram showing the positional relationship of the movable member 31 and a second liquid flow path 16 by overlapping these components. The lower side in each drawing is a front side where a discharge opening is located.

The second liquid flow path 16 in this embodiment has a narrow portion 19 at the upstream side of the heat-generating member 2 (the upstream side as mentioned here is an upstream side in a large stream that flows from the second common liquid chamber through the location of the heat-generating member, the movable member and the first liquid path to the discharge opening). Thus, a chamber (bubble generation chamber) structure is provided where the pressure exerted during bubble generation is prevented from easily escaping upstream in the second liquid flow path 16.

For a conventional head wherein the same liquid flow path is employed for bubble generation and for liquid discharge, and wherein a narrow portion is provided so that pressure generated in the liquid chamber by the heat-generating member is prevented from escaping to the common liquid chamber, the cross-sectional area of the liquid flow path at the narrowing portion should not be too small while fully taking the refilling with liquid into consideration.

In this embodiment, most of the liquid to be discharged is the discharge liquid in the first flow path, while not much bubble generation liquid in the second liquid flow path in which the heat-generating member is provided is consumed, and therefore a small quantity of bubble generation liquid is required to refill the bubble-generating region 11 in the second liquid flow path. Accordingly, since the distance at the narrow portion 19 is very short, ranging from several $\mu$m to several ten $\mu$m, the pressure that is exerted in the second liquid flow path as a result of bubble generation can be prevented from escaping, and can be mainly transmitted toward the movable member 31. Further, since this pressure can be used via the movable member 31 as a discharge force, the discharge efficiency and the discharge force can be further increased. The shape of the first liquid flow path is not limited to the above described structure; any shape can be adopted that permit pressure accompanying the generation of a bubble to be effectively transmitted to the movable member 31.

As is shown in FIG. 14C, the sides of the movable member 31 extend over the part of the wall that constitutes the second liquid flow path, so that the movable member 31 can be prevented from falling into the second liquid flow path. With this structure, a more adequate separation of the discharge liquid and the bubble generation liquid can be provided. In addition, since the escape of a bubble through the slit can be prevented, the discharge pressure and discharge efficiency can be further increased. Furthermore, the refilling effect provided by upstream pressure when a bubble disappears can be enhanced.

In FIGS. 12B and 13, as the movable member 31 is displaced upward into the first liquid flow path 14, part of the bubble 40 that is generated in the bubble-generating region 11 in the second liquid flow path 16 is expanded and enters to the first liquid flow path 14. Since the height of the second liquid flow path is such that a bubble is expanded and enters the other flow path, the discharge force in this case can be improved more than in a case that a bubble is not expanded. In order to expand the bubble so it enters the first liquid flow path 14, it is preferable that the height of the second liquid flow path 16 be less than the maximum height of the bubble; preferably, its height should be set to be several $\mu$m to 30 $\mu$m. In this embodiment, the height of the second liquid flow path is 15 $\mu$m.

<Movable member and partition wall>

Figure 15A:
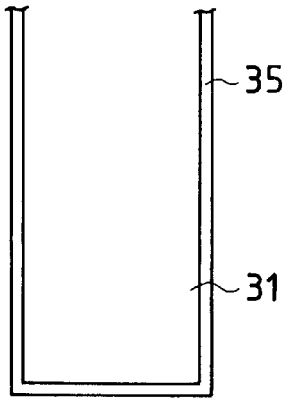
FIGS. 15A, 15B and 15C are diagrams for explaining another shape of the movable member.
Figure 15B:
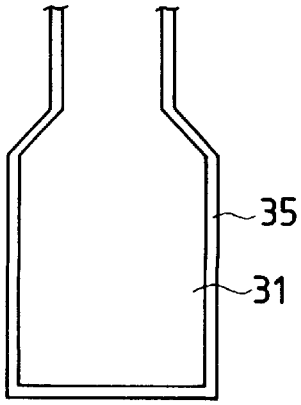
Figure 15C:
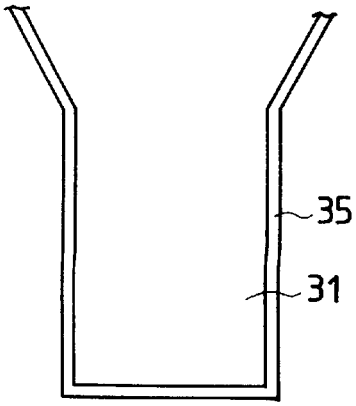

FIGS. 15A to 15C are diagrams for explaining a movable members having other shapes. FIG. 15A is a diagram showing a rectangular movable member; FIG. 15B is a diagram showing a movable member, the fulcrum side of which is narrowed to facilitate the movement of the movable member. FIG. 15C is a diagram showing a movable member, the fulcrum side of which is widened to improve the durability of the movable member.

In FIGS. 15A to 15C, a slit 35 is formed in a partition wall, and forms a movable member 31. Although a preferable shape for easy movement and for durability is that shown in FIG. 14A, where the width at the fulcrum is narrowed and has an arced shape, the movable member may be given any shape that will not enter the second liquid flow path, that can be easily moved and that has superior durability.

In the previous embodiments, the movable member 31 having a plate shape, and the partition wall 5 bearing this movable member 31 were made of nickel, 5 μm thick. The material that can be used is not limited to this; any material may be employed that has a solvent resistance for the bubble generation liquid and the discharge liquid, that is elastic enough to provide adequate movement as a movable member, and in which a minute slit can be formed.

As the movable member having high durability, the following materials are preferable: a metal such as silver, nickel, gold, iron, titanium, aluminum, platinum, tantalum, stainless steel or phosphor bronze, or an alloy of them; or a resin containing a nitrile group such as acrylonitrile, butadiene or styrene, a resin containing an amide group such as polyamide, a resin containing a carboxyl group such as polycarbonate, a resin containing an aldehyde group such as polyacetal, a resin containing a sulfone group such as polysulfone, a resin such as liquid crystal polymer, or a compound of them. As the movable member having high ink resistance, the following material are preferable: a metal such as gold, tungsten, tantalum, nickel, stainless steel or titanium, or an alloy of them; a material coated with one of the high ink resistant metallic materials as described above; a resin containing an amide group such as polyamide, a resin having an aldehyde group such as polyacetal, a resin containing a ketone group such as polyetheretherketone, a resin containing an imide group such as polyimide, a resin containing a hydroxyl group such as phenol resin, a resin containing an ethyl group such as polyethylene, a resin containing an alkyl group such as polypropylene, a resin containing an epoxy group such as epoxy resin, a resin containing an amino group such as melamine resin, a resin containing a methylol group such as xylene resin, or a compound of them; or a ceramic such as silicon dioxide, or a compound containing it.

For the partition wall, the following materials are preferable: polyethylene, polypropylene, polyamide, poly (ethylene terephthalate), melamine resin, phenol resin, epoxy resin, polybutadiene, polyurethane, polyether etherketone, polyether sulfone, polyarylate, polyimide, polysulfone, liquid crystal polymer (LCP) or other resins that have been produced for recently engineered plastic and that have satisfactory heat resistance, solvent resistance and formability, or a compound of them; silicon oxide; silicon nitride; a metal such as nickel, gold or stainless steel, an alloy or a compound; or a material coated with titanium or gold.

To provide sufficient strength for a partition wall and satisfactory movement as a movable member, the thickness of the partition wall must be determined while taking into consideration the material used and the shape. Preferably, the thickness of 0.5 μm to 10 μm is preferred.

In this embodiment, the width of the slit 35 for forming the movable member 31 is 2 μm. When the bubble formation liquid and discharge liquid differ, and when the mixing of these liquids is to be prevented, the slit width only need be so set that a meniscus is formed between the two liquids to restrict the dispersal of the liquids. When, for example, a liquid of about 2 cp (centipoise) is employed as a bubble formation liquid, and a liquid more than 100 cp is employed as a discharge liquid, the mixing of these liquids can even be prevented with a slit having a width of 5 μm. Preferably, however, the width of a slit is 3 μm or less.

The thickness (t μm) of μm order is employed for the movable member in this invention, and one having a thickness of cm order is not included. When the slit has a width (W μm) of μm order, it is preferable that manufacturing variance be taken into account for a movable member having a thickness of μm order.

When the thickness of the free end of the movable member, which is formed by a slit, or/and the thickness of the member directed to the side end, is equal to the thickness of the movable member (FIGS. 12A, 12B and 13), the relationship between the slit width (W) and the thickness (t) is set in a following range while taking manufacturing variance into consideration. Thus, the mixing of the bubble formation liquid and the discharge liquid can be stably restricted. From the viewpoint of design, when a highly viscous ink (5 cp, 10 cp, etc.) is employed relative to a bubble formation liquid of 3 cp, so long as $W/t \leqq 1$ is satisfied, the mixing of the two liquids can be prevented for a long period of time, even under limited conditions.

When a slit formed in this invention has a width of several μms, its function for providing a "substantially sealed condition" can be ensured.

As is described above, when different liquids are used for bubble generation and for discharge, the movable member serves substantially as a partition member. As the movable member is moved in accordance with the generation of a bubble, a little bubble generation liquid may be seen to enter the discharge liquid. While taking into account the fact that, for ink-jet recording, discharge liquid for forming an image generally has a color density of 3% to 5%, even when the content of the bubble generation liquid in a discharge liquid droplet is 20% or less, no great change occurs in the density. Therefore, the present invention includes a mixture of bubble generation liquid and discharge liquid where the content of the bubble generation liquid is 20% or less of a discharge liquid droplet.

In the above embodiment, when the viscosity is changed, the content of the bubble generation liquid in a liquid mixture is 15% at the maximum. The mixture ratio for a bubble generation liquid of 5 cp or less is 10% at the maximum, even though it depends on a driving frequency.

In particular, when the viscosity of discharge liquid is 20 cp or less, the mixing ratio for the bubble formation liquid can be reduced (e.g., to 5% or lower).

The positional relationship of heat-generating members and movable members will now be described while referring to the drawings. The shapes, sizes, and numbers of the movable members and the heat-generating members are not limited to the following. In an optimal arrangement of a heat-generating member and a movable member, a pressure exerted due to a bubble generated by the heat-generating member can be used effectively as a discharge pressure.

Figure 16:
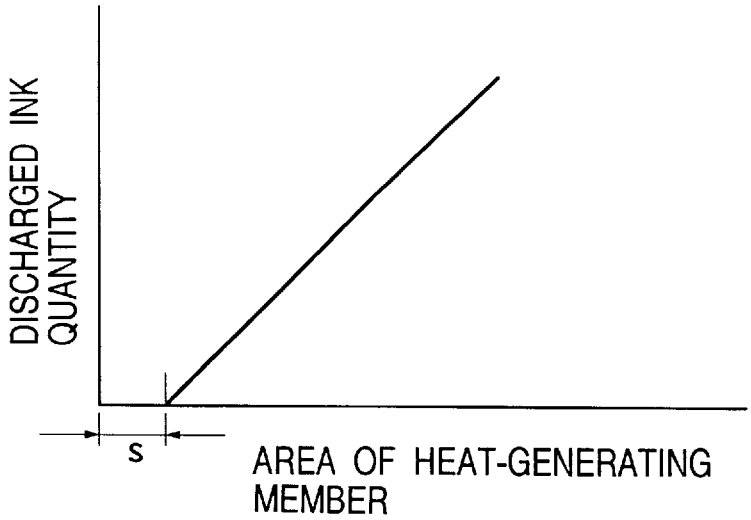
FIG. 16 is a graph showing the relationship between the area of a heat-generating member and a discharged ink quantity.

FIG. 16 is a graph showing the relationship between the area of the heat-generating member and the discharged ink quantity.

According to a conventional ink-jet recording method, a so-called bubble-jet recording method, the conditional change that accompanies a drastic change in ink volume (generation of a bubble) is caused by applying thermal energy to ink, and the ink is discharged from a discharge opening by the force exerted by the conditional change and is landed on a recording medium to form an image. As is shown in FIG. 16, the area of the heat-generating member and the discharged ink quantity are proportional, and a non-bubble-effective region S exists that does not contribute to the discharge of ink. In addition, from the scorching on the heat-generating member, it is found that the non-bubble-effective area S is formed around the heat-generating member. From these results, an area about 4 μm wide around the heat-generating member is not concerned with the bubble generation.

To fully employ a bubble pressure, the movable member is so located that the movable portion of the movable member covers the area immediately above the effective bubble generating area, i.e., the inside area of the heat-generating member except a width of about 4 μm or more measured inward from the edge of the heat-generating member. In this embodiment, the effective bubble generating area is defined as the inside area except a width of about 4 μm or more measured inward from the circumference of the heat-generating member. This area is not limited to this, and can vary, depending on the heat-generating member type and the formation method.

Figure 17A:
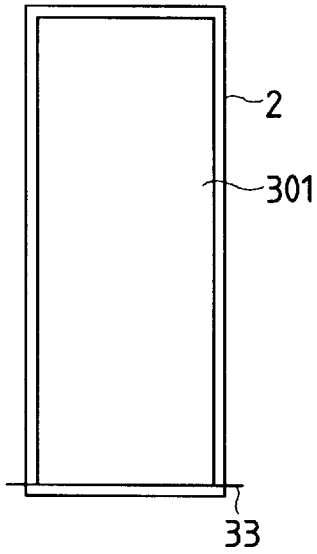
FIGS. 17A and 17B are diagrams each showing the positional relationship between a movable member and a heat-generating member.
Figure 17B:
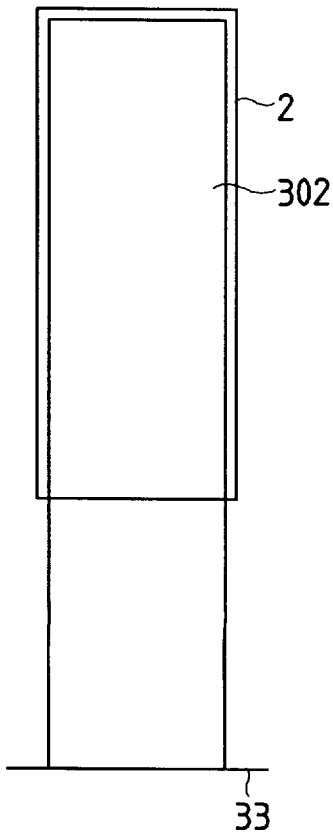

FIGS. 17A and 17B are specific top views showing the positional relationship between a movable member and a heat-generating member. The movable members 301 (FIG. 17A) and 302 (FIG. 17B), which differ in total movable area, are arranged for a heat-generating member 2 of 58×150 μm.

The size of the movable member 301 is 53×145 μm, smaller than the area of the heat-generating member 2 and as large as the effective bubble generating area of the heat-generating member 2. The movable member 301 is so located that it covers the effective bubble generating area. The size of the movable member 302 is 53×220 μm, larger than the area of the heat-generating member 2 (with the same width, the length between the fulcrum and the movable tip end is longer than the length of the heat-generating member). Like the movable member 301, the movable member 302 is so located that it covers the effective bubble generating area. The durability and discharge efficiency for two movable members 301 and 302 were measured under the following conditions.

| | |
|---|---|
| bubble formation liquid: | 40% ethanol aqueous solution |
| discharge ink: | dye ink |
| voltage: | 20.2 V |
| frequency: | 3 kHz |

As to the results obtained through the experiment, for the durability of the movable members, damage was observed at the fulcrum of the movable member 301 when $1\times10^7$ pulses were applied, while no damage was observed for the movable member 302 even when $3\times10^8$ pulses were applied. The kinetic energy obtained by a discharge quantity and a discharge speed relative to the input energy was increased about 1.5 to 2.5 times.

As is apparent from the above results, for durability and discharge efficiency it is better that the movable member be provided to cover the area immediately above the effective bubble generating area, and that the area of the movable member be greater than the area of the heat-generating member.

Figure 18:
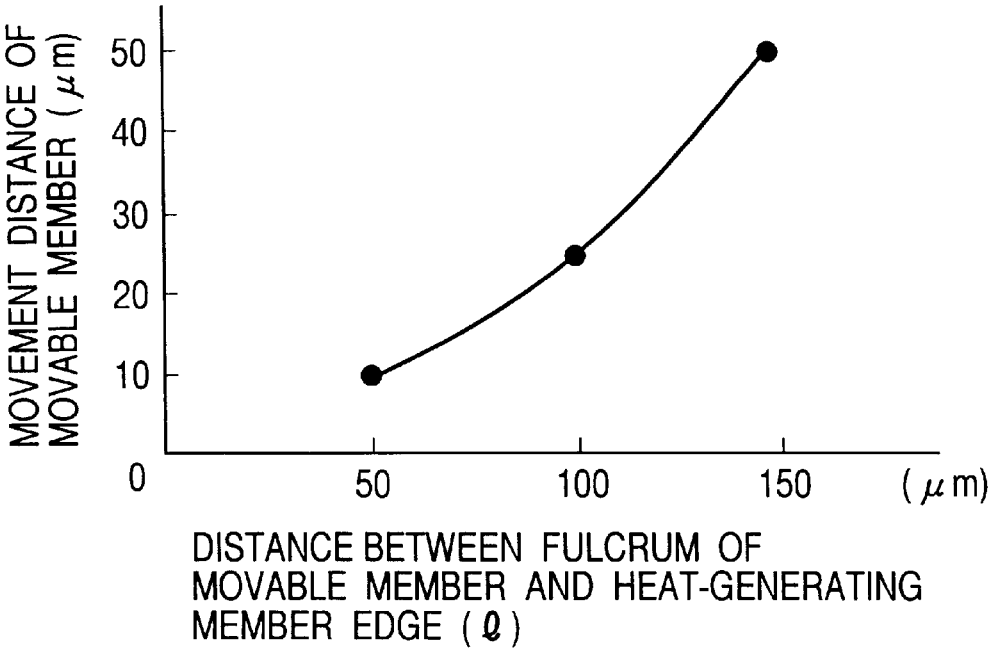
FIG. 18 is a graph showing the relationship between a distance from the edge of the heat-generating member and a fulcrum, and a movement distance for a movable member.
Figure 19:
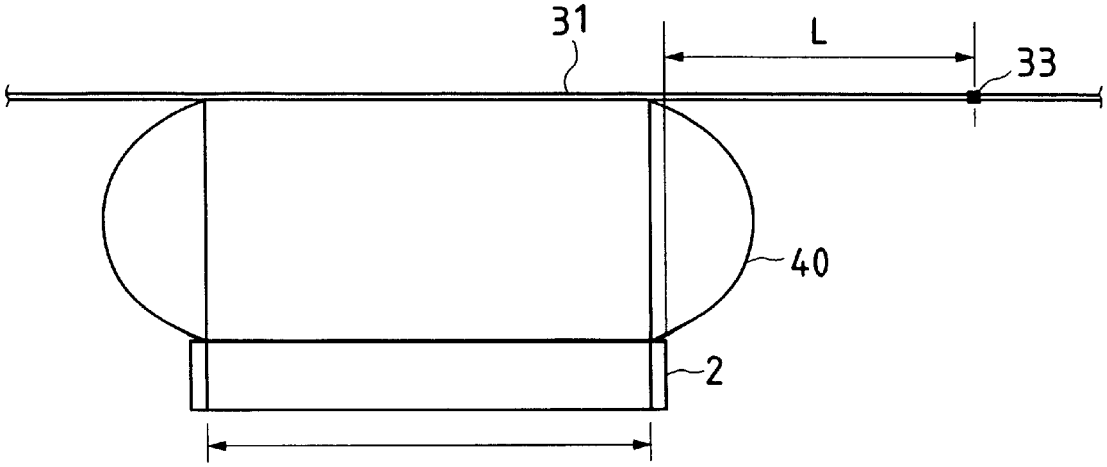
FIG. 19 is a diagram for explaining the positional relationship between the heat-generating element and the movable member.

FIG. 18 is a graph showing the relationship for the distance from the edge of a heat-generating member 2 to the fulcrum of a movable member 31, and a displacement distance for the movable member 31. FIG. 19 is a cross-sectional view of the structure from the side, showing the positional relationship of the heat-generating member 2 and the movable member 31.

A large heat-generating member 2 of 40×105 μm is employed. It has been found that the displacement distance becomes greater as the distance L between the edge of the heat-generating member 2 and a fulcrum 33 of the movable member 31 becomes longer. Therefore, it is preferable that, while taking into consideration a quantity of ink that is required to be discharged, a flow path structure for discharge liquid and the shape of the heat-generating member, the optimal displacement be acquired and the position of the fulcrum of the movable member be determined.

When the fulcrum of the movable member is positioned immediately above the effective bubble generating area of the heat-generating member, not only the stress due to the displacement of the movable member, but also bubble pressure is directly applied to the fulcrum, so that the durability of the movable member is deteriorated. According to the experiment conducted by the present inventor, it was confirmed that when the fulcrum was located immediately above the effective bubble generating area, the movable member was damaged by application of $1\times10^6$ pulses, and the durability was deteriorated. Therefore, the fulcrum of the movable member should be located at a position other than immediately above the effective bubble generating area of the heat-generating member, so that possibility of practical use becomes larger even by using a movable member that is formed in a low durable shape and of a low durable material. Even a movable member, the fulcrum of which is located immediately above the effective bubble generating area, can be employed so long as the shape of and material selected for the movable member are adequate. With the above described structure, provided is a liquid discharge head that is superior in discharge efficiency and durability.

<Device substrate>

The structure of a device substrate on which is provided a heat-generating member for applying heat to liquid will now be described.

Figure 20A:
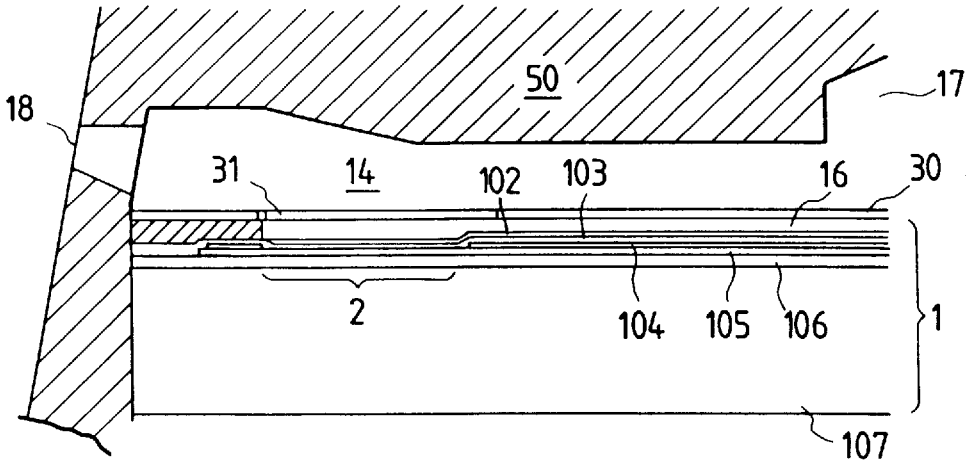
FIGS. 20A and 20B are vertical cross-sectional views of a liquid discharge head according to the present invention.
Figure 20B:
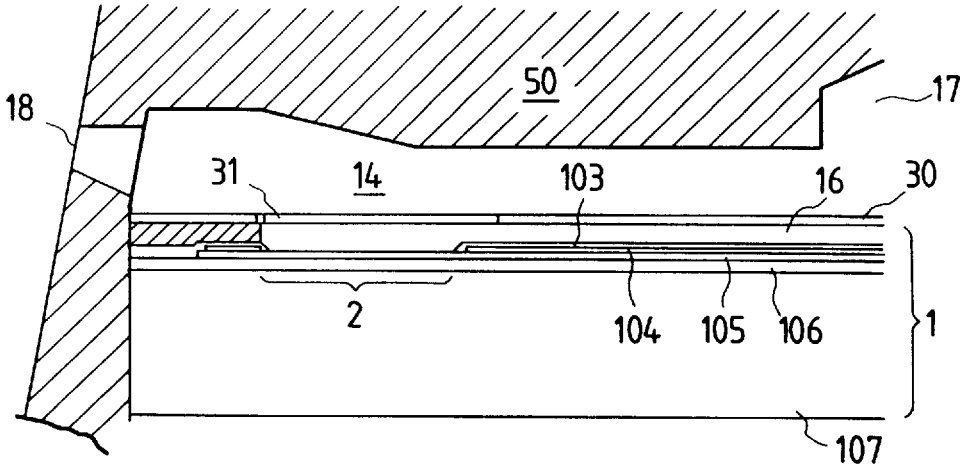

FIGS. 20A and 20B are vertical cross-sectional views of a liquid discharge head according to the present invention. In FIG. 20A is shown a liquid discharge head having a protective film which will be described later, and in FIG. 20B is shown a liquid discharge head having no protective film.

A device substrate 1 comprises a second liquid flow path 16, a partition wall 30, a first liquid flow path 14 and a grooved member 50 having a groove to constitute and the first liquid flow path 14.

For production of the device substrate 1, a silicon oxide film or a silicon nitride film 106 for insulation and for the accumulation of heat is deposited on a silicon substrate 107. An electric resistance layer 105 (0.01 to 0.2 μm thick) such as of hafnium boraide ($HfB_2$), tantalum nitride (TaN) or tantalic aluminum (TaAl) for forming a heat-generating member, and two wiring electrodes 104 (0.2 to 1.0 μm thick) such as of aluminum, are patterned on the film 106, as is shown in FIGS. 20A and 20B. A voltage is applied to the resistance layer 105 from the two wiring electrodes 104, and a current is provided through the resistance layer 105 to generate heat. A protective layer with 0.1 to 2.0 μm thickness, such as silicon oxide or silicon nitride, is deposited on the resistance layer 105 between the wiring electrodes 104, and thereon, an anticavitation layer (0.1 to 0.6 μm thick), such as tantalum, is deposited to protect the resistance layer 105 from various liquids, such as ink.

Particularly since the pressure and an impact wave generated when a bubble is generated or disappears are very strong and deteriorate the durability of oxide film that is rigid and weak, a metal such as tantalum (Ta) is used as an anticavitation layer.

The structure may not require the above protective layer, by depending on the liquid type, the liquid flow path structure and the combination of resistance materials. An example of such a structure is shown in FIG. 20B. The material for a resistance layer that does not require a protective layer is an iridium-tantalum-aluminum alloy.

As is described above, for the structures in the above embodiments, only the resistance layer (heat-generating portion) between the electrodes may be formed, or a protective layer to protect the resistance layer may also be formed.

In this embodiment, the heat-generating member has a heat-generating portion, including a resistance layer that generates heat in accordance with an electric signal. The heat-generating member is not limited to this example. A heat-generating member that generates an adequate bubble in bubble liquid for discharging liquid may be employed, such as a heat-generating member that has a photo-thermal converting member that generates heat upon receipt of a laser beam, or that has a heat-generating portion that generates heat upon receipt of a high frequency.

Further, not only the electro-thermal converting member comprising the resistance layer 105 that constitutes the heat-generating member and the wiring electrode 104 that supplies an electric signal to the resistance layer, but also functional devices such as a transistor, a diode, a latch and a shift register, for selectively driving the electro-thermal converting member, may be integrally formed in the substrate device 1 by the semiconductor fabrication procedure.

Figure 21:
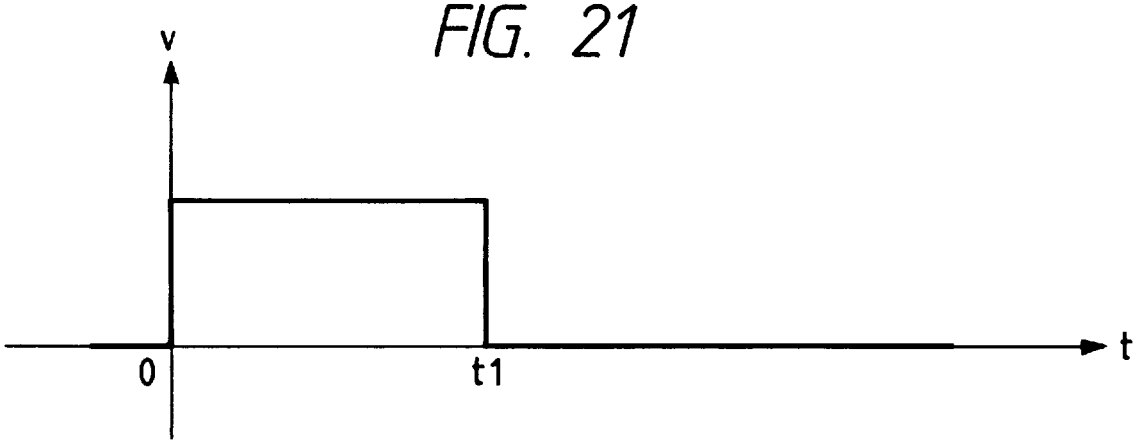
FIG. 21 is a specific diagram illustrating the shape of a driving pulse.

To drive the heat-generating portion in the electro-thermal converting member on the device substrate 1 and to discharge liquid, a rectangular pulse shown in FIG. 21 is applied to the resistance layer 105 from the wiring electrodes 104, and the resistance layer 105 between the wiring electrodes 104 is heated drastically.

FIG. 21 is a specific diagram showing the shape of a driving pulse.

In the head for each previous embodiment, the heat-generating member is driven by application of a voltage of 24 V, a pulse width of 7 $\mu$sec, current 150 mA, and an electric signal of 6 kHz, so that the previously mentioned operation is performed to discharge ink from the discharge opening. The conditions for a driving signal are not limited to those described above, and a drive signal that can adequately generate bubbles in liquid may be employed.

<Head structure for dual flow path structure>

An explanation will now be given for an example of structure for a liquid discharge head wherein different liquids can be appropriately separated and introduced into first and second common liquid chambers, and for which the required number of components can be reduced to decrease manufacturing costs.

Figure 22:
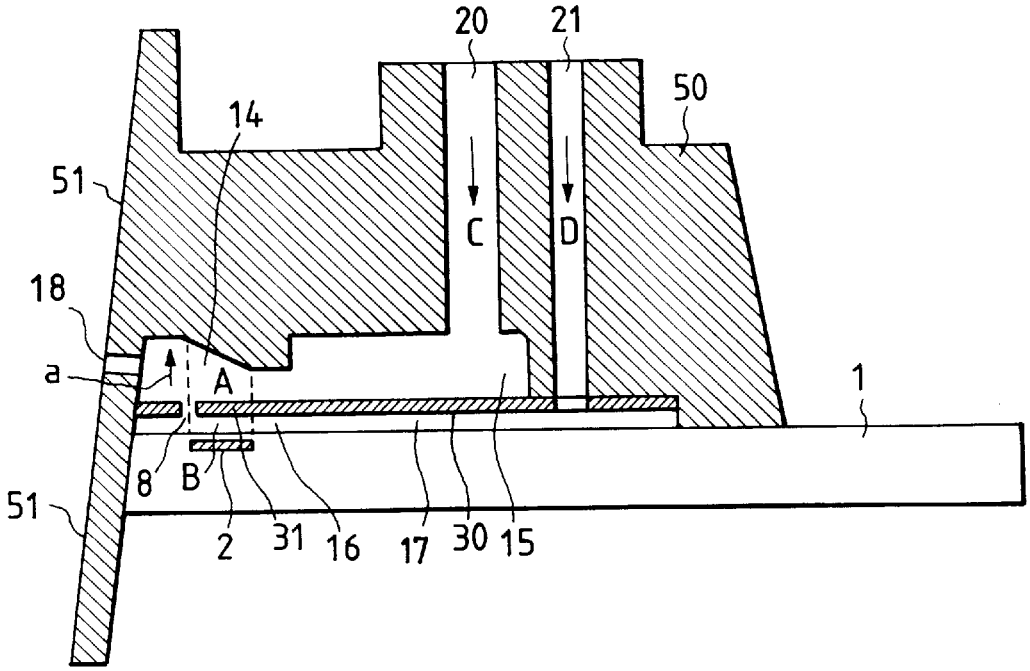
FIG. 22 is a cross-sectional view for explaining a supply path in a liquid discharge head according to the present invention.

FIG. 22 is a cross sectional view for explaining a supply path in a liquid discharge head according to the present invention. The same reference numerals as are used for the previous embodiments are also used to denote the same components, and no further explanation for them will be given.

In this embodiment, a grooved member 50 is constituted mainly by an orifice plate 51 having a discharge opening 18, a plurality of grooves serving as a plurality of first liquid flow paths 14, and a recessed portion that communicates with the first liquid flow paths 14 and that forms a first common liquid chamber 15 for supplying liquid (discharge liquid) to the first liquid flow paths 14.

The first liquid flow paths 14 can be formed by bonding a partition wall 30 to the lower portion of the grooved member 50. The grooved member 50 has a first supply path 20 that vertically penetrates the member 50 to reach the first common liquid chamber 15. Further, the grooved member 50 has a second liquid supply path 21 that vertically penetrates the member 50 to reach the second common liquid chamber 17 through the partition wall 30.

The first liquid (discharge liquid) is supplied along the first liquid supply path 20, to the first common liquid chamber 15, and to the first liquid flow paths 14, as is indicated by arrow C in FIG. 22. The second liquid (bubble generation liquid) is supplied along the second liquid supply path 21 to the second common liquid chamber 17 and to the second liquid flow path 16, as is indicated by arrow D in FIG. 22.

Although, in this embodiment, the second liquid supply path 21 is arranged in parallel with the first liquid supply path 20, the arrangement of the second liquid supply path is not limited to this. Any arrangement of the second liquid supply path may be determined so long as it penetrates the partition wall 30, which is located outside the first common liquid chamber 15, and communicates with the second common liquid chamber 17.

The width (diameter) of the second liquid supply path 21 is determined by taking into consideration of the quantity of the second liquid to be supplied. The shape of the second liquid supply path 21 is not necessarily round, and may be rectangular.

The second common liquid chamber 17 can be formed by combining the grooved member 50 with the partition wall 30. For example, as is shown in an exploded perspective view in this embodiment in FIG. 23, a common liquid chamber frame and the second liquid flow path wall are formed of a dry film on the device substrate, and the grooved member 50 to which the partition wall 30 is fixed is bonded to the device substrate 1, so that the second common liquid chamber 17 and the second liquid flow path 16 can be formed.

In this embodiment, as is described above, on a support member 70 formed of a metal such as aluminum, is provided the device substrate 1, in which a plurality of electro-thermal converting members are arranged that serve as heat-generating members for generating heat to produce bubbles in a bubble generation liquid by film boiling.

On the device substrate 1 are provided a plurality of grooves that constitute the liquid flow paths 16, which are formed with the second liquid flow walls; a recessed portion that communicates with a plurality of bubble generation liquid flow paths and that constitutes the second common liquid chamber (common bubble generation liquid chamber) 17 for supplying a bubble generation liquid to the individual bubble generation liquid flow paths; and the partition wall 30 provided with the movable members 31.

A grooved member 50 comprises: grooves that constitute discharge liquid flow paths (first liquid flow paths) when the grooved member 50 is bonded to the partition wall 30; a recessed portion that communicates with the discharge liquid flow paths and that constitutes the first common liquid chamber (common discharge liquid chamber) 15 for supplying a discharge liquid to the individual discharge liquid flow paths; a first supply path (discharge liquid supply path) 20 along which a discharge liquid is supplied to the first common liquid chamber; and a second supply path (bubble formation liquid supply path) 21 along which a bubble formation liquid is supplied to the second common liquid chamber 17. The second supply path 21 penetrates the partition wall 30, which is located outside the first common liquid chamber 15, and is connected to a channel that communicates with the second common liquid chamber 17. With this channel, the bubble formation liquid can be supplied to the second common liquid chamber 17 without being mixed with the discharge liquid.

According to the positional relationship between the device substrate 1, the partition wall 30 and the grooved member 50, the movable members 31 are so arranged that they correspond to the heat-generating members 2 in the device substrate 1, and discharge liquid flow paths 14 are so arranged that they correspond to the movable members 31. Although, in this embodiment, only one second supply path is formed for the grooved member, a plurality of supply paths may be formed in accordance with the quantity of a liquid to be supplied. Further, the cross-sectional areas of the discharge liquid supply path and the bubble generation liquid supply path 21 may be so determined that they are proportional to the supply quantity. By optimizing the cross-sectional areas of the paths, the sizes of components constituting the grooved member 50 can be made smaller.

As is described above, according to this embodiment, the second supply path, along which the second liquid is supplied to the second liquid flow path, and the first supply path, along which the first liquid is supplied to the first liquid flow path, are formed with the same grooved ceiling plate that is the grooved member. As a result, the components can be reduced, the manufacturing process can be shortened, and manufacturing costs can be lowered.

In addition, in this embodiment, the supply of the second liquid to the second common liquid chamber, which communicates with the second liquid flow path, is performed along the second liquid flow path in a direction such that the partition wall separating the first and the second liquids is penetrated. Therefore, the procedure for bonding the partition wall, the grooved member and the substrate having the heat-generating member need be performed only once, and the bonding accuracy is enhanced, resulting in a satisfactory liquid discharge.

Since the second liquid is supplied to the second liquid common liquid chamber through the partition wall, supply of the second liquid to the second liquid flow path is ensured, and a sufficient quantity of liquid can be supplied. As a result, a stable liquid discharge can be performed.

<Discharge liquid and bubble generation liquid>

As is described in the previous embodiments, according to the present invention, with the structure having the movable member, a liquid can be rapidly discharged with a greater discharge force and with higher discharge efficiency than that provided by a conventional liquid discharge head. When the same liquid is used for a discharge liquid and a bubble generation liquid, the liquid is not deteriorated by the heat applied by the heat-generating member, almost no precipitate is deposited on the heat-generating member even by heating, and reversible conditional changes of vaporization and condensation can be performed with heat. Further, various liquid can be employed that do not cause deterioration of the liquid flow paths, the movable member and the partition wall.

The composition of the liquid (recording liquid) to be used for recording can have the same as that of the ink used for a conventional bubble-jet apparatus.

On the other hand, when the liquid discharge head with the dual flow path structure of the present invention is used and the discharge liquid and the bubble generation liquid are different, the liquids having the above mentioned properties can be used as the bubble formation liquid. More specifically, the bubble generation liquid includes: methanol, ethanol, n-propanol, isopropanol, n-hexane, n-heptane, n-octane, toluene, xylene, methylene dichloride, triclene, Freon TF, Freon BF, ethylether, dioxan, cyclohexane, methyl acetate, ethyl acetate, acetone, methylethylketone, or water, or a mixture of them.

Various type of liquids can be used for the discharge liquid, regardless of the bubble production property and the thermal property. In addition, a liquid that has a low bubble production property, a liquid that is easily affected or deteriorated by heat, or a liquid with high viscosity, all of which are conventionally difficult to discharge, can also be used as the discharge liquid.

It is preferable that as the property of the discharge liquid it does not interfere with discharging, the production of bubbles, and the movement of the movable member because of a reaction of the liquid or a reaction with bubble generation liquid.

Highly viscous ink can also be used as a discharge liquid for recording. In addition, medical liquids that are easily damaged by heat and perfume liquids can be used as other example discharge liquids.

According to the present invention, ink having the following composition was employed as a recording liquid that can be used for both of a discharge liquid and a bubble generation liquid. Since the ink discharge speed was increased by the improvement of the discharge force, the accuracy in the application of liquid droplets on a recording medium was enhanced, and a very satisfactory recorded image could be obtained.

| | |
|---|---|
| Dye ink, viscosity 2 cp: (C.I. foodblack 2) dye | 3 wt % |
| diethyleneglycol | 10 wt % |
| thiodiglycol | 5 wt % |
| ethanol | 3 wt % |
| water | 77 wt % |

Further, the bubble generation liquids and the discharge liquids having the following compositions were employed together and the liquid was discharged for recording. As a result, not only a liquid having a viscosity of several ten cp, the discharging of which is difficult for a conventional head, but also a liquid having a high viscosity of 150 cp could be satisfactorily discharged, and a high quality image could be obtained.

| | | |
|---|---|---|
| Bubble generation liquid 1: | ethanol | 40 wt % |
| | water | 60 wt % |
| Bubble generation liquid 2: | water | 100 wt % |
| Bubble generation liquid 3: | isopropyl alcohol | 10 wt % |
| | water | 90 wt % |
| Discharge liquid 1: carbon black 5 pigment ink (viscosity of about 15 cp) | | 5 wt % |
| styrene-acrylic acid-acrylic acid ethyl copolymer (oxidation of 140, weight-average molecular weight of 8000) | | 1 wt % |
| monoethanolamine | | 0.25 wt % |
| glycerin | | 69 wt % |
| thiodiglycol | | 5 wt % |
| ethanol | | 3 wt % |
| water | | 16.75 wt % |
| Discharge liquid 2: polyethyleneglycol 200 (viscosity of 55 cp) | | 100 wt % |
| Discharge liquid 3: polyethyleneglycol 600 (viscosity of 150 cp) | | 100 wt % |

Conventionally, when a liquid that is difficult to discharge is employed, the low discharge speed exaggerates differences in the discharge direction and adversely affects the accuracy in the landing of dots on a recording medium, and as the quantity of liquid discharged varies due to the unstable discharge of liquid, an image of high quantity can not be easily obtained. With the structure in the above embodiments, bubbles are adequately and stably generated by using the bubble generation liquid to stably discharge a liquid having a high viscosity. And as a result, the accuracy in landing liquid droplets on a recording medium can be enhanced, the quantity of discharged ink can be stabilized, and accordingly, the quality of a recorded image can be considerably improved.

<Manufacture of liquid discharge head>

The process for manufacturing a liquid discharge head according to the present invention will now be described.

To manufacture a liquid discharge head shown in FIG. 2, the base 34, for supporting the movable member 31, was formed on the device substrate 1 by patterning a dry film. The movable member 31 was bonded or welded to the base 34. Then, a grooved member having a plurality of grooves that serve as the liquid flow paths 10, and a recessed portion that serves as the common liquid chamber 13, was bonded to the device substrate 1 so that the grooves corresponded to the movable members.

The process for manufacturing the liquid discharge head with the dual liquid flow path structure shown in FIGS. 10 and 23 will now be described.

Figure 23:
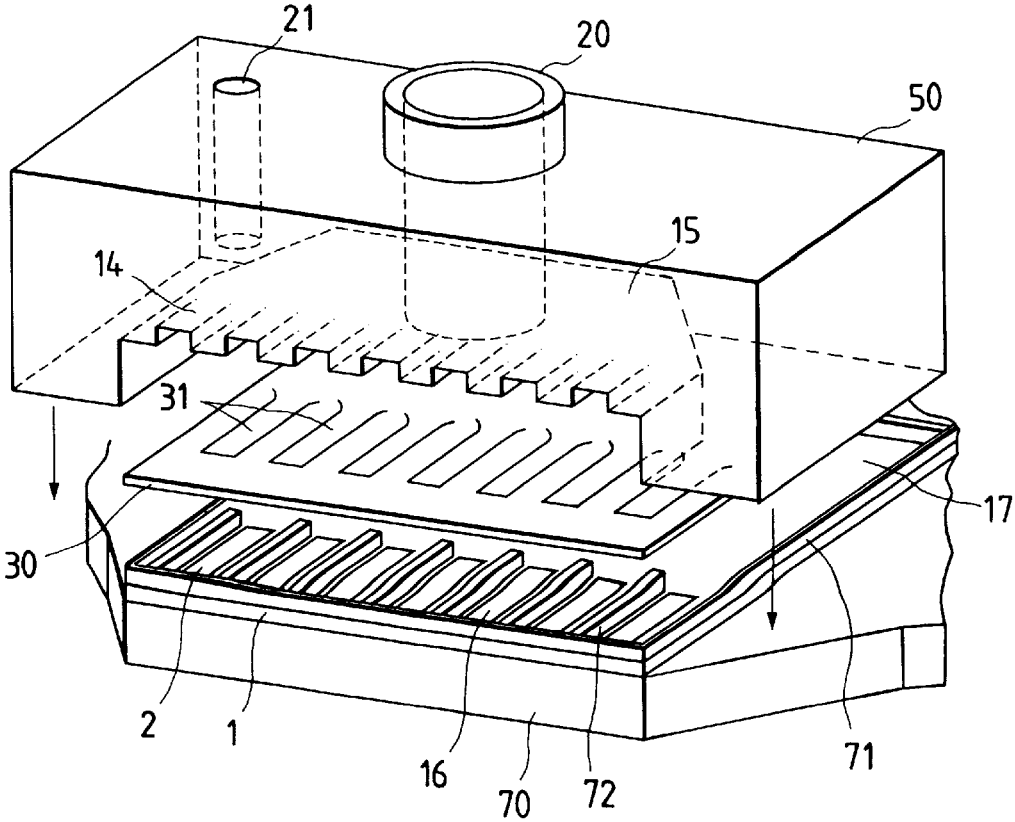
FIG. 23 is an exploded perspective view of a liquid discharge head according to the present invention.

FIG. 23 is an exploded perspective view of the liquid discharge head of the present invention.

Roughly speaking, the walls for second liquid flow paths 16 were formed on a device substrate 1, and a partition wall 30 was attached thereto. Then, a grooved member 50, in which grooves were formed to serve as first liquid flow paths 14, was bonded to the resultant structure. Otherwise, after the walls for the second liquid flow paths 16 were formed, the grooved member 50 to which the partition wall 30 was attached was bonded to the walls. The liquid discharge head was thereafter completed.

The method for fabricating the second liquid flow paths will now be described in detail.

FIGS. 24A to 24E are diagrams for explaining the method for manufacturing the liquid discharge head according to the present invention.

Figure 24A:
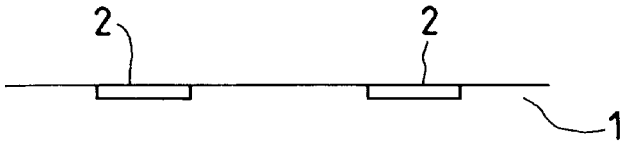
FIGS. 24A, 24B, 24C, 24D and 24E are diagrams showing the steps for explaining a method for manufacturing a liquid discharge head according to the present invention.

In this embodiment, as is shown in FIG. 24A, an electrothermal converting element having a heat-generating member 2 made of hafnium boraide or tantalum nitride, was formed on a device substrate (silicon wafer) 1 using the same manufacturing apparatus as is used in a semiconductor fabrication procedure. Then, the surface of the device substrate 1 was rinsed to improve the adhesiveness for the application of a photosensitive resin at the following step. To further enhance the adhesiveness, surface modification using ultraviolet ray-ozone was performed for the surface of the device substrate, and a solution containing a silane coupling agent (A189, produced by Nihon Unika Co., Ltd.) was diluted to 1 weight % with ethyl alcohol and was spin-coated on the modified surface.

Figure 24B:
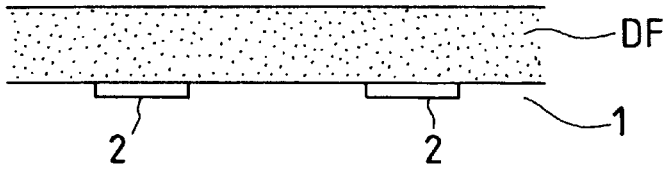

Then, the surface was rinsed, and an ultraviolet photosensitive resin film (dry film ordil SY-318, produced by Tokyo Ohka Kogyo Co., Ltd.) DF was laminated on the substrate 1 having improved adhesiveness, as is shown in FIG. 24B.

Figure 24C:
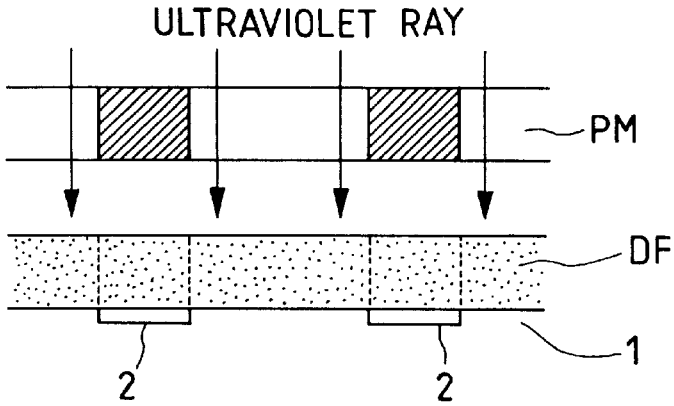

As is shown in FIG. 24C, a photomask PM was arranged above the dry film DF, and ultraviolet rays were used to irradiate, via the photo mask PM, a portion of the dry film DF that remained as the second flow path wall. This exposure step was performed with an exposure quantity of about 600 mJ/cm$^2$ using a MPA-600 produced by Canon Inc.

Figure 24D:
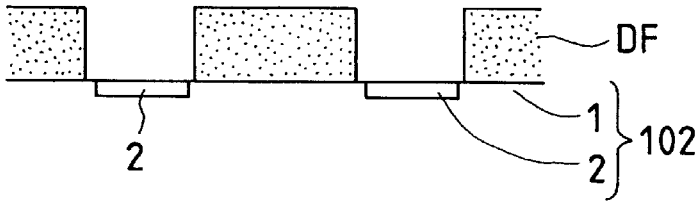

Next, as is shown in FIG. 24D, the dry film DF was developed in a developing liquid (BMRC-3: produced by Tokyo Ohka Kogyo Co., Ltd.) that consists of a mixture of xylene and butylcelsolvacetate. The non-exposed portion was dissolved, and the exposed and cured portion formed the walls for the second liquid flow paths 16. The residue on the surface of the device substrate 1 was processed by an oxygen plasma ashing apparatus (MAS-800: produced by Alkantec Co., Ltd.) for 90 seconds and was removed. Then, the resultant substrate 1 was irradiated with ultraviolet rays of 100 mJ/cm$^2$ at 150° C. for two hours to completely cure the exposed portion.

Figure 27:
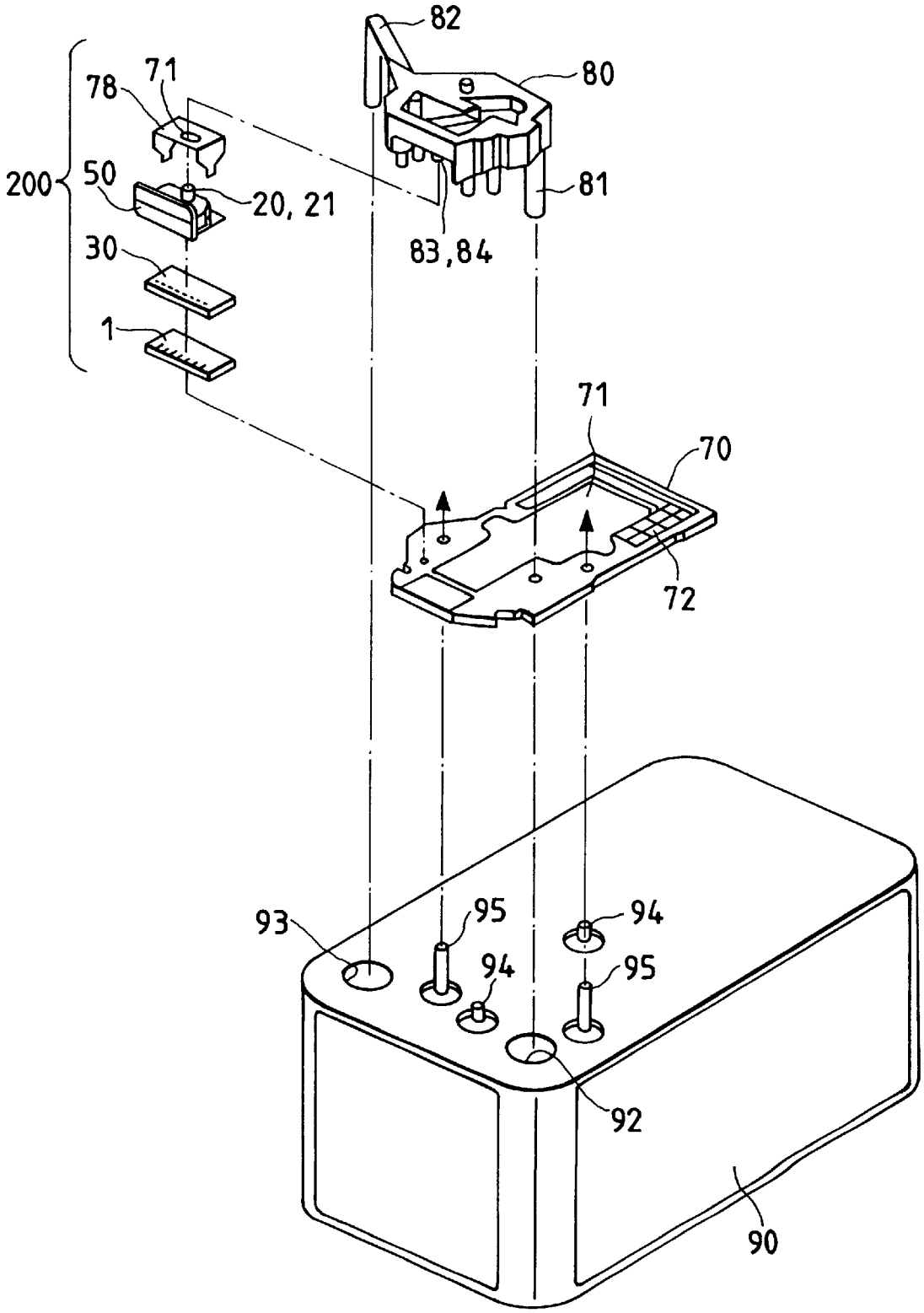
FIG. 27 is an exploded perspective view of a liquid discharge head cartridge.

With the above described method, the second liquid flow paths can be accurately and uniformly formed for a plurality of heater boards (device substrates) that are obtained by dividing the above silicon substrate. The silicon substrate was cut and separated into heater boards 1 by a dicing machine (AWD-4000: produced by Tokyo Seimitsu Co., Ltd.) to which a diamond blade of 0.05 mm thick is attached. The separated heater board 1 was fixed to an aluminum base plate 70 with an adhesive (SE4400: Toray Industries, Inc.) (FIG. 27). Then, a printed wiring board 71, which was bonded to the aluminum base plate 70 in advance, was connected to the heater board 1 with aluminum wire (not shown) having a diameter of 0.05 mm.

Figure 24E:
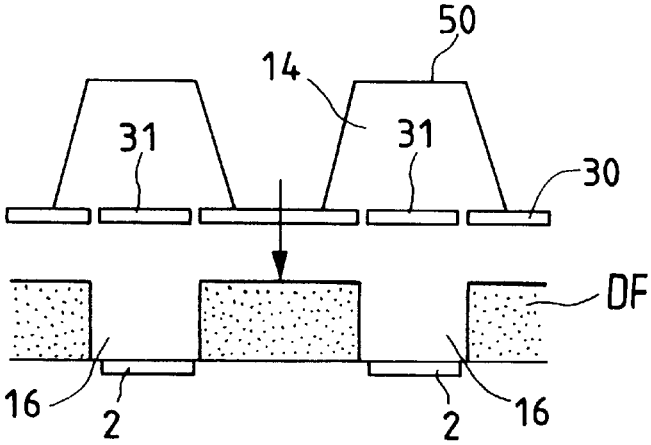

As is shown in FIG. 24E, the assembly consisting of a grooved member 50 and a partition wall 30 was positioned and bonded to the thus acquired heater board 1 according to the above described method. That is, the grooved member 50 having the partition wall 30 and the heater board 1 were positioned to each other, and then were joined and fixed together by a presser bar spring 78. Then, an ink/bubble generation liquid supply member 80 was bonded to the aluminum base plate 70, and the gap between the aluminum wirings and the gaps between the grooved member 50, the heater board 1 and the ink/bubble generation liquid supply member 80 were sealed with silicon silant (TSE399: produced by Toshiba silicon Co., Ltd.).

Since the second liquid flow paths are formed by the above described method, they can be accurately positioned relative to corresponding heaters on the heater boards. In particular, when the grooved member 50 and the partition wall 30 are bonded together in advance, the positional accuracy for the first liquid flow paths 14 and the movable members 31 can be improved.

The liquid discharging can be stabilized by this highly accurate manufacturing technique, and printing quality is improved. Further, since the liquid discharge head can be formed on a single wafer, a large quantity of heads can be manufactured at a low cost.

Although, in this embodiment, a dry film of an ultraviolet curing type was employed to form the second liquid flow paths, a resin that has an absorption band for ultraviolet rays, especially around 248 nm, may be employed. After that resin is laminated and cured, the resin at the portion that serves as the second liquid flow path can be removed directly by an excimer layer to provide the liquid discharge head.

There is another manufacturing method.

FIGS. 25A to 25D are diagrams for explaining a method for manufacturing a liquid discharge head according to the present invention.

Figure 25A:
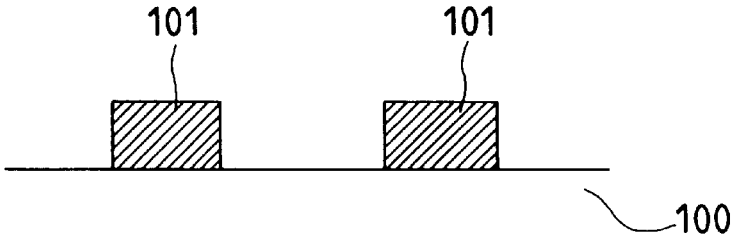
FIGS. 25A, 25B, 25C and 25D are diagrams showing the steps for explaining another method for manufacturing a liquid discharge head according to the present invention.

In this example, as is shown in FIG. 25A, a 15 $\mu$m thick resist 101 was patterned in the shape of the second liquid flow path on an SUS substrate 100.

Figure 25B:
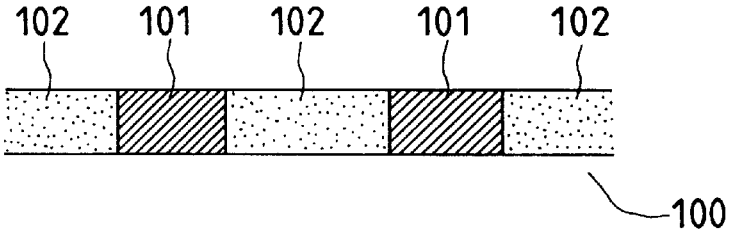

Then, as is shown in FIG. 25B, electroplating was performed on the SUS substrate 100, and nickel layers 102 also having a thickness of 15 $\mu$m were grown on the SUS substrate 100. The plating liquid contained sulfomin acid nickel, a stress reduction agent (Zeroall: produced by World Metal Co., Ltd.), boric acid, a pit prevention agent (NP-APS: produced by World Metal Co., Ltd.) and nickel chloride. For application of an electric field at elecrtrodeposition, an electrode was provided on the anode side and the patterned SUS substrate 100 was provided on the cathode side, the temperature of the plating liquid was 50° C., and the current density was 5 A/cm$^2$.

Figure 25C:
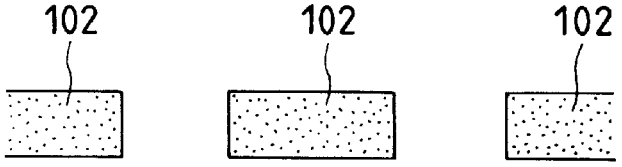

Next, as is shown in FIG. 25C, supersonic vibration was transmitted to the SUS substrate 100 for which the plating was completed, and the nickel layers 102 were peeled off the SUS substrate 100 and used to form the desired second liquid flow paths.

Figure 25D:
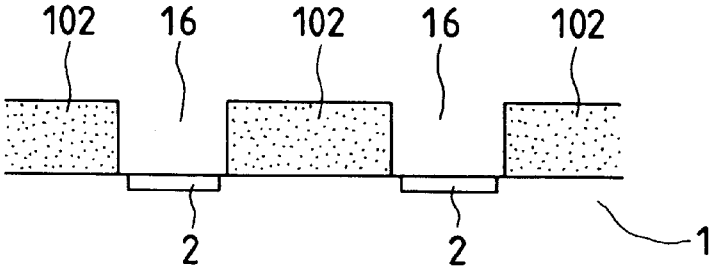

The heater board where the electro-thermal converting member was arranged was formed on a silicon wafer by the same fabrication apparatus that is used for semiconductors. As in the previous embodiments, the silicon wafer was separated into heater boards by a dicing machine. The heater board 1 was bonded to an aluminum base plate 70, to which a printed board 104 was bonded, and a printed board 71 was connected to aluminum wire (not shown) to provide electric wiring. As is shown in FIG. 25D, the second liquid flow paths that were previously obtained were positioned against the heater board 1 and were fixed in place. These components were engaged and secured by a plate, to which the partition wall was fixed, and a presser bar spring, in the same manner as was done in the first embodiment. Thus, the flow path and the heater board need only be fixed in place so that a shift in position does not occur when the plate is bonded.

In this example, an ultraviolet curing adhesive (Amicon UV-300: Grace Japan Co., Ltd.) was coated for positioning and fixing, and the resultant structure was irradiated by an ultraviolet irradiation apparatus with an exposure quantity of 100 mJ/cm$^2$ for three seconds to complete the fixing.

According to the above described method, the second liquid flow paths can be accurately positioned relative to the heat-generating member, and since the flow path walls are formed of nickel, they are not easily affected by an alkaline liquid. As a result, a reliable liquid discharge head could be provided.

There is an additional manufacturing method.

FIGS. 26A to 26D are diagrams for explaining a method for manufacturing a liquid discharge head according to the present invention.

Figure 26A:
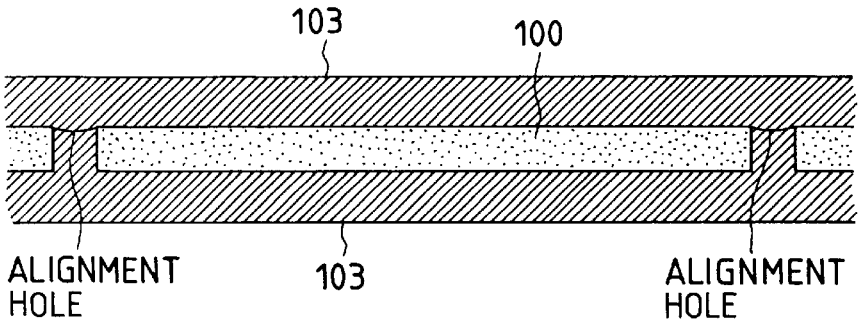
FIGS. 26A, 26B, 26C and 26D are diagrams for explaining a further method for manufacturing a liquid discharge head according to the present invention.

In this embodiment, as is shown in FIG. 26A, a resist 103 was coated on both sides of a 15 $\mu$m thick SUS substrate 100 that has alignment holes or marks 100*a*. PMERP-AR900 produced by Tokyo Ohka Kogyo Co., Ltd. was employed as the resist 103.

Figure 26B:
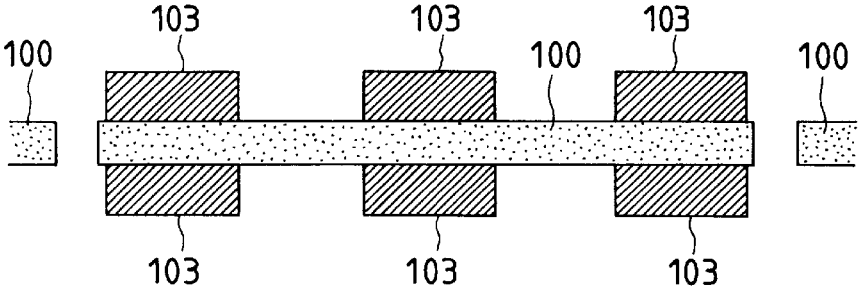

Then, as is shown in FIG. 26B, exposure was performed by an exposure apparatus (MPA-600: produced by Canon Inc.) so as to be adjusted to the alignment holes 100*a* of the device substrate 100, and the resists 103 at the portions where the second liquid flow paths were to be formed were removed. Exposure was conducted with an exposure quantity of 800 mJ/cm$^2$.

Figure 26C:
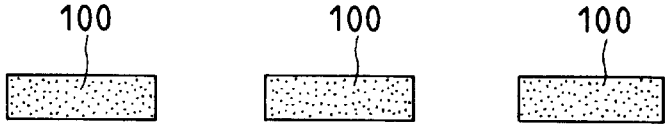

Next, as is shown in FIG. 26C, the SUS substrate 100 where the resists 103 were patterned on both sides was immersed in an etching liquid (an aqueous solution of iron chloride (II) or copper chloride (II)), and the exposed portions from the resists 103 were etched away. Then, the resists 103 were peeled off.

Figure 26D:
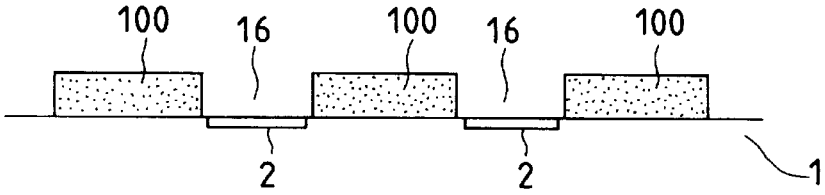

Finally, as is shown in FIG. 26D, in the same manner as for the previous embodiments, the etched SUS substrate 100 was positioned and fixed to the heater board 1 to provide a liquid discharge head having the second liquid flow paths 4.

According to the method in this example, the second liquid flow paths 4 can be accurately positioned relative to the heaters. Since the flow paths are formed of SUS, they are not easily damaged by acid and alkaline liquid. A reliable liquid discharge head can therefore be provided.

As is described above, according to the methods in the above embodiment, since the walls for the second liquid flow paths are formed on the device substrate in advance, the electro-thermal converting member and the second liquid flow paths can be positioned accurately. Before the board is separated to obtain multiple device substrates, the second liquid flow paths can be formed at the same time for those multiple device substrates. Accordingly, a large quantity of liquid discharge heads can be provided at a low cost.

In addition, in a liquid discharge head that is manufactured by the above method of this embodiment, since the heat-generating member and the second liquid flow paths are accurately positioned, the pressure due to bubbles, which are generated by the heat provided by the electro-thermal converting member, can be received efficiently, and a superior discharge force is acquired.

<Liquid discharge head cartridge>

A liquid discharge cartridge on which a liquid discharge head according to the present invention is mounted will be schematically explained.

FIG. 27 is an exploded perspective view of a liquid discharge head cartridge.

As is shown in FIG. 27, the liquid discharge head cartridge mainly comprises a liquid discharge head 200 and a liquid container 80.

The liquid discharge head 200 comprises a device substrate 1, a partition wall 30, a grooved member 50, a presser bar spring 78, a liquid supply member 90 and a support member 70. As was previously described, a plurality of heat generating resistance members are arranged in a row on the device substrate 1 to apply heat to bubble liquid. Further, a plurality of functional devices are arranged on the device substrate 1 to selectively drive the heat generating resistance members. A bubble generation liquid path is defined between the device substrate 1 and the partition wall 30 having a movable member, and bubble generation liquid flows along the path. A discharge liquid path (not shown) is defined by bonding the partition wall 30 to the grooved plate 50, and discharge liquid flows along the path.

The presser bar spring 78 acts on the grooved member 50 by applying a pressing force toward the device substrate 1. With this force, the device substrate 1, the partition wall 30, the grooved member 50 and the support member 70, which will be described later, are satisfactorily assembled.

The support member 70 is used to support the device substrate 1. On the support member 80 are arranged a circuit board 71, which is connected to the device substrate 1 to supply an electric signal, and a contact pad 72, which is connected to an apparatus to exchange electric signals with the apparatus.

In the liquid container 90 are separately retained a discharge liquid, such as ink, that is supplied to the liquid discharge head and a bubble generation liquid that is used for generating bubbles. A positioning section 94, which is employed to position a connecting member that is used for connection between the liquid discharge head and the liquid container, and a fixed shaft 95, which is used to fix the connection portion, are provided outside the liquid container 90. The discharge liquid is supplied from the discharge liquid supply path 92 in the liquid container 90 along a supply path 84 in the connection member to a discharge liquid supply path 81 in a liquid supply member 80, and finally, via discharge liquid supply paths 83, 71 and 21 of individual members, to the first common liquid chamber.

Similarly, the bubble generation liquid is supplied from the discharge liquid supply path 93 in the liquid container 90 along the supply path in the connection member to a bubble generation liquid supply path 82 in the liquid supply member 80, and finally, via bubble generation liquid supply paths 84, 71 and 22 of individual members, to the second common liquid chamber.

For the liquid discharge head cartridge, the supply routes and the liquid container have been explained for when the bubble generation liquid and the discharge liquid are different liquids. When these liquids are the same, the supply route and the liquid container need not be separated for the supply of the bubble generation liquid and for the discharge liquid.

The liquid container may be used by refilling it with liquids after the original liquids are expended. To do this, it is preferable that liquid entering ports be provided for the container. The liquid discharge head and the liquid container may either be formed integrally or separately.

<Liquid discharge apparatus>

Figure 28:
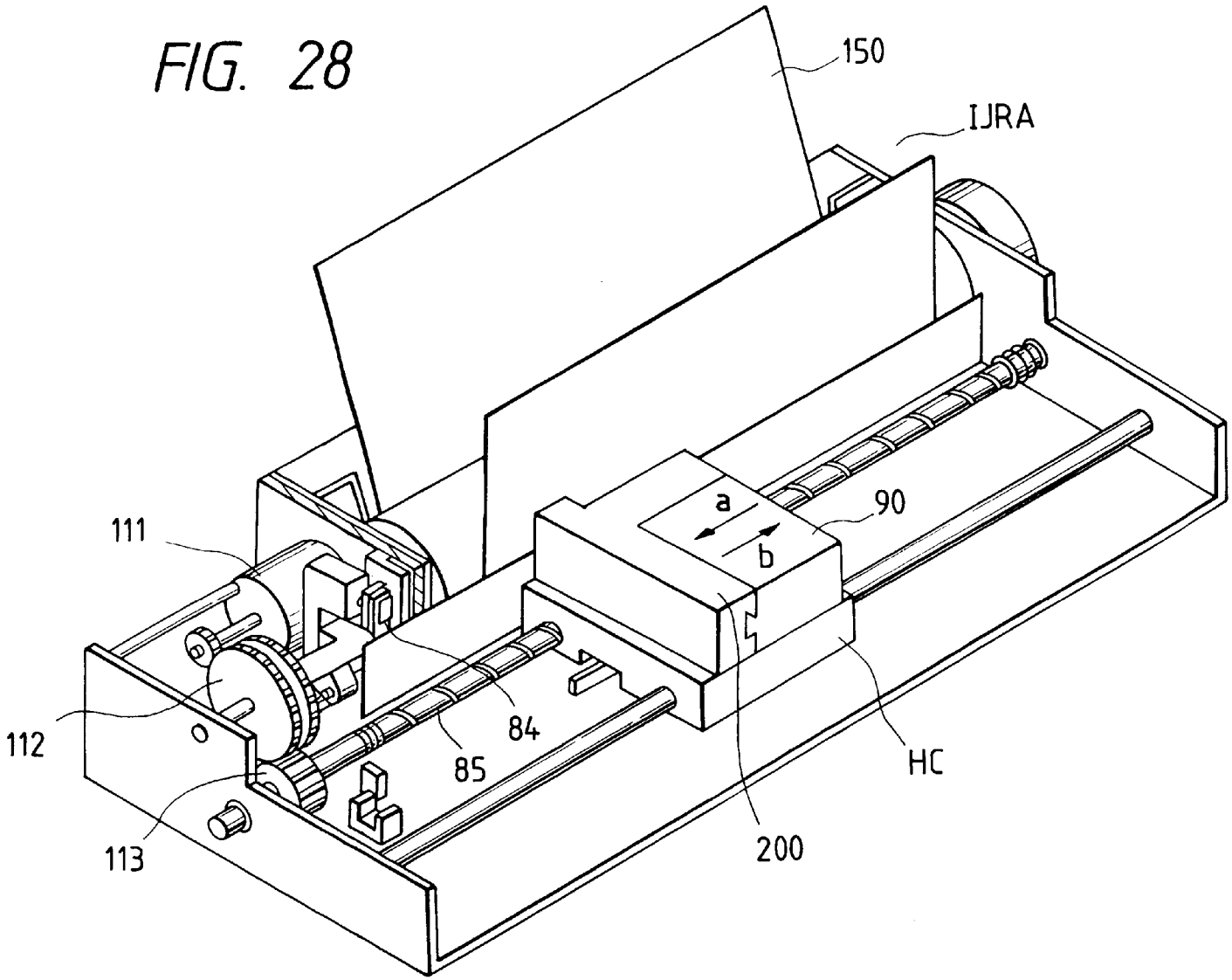
FIG. 28 is a schematic diagram illustrating the structure of a liquid discharge apparatus.

FIG. 28 is a schematic diagram illustrating the structure of a liquid discharge apparatus.

In this embodiment, an ink discharge recording apparatus that employs ink as discharge liquid will be explained. On a carriage HC of the liquid discharge apparatus is mounted a head cartridge, to which a liquid tank 90 containing ink and a liquid discharge head 200 can be detachably attached. The carriage HC reciprocates in the direction of the width of a recording medium 150, such as a recording sheet, that is fed by a recording medium feeding means.

When a driving signal is supplied from driving signal supply means (not shown) to the liquid discharge means on the carriage HC, liquid is discharged toward the recording medium from the liquid discharge head.

The liquid discharge apparatus of the present invention includes a motor 111 that serves as a driving source for driving the recording medium feeding means and the carriage HC; gears 112 and 113 for transmitting power from the driving source to the carriage HC; and a carriage shaft 115. When liquid was discharged toward various types of recording media by this recording apparatus according to the liquid discharge method, satisfactory images could be obtained.

Figure 29:
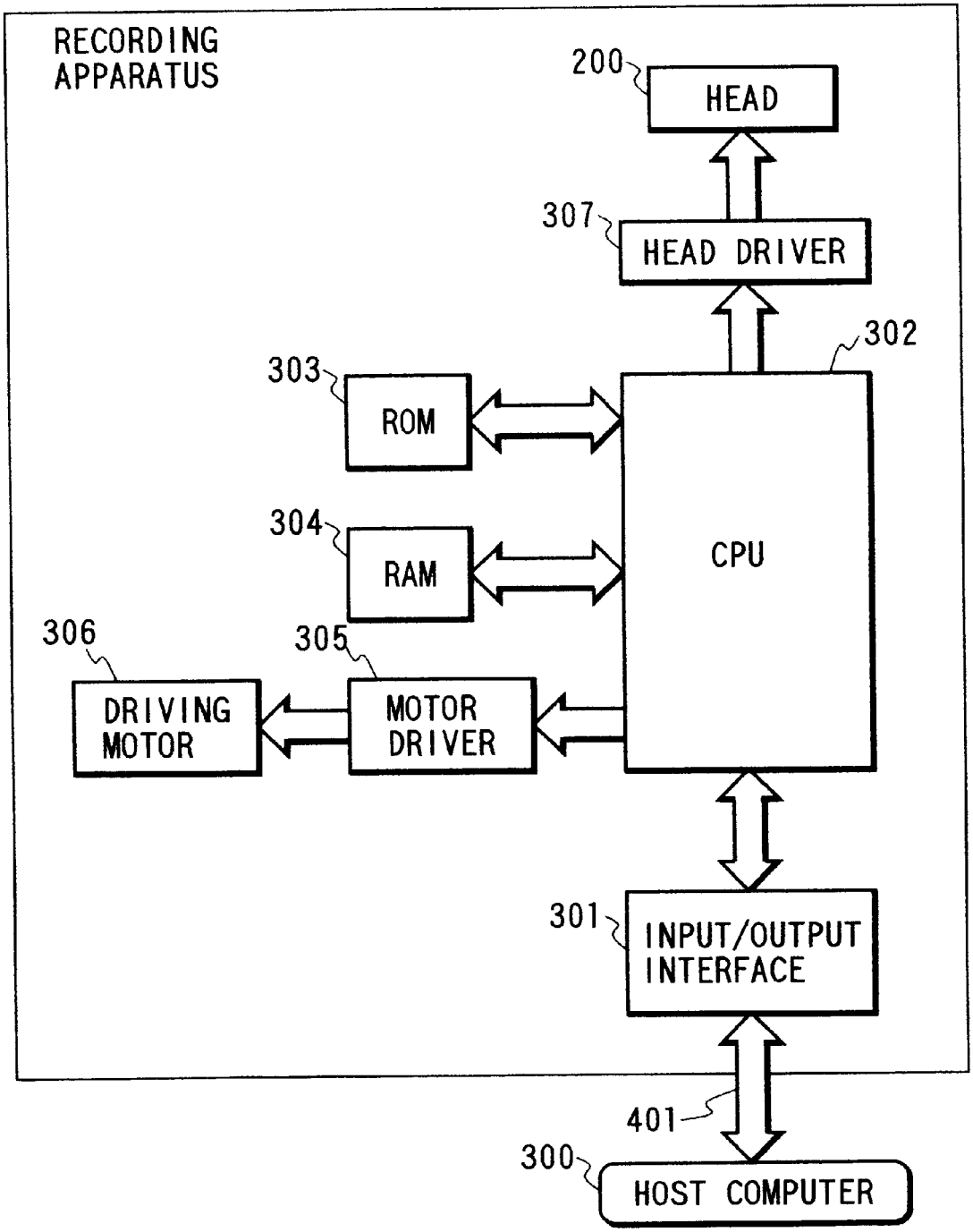
FIG. 29 is a block diagram illustrating the apparatus.

FIG. 29 is a block diagram illustrating the entire arrangement of a recording apparatus that employs the liquid discharge method and the liquid discharge head of the present invention to record images by discharging ink.

The recording apparatus receives print data 401 as a control signal from a host computer 300. The print data is temporarily held in an input interface 301. At the same time, the print data is converted into data that can be processed inside the apparatus, and the resultant data is transmitted to a CPU 302, which also serves as head driving signal supply means. Based on a control program stored in a ROM 303, the CPU 302 processes the received data using a peripheral unit, such as a RAM 304, and converts the raw data into image data.

In addition, in order to record the image data at a suitable position on a recording sheet, the CPU 302 prepares driving data used for driving the motor that moves the recording sheet and the recording head synchronously with the image data. The image data and motor driving data are transmitted respectively via a head driver 307 and a motor driver 305 to the head 200 and the drive motor 306, which are driven at controlled timings to form images.

The recording medium, which can be employed for the above recording apparatus and toward which liquid such as ink is discharged, is one of various types of paper, an OHP sheet, a plastic material used for compact disks and decorative laminated sheets, a fabric, a metal such as aluminum or copper, a leather such as oxhide, pig skin or artificial leather, a wood such as plywood, bamboo, ceramics such as tiles, or a three-dimensional net structure such as a sponge.

The recording apparatus includes a printer for printing on various types of paper and OHP sheets; a plastic recording apparatus for recording on a plastic material, such as compact disks; a metal recording apparatus for recording on metal plates; a leather recording apparatus for recording on a leather; a wood recording apparatus for recording on a wood; a ceramics recording apparatus for recording on ceramics; a recording apparatus for recording on a three-dimensional net structure such as a sponge; or a textile printing apparatus for printing on a fabric.

Liquids that match individual recording media and recording conditions can be used as the discharge liquids for these liquid discharge apparatuses.

<Recording system>

An explanation will now be given for an example of an ink-jet recording system that employs the liquid discharge head of the present invention as a recording head when recording an image on a recording medium.

Figure 30:
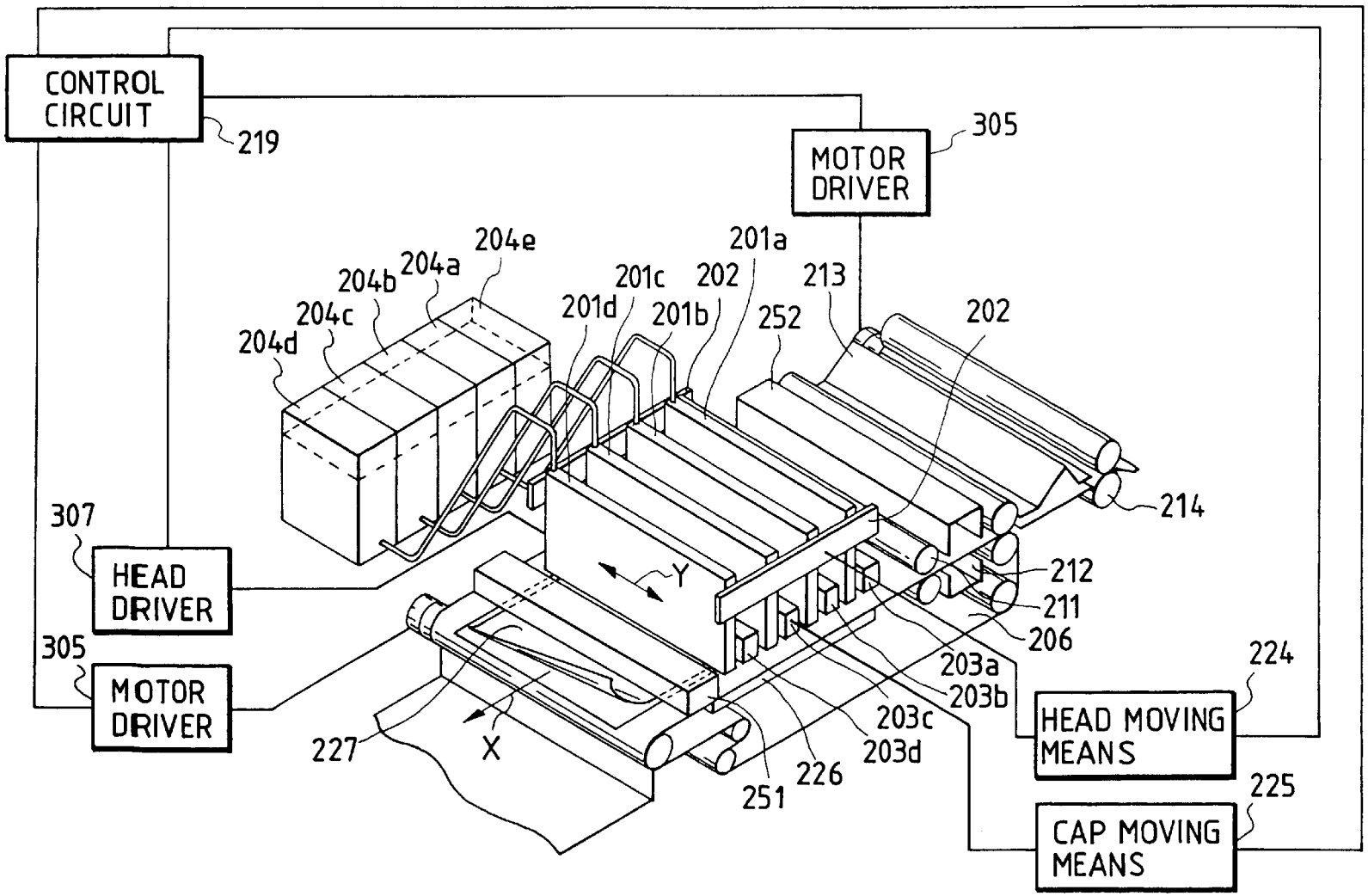
FIG. 30 is a diagram illustrating a liquid discharge recording system.

FIG. 30 is a specific diagram for explaining the structure of an ink-jet recording system that employs liquid discharge heads 201*a* to 201*d* according to the present invention.

The liquid discharge head 201 is a full-line type head where a plurality of discharge openings are arranged at intervals of 360 dpi along a length that corresponds to the effective recording width of a recording medium 227. Four corresponding heads for the colors yellow (Y), magenta (M), cyan (C) and black (Bk) are held parallel to one another by a holder 202 at predetermined intervals in direction X.

Signals are supplied to these four heads from head drivers 307 comprising driving signal supply means, and the heads are driven in response to the signals.

Four inks of colors, Y, M, C and Bk, are supplied respectively by ink containers 204*a* to 204*d* to the heads. A bubble generation liquid container 204*e* is used to retain a bubble generation liquid. The bubble generation liquid is supplied by this container to the heads.

Head caps 203*a* to 203*d* that have internal ink absorption members, such as sponges, are located below the respective heads. When no recording is being performed, the caps 203*a* to 203*d* cover the discharge openings of the heads 201 to protect them.

A feed belt 206 is feeding means for feeding the various recording media that were described in the previous embodiments. The feed belt 206 lies along a predetermined route supported by rollers, and is driven by a driving roller connected to the motor driver 305.

In this ink-jet recording system, a pre-processor 251 and a post-processor 252 are respectively provided upstream and downstream along the recording medium feeding route, and perform various processes for the recording medium before and after printing is performed.

The pre-process and the post-process differ depending on the recording medium type and the ink type. For example, a recording medium such as a metal, a plastic and ceramics, is irradiated by ultraviolet rays and ozone as a pre-process to activate the surface of the recording medium, so that the attachment of ink is enhanced. Other recording media such as plastic that tend to generate static electricity may attract dust that adheres to its surface to thereby interrupt the recording process. Therefore, as the pre-process for such media, static electricity is removed from a recording medium by an ionizer so that dust on the recording surface can be removed. Further, when a fabric is employed as a recording medium, as the pre-process, an alkaline substance, an aqueous substance, a synthetic polymer, an aqueous metal complex salt, urea, or thiourea is applied to the recording material from the viewpoint of improving the prevention of oozing and the degree of exhaustion. The pre-processes are not limited to those mentioned above, and they may involve the setting of the temperature of a recording medium to a temperature that is appropriate for recording.

The post-process includes a thermal process, a fixing process for promoting the fixing of ink by irradiation with ultraviolet rays, or a process for removing a processing agent that was provided in the pre-process and was not removed during printing.

In this embodiment, a full-line head type has been employed, but the liquid discharge head is not limited to this type. The previously described compact head may be moved in the direction of the width of the recording medium to record images.

<Head kit>

A head kit of which one component is a liquid discharge head of the present invention will now be described.

Figure 31:
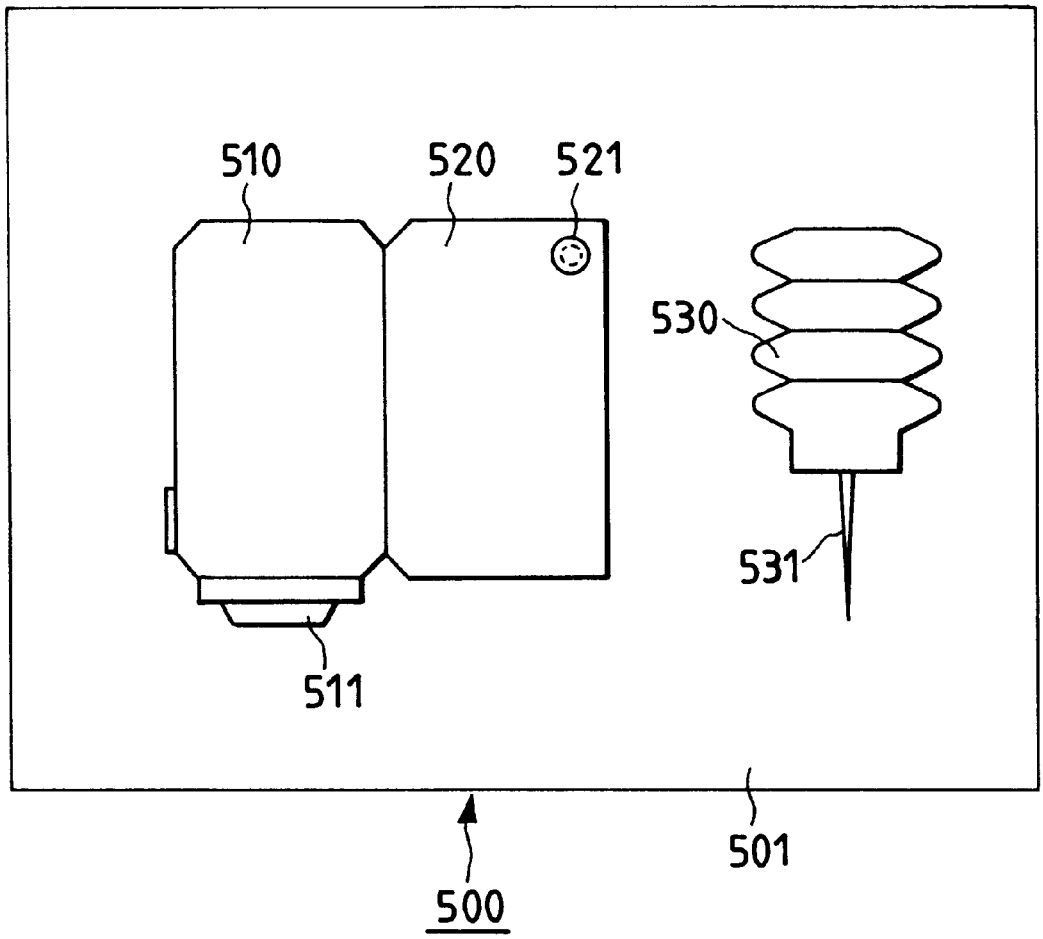
FIG. 31 is a specific diagram showing a head kit.

FIG. 31 is a specific diagram showing a head kit.

In a kit container 501 of the head kit in FIG. 31 are stored a head 510 according to the present invention, which has an ink discharging portion 511 for discharging ink; an ink container 520, which is a liquid container that can be included as a part of the head 510 or as a separate part; and ink refilling means for holding ink for refilling the ink container 520.

When the supply of ink in the ink container 520 is exhausted, an insertion portion (injection needle) 531 of the ink refilling means is partially inserted into a communication opening 521 in the ink container 520, the portion connected to the head, or into an opening in the wall of the ink container 520, so that using the ink in the ink refilling means can be transferred to the ink container 520 via the inserted portion 531.

Since the liquid discharge head of the present invention, the ink container and the ink refilling means are stored in a single kit container and constitute a head kit, even when the ink container has been emptied, it can be easily refilled with ink and i-recording can be quickly resumed.

Although the head kit in this embodiment has ink refilling means, another type of head kit can be employed with which ink refilling means is not provided, for which a separate ink container filled with ink and a head are stored in a kit container 510.

Although only the ink refilling means for refilling the ink container is shown in FIG. 31, in addition to the ink container, bubble generation liquid refilling means may be stored in the kit container to refill a bubble liquid container.

The examples of the present invention will now be described while referring to the drawings.

EXAMPLE 1

Figure 32A:
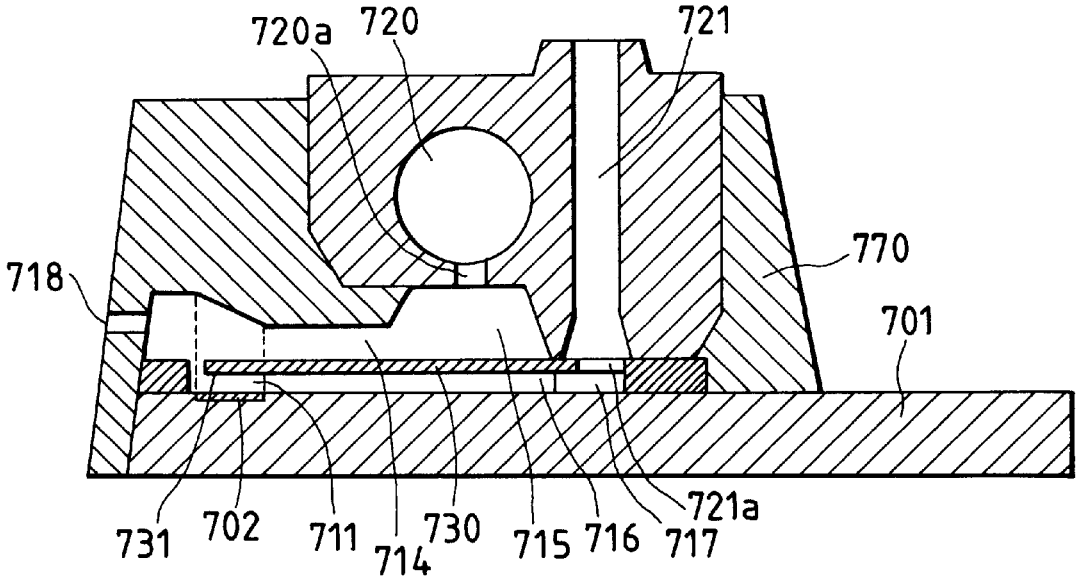
FIGS. 32A and 32B are cross-sectional views of the main portion of a first example for the liquid discharge head according to the present invention.
Figure 32B:
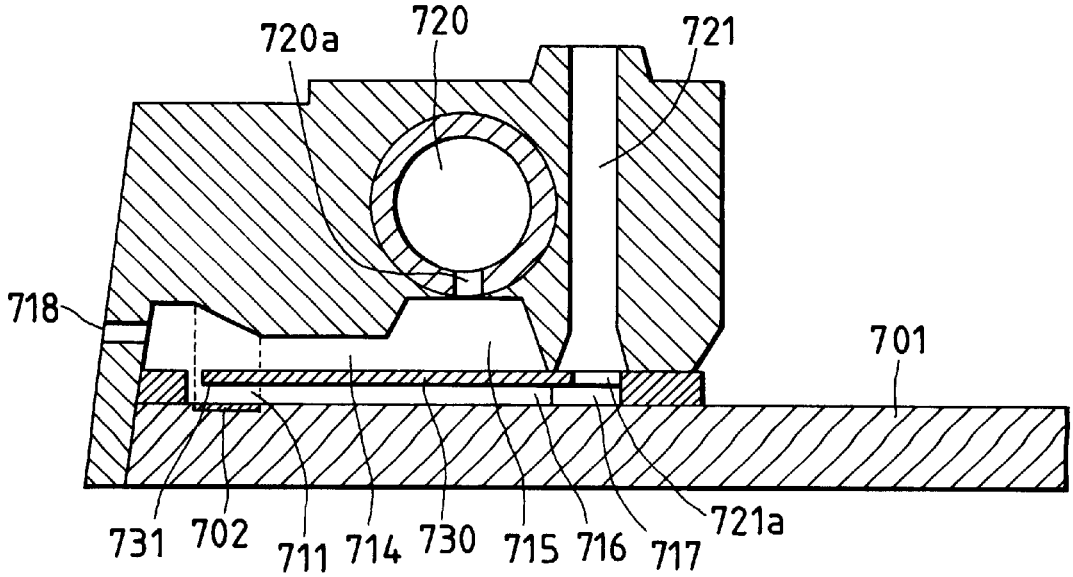

FIGS. 32A and 32B are cross-sectional views of the main portion according to a first example of the liquid discharge head of the present invention.

As is shown in FIGS. 32A and 32B, the liquid discharge head comprises: a discharge opening 718 through which liquid is to be discharged; a first supply path 720 having a pipe shape; a first liquid flow path 714, formed of stainless steel, along which liquid that is supplied to the first supply path 720 is introduced to the discharge opening 718; a heat-generating member 702 for providing thermal energy to generate a bubble in the liquid; a device substrate 701 which is supported by a support member 770 made of aluminum and on which the heat-generating member 702 is arranged; a second supply path 721 along which bubble generation liquid is supplied from a second liquid chamber; a second liquid flow path 716 along which the liquid that is supplied to the second supply path 721 is introduced to a bubble-generating region 711; a movable member 731 which is displaced by pressure exerted by a bubble that is produced in the bubble-generating region 711; and a partition wall 730 that includes the movable member 731. The first supply path 720 communicates with a first liquid chamber (not shown) where a discharge liquid is retained, and the discharge liquid is supplied from the first liquid chamber. The first liquid flow path 714 communicates with the discharge opening 718 and the first supply path 720. The second supply path 721 communicates with the second liquid chamber (not shown) storing the bubble generation liquid for the generation of bubbles in the bubble-generating region 711, which is located above the heat-generating member 702. The second liquid flow path communicates with the second supply path 721. The movable member 731 faces the bubble-generating region 711, the movable member 731 has a free end close to the discharge opening 718 and a fulcrum at the opposite end, and is so located that it separates the first liquid flow path 714 and the second liquid flow path 716. The movable member 731 is displaced toward the first liquid flow path 714 by pressure produced when a bubble is generated in the bubble-generating region 711 and connects the first liquid flow path 714 to the second liquid flow path 716. The partition wall 730 separates the first liquid flow path 714 and the second liquid flow path 716. The first supply path 720 is not limited to a pipe shape having a circular cross section, and may be a pipe shape having a rectangular cross section. The member for forming the first liquid flow path 714 has the same thermal expansion coefficient as the support member 770.

The structures of the first supply path 720 and the second supply path 721 will now be explained in detail.

Figure 33A:
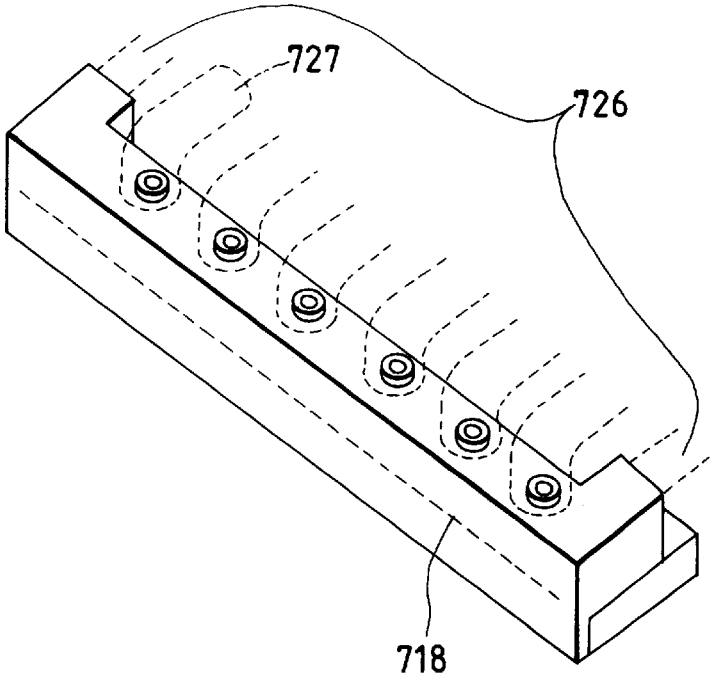
FIGS. 33A and 33B are perspective views of the structures for a second supply path in FIGS. 32A and 32B, with FIG. 33A showing the second supply path provided for each second liquid flow path, and with FIG. 33B showing an integrally formed partition wall and two second supply path provided only for the right and left sides.
Figure 33B:
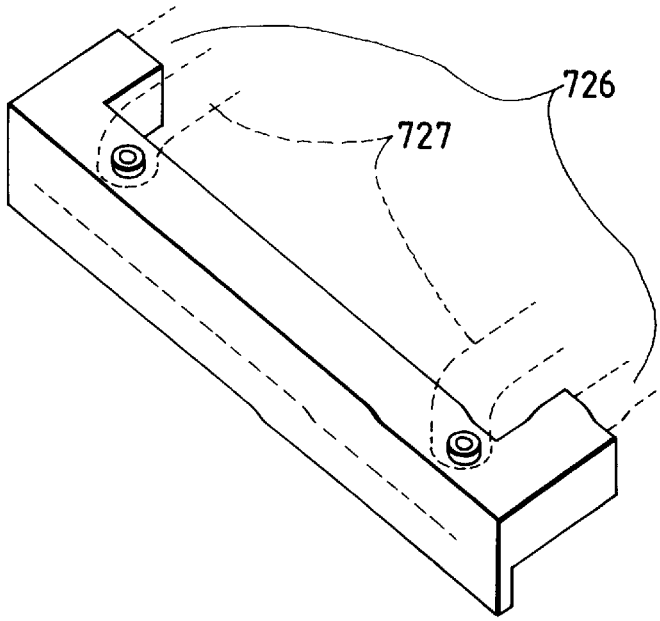
Figure 34A:
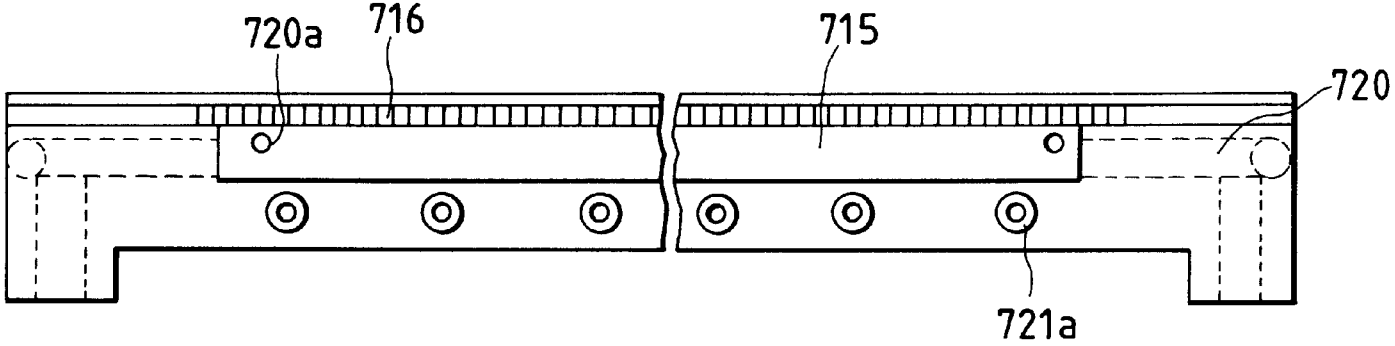
FIGS. 34A and 34B are rear views of a first and a second supply paths in FIGS. 32A and 32B, with FIG. 34A showing the second supply path provided for each second liquid flow path, and with FIG. 34B showing an integrally formed partition wall and two second supply path provided only for the right and left sides.
Figure 34B:
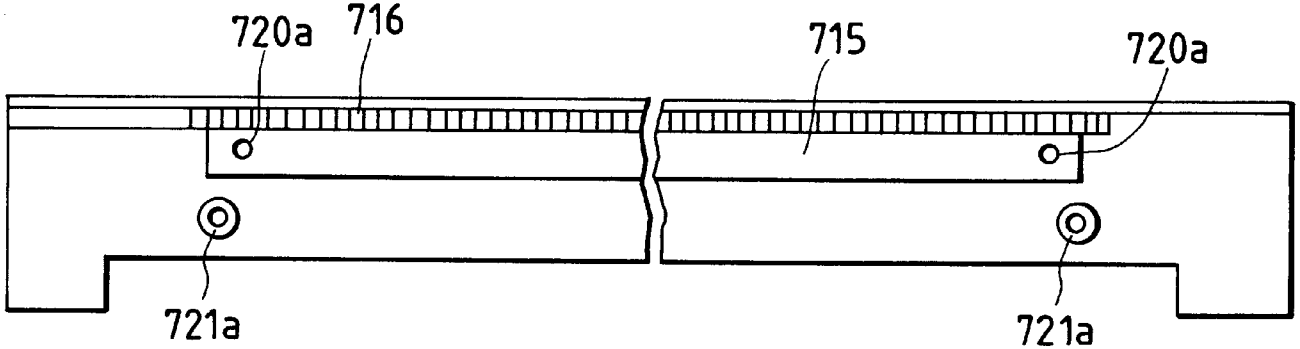

FIGS. 33A and 33B are perspective views of the structure of the second supply path 721 shown in FIGS. 32A and 32B. FIG. 33A is a diagram showing the second supply path 721 provided for each second liquid flow path 716, and FIG. 33B is a diagram showing the second supply path 721 that is integrally formed with the partition wall 730 and that is provided only on the right and left sides. FIGS. 34A and 34B are rear views of the first supply path 720 and the second supply path 721 shown in FIGS. 32A and 32B. FIG. 34A is a diagram showing the second supply path 721 provided for each second liquid flow path 716, and FIG. 34B is a diagram showing the second supply path 721 that is integrally formed with the partition wall 730 and is provided only on the right and left sides.

As is shown in FIGS. 33A, 33B, 34A and 34B, the second supply path 721 and the second supply port 721*a* provided corresponding thereto can be provided for each second liquid flow path 716, or can be provided only on the right and left sides when the path 721 is integrally formed with the partition wall 730. The liquid is to be supplied from both sides of the first supply path 720.

Figure 35:
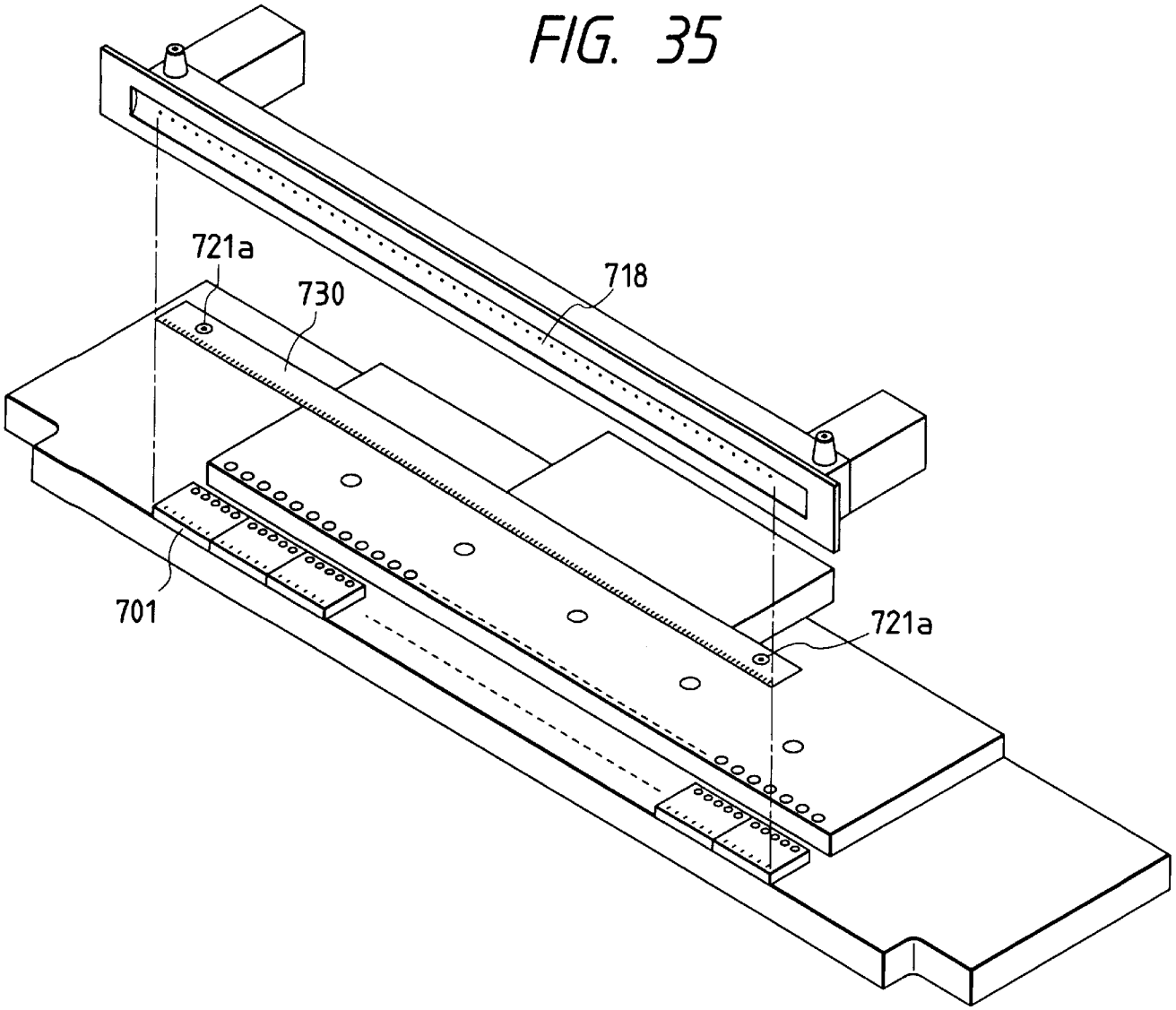
FIG. 35 is a perspective view of a liquid discharge head according to the present invention in which a partition wall is formed integrally and two second supply path is provided only for the right and left sides.
Figure 36:
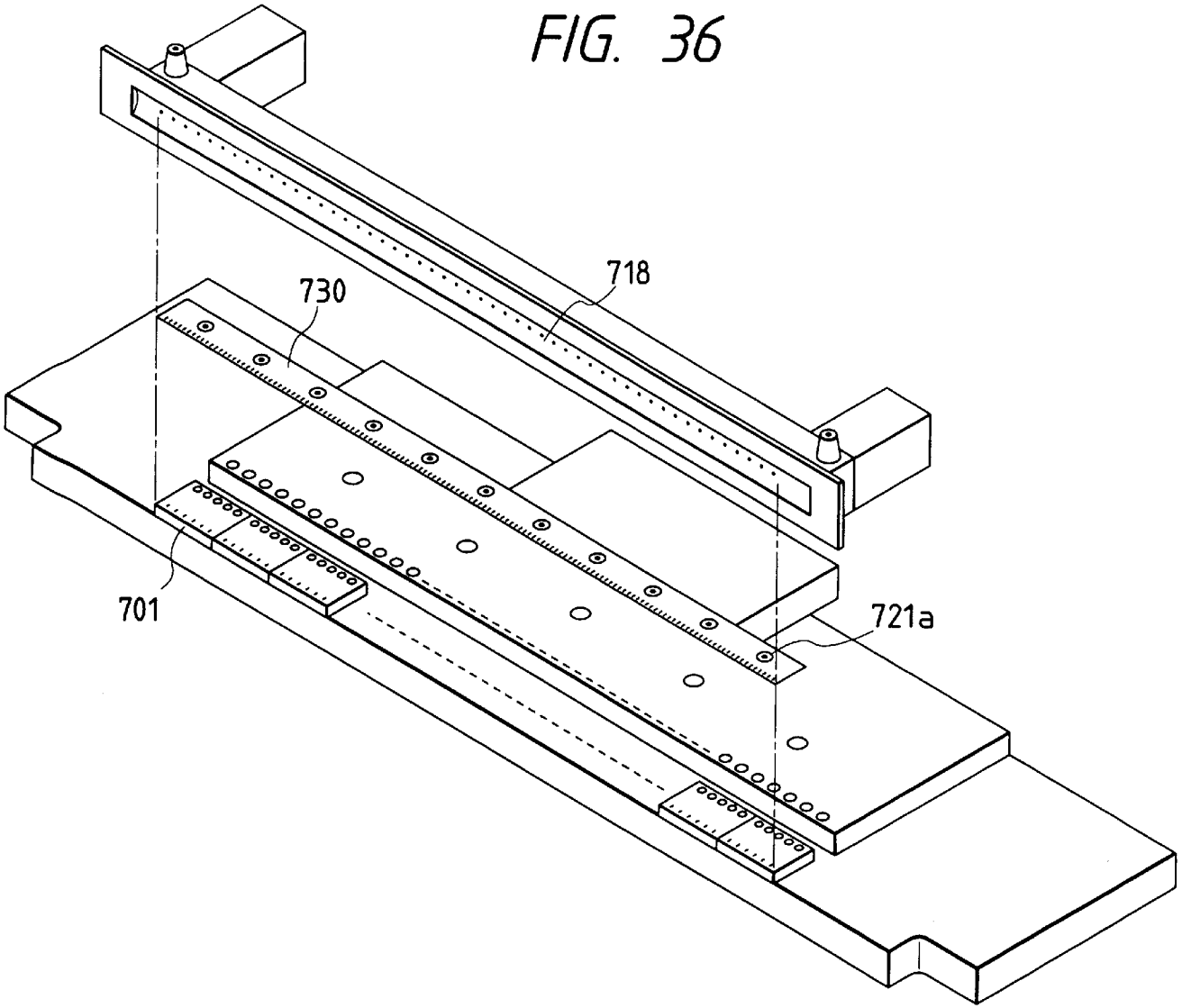
FIG. 36 is a perspective view of a liquid discharge head according to the present invention in which a partition wall is formed integrally and two second supply path is provided for each flow path.
Figure 37:
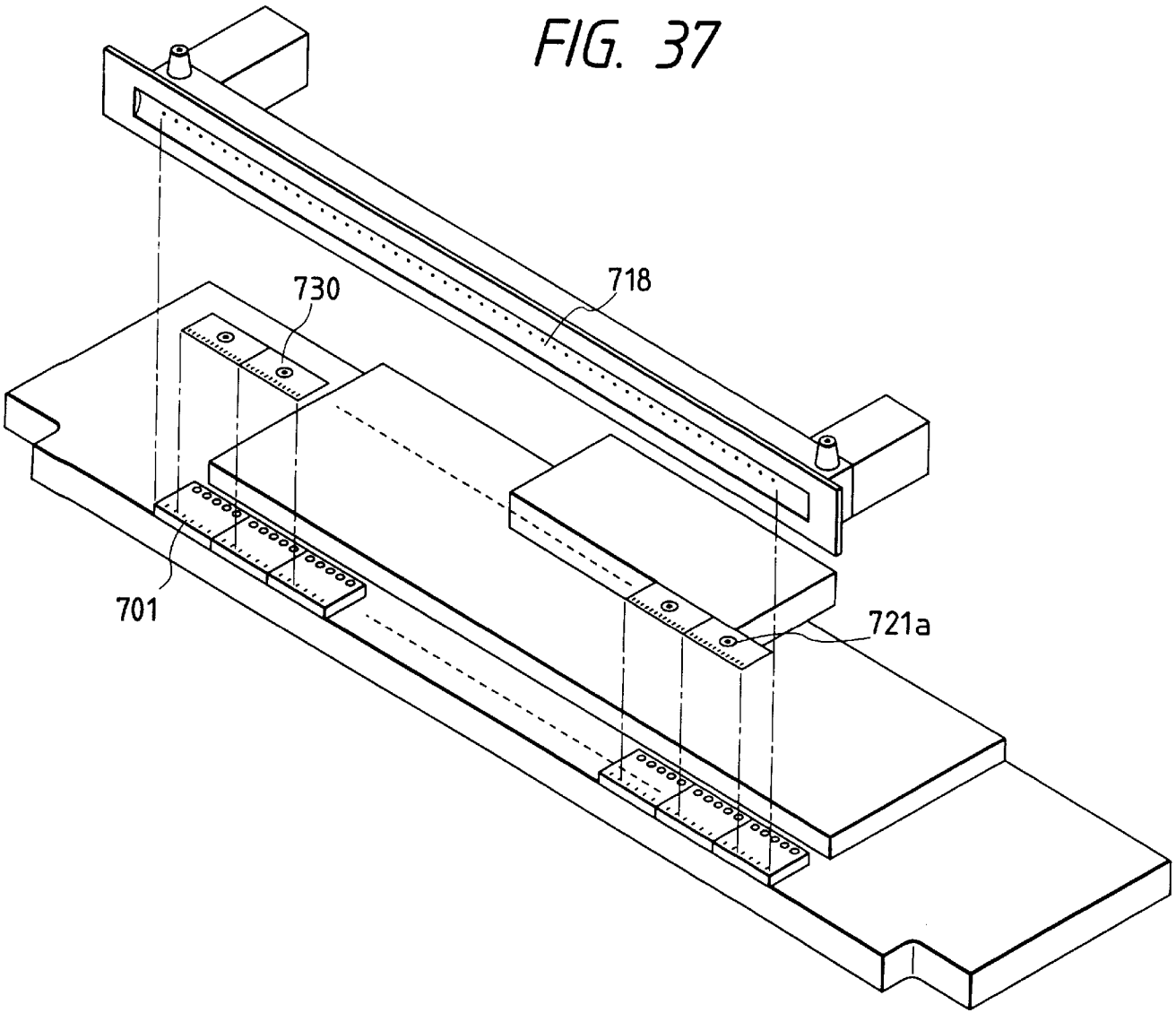
FIG. 37 is a perspective view of a liquid discharge head according to the present invention in which a partition wall is separated for each flow path.

FIGS. 35 to 37 are perspective views of the liquid discharge head according to the present invention. FIG. 35 is a diagram showing the liquid discharge head where the partition wall is integrally formed and the second supply path is provided only on the right and left sides. FIG. 36 is a diagram showing the liquid discharge head where the partition wall is integrally formed and the second supply path is provided for each liquid flow path. FIG. 37 is a diagram showing the liquid discharge head where the partition wall is separated for each liquid flow path.

The operation for the thus structured liquid discharge heads will now be described.

The discharge liquid is supplied from the first supply path 720 via the first supply port 720*a* to the first liquid flow path 714. The bubble formation liquid is supplied from the second supply path 721 via the second supply port 721*a* to the second liquid flow path 716. At this time, the movable member 731 separates the first liquid flow path 714 from the second liquid flow path 716.

A bubble is produced at the bubble-generating region 711 by heat generated by the heat-generating member 702. As the bubble grows, the free end of the movable member 731 is displaced toward the first liquid flow path 714, so that the first liquid flow path 714 communicates with the second liquid flow path 716.

As a result, in accordance with the displacement of the movable member 731, the pressure exerted by generation of the bubble is directed toward the discharge opening 718 along the movable member 731, and a liquid in the first liquid flow path 714 can be efficiently discharged through the discharge opening 718.

When the bubble has shrunk and finally disappears, the movable member 731 is closed and again separates the first liquid flow path 714 from the second liquid flow path 716.

When the movable member 731 is closed, the discharge liquid is supplied from the first supply path 720 via the first supply port 720*a* to the first liquid flow path 714 to refill the area in the vicinity of the discharge opening 718. The bubble generation liquid is also supplied from the second supply path 721 via the second supply port 721*a* to the second liquid flow path 716, to refill the area in the vicinity of the bubble-generating region 711.

The above described liquid discharge heads are an elongated type constituted by a plurality of device substrates. The first supply path 720 having a pipe shape and the second supply path 721 are integrally formed, and this assembly is inserted into the head during the manufacturing process.

EXAMPLE 2

Figure 38:
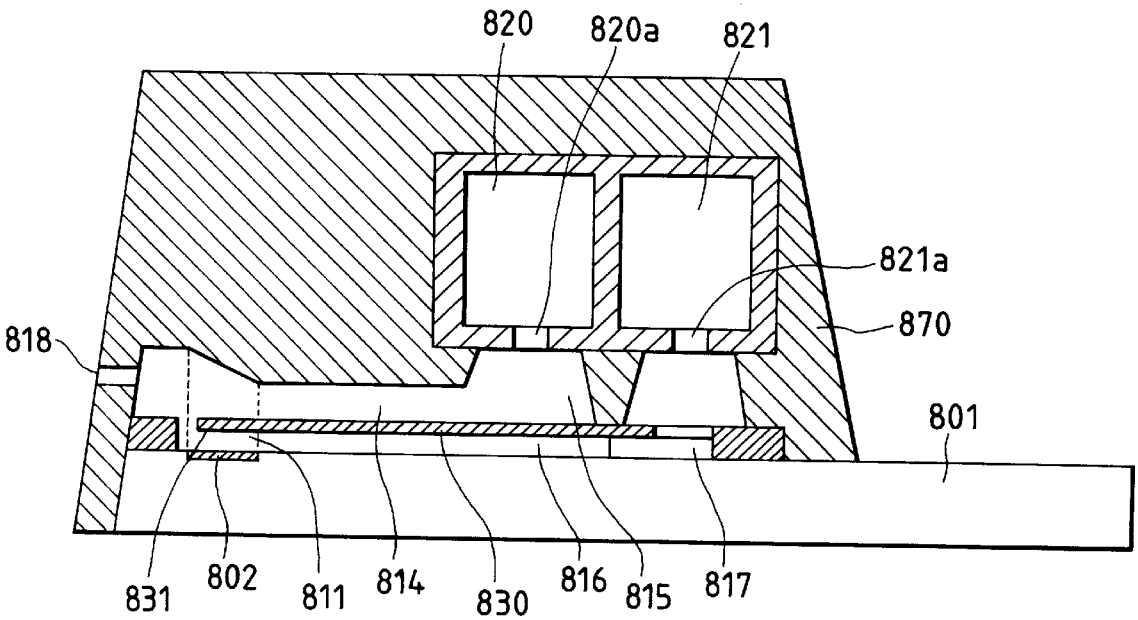
FIG. 38 is a cross-sectional view of the main portion of the second example for the liquid discharge head according to the present invention.

FIG. 38 is a cross-sectional view of the main portion according to the second example of the liquid discharge head of the present invention.

As is shown in FIG. 38, the liquid discharge head comprises: a discharge opening 818 through which liquid is to be discharged; a first supply path 820 having a pipe shape; a first liquid flow path 814, formed of stainless steel, along which a liquid supplied to the first supply path 820 is introduced to the discharge opening 818; a heat-generating member 802 for providing thermal energy to generate bubbles in the liquid; a device substrate 801, which is supported by a support member 870 made of aluminum and on which the heat-generating member 802 is arranged; a second supply path 821 having a pipe shape, along which a bubble generation liquid is supplied from a second liquid chamber; a second liquid flow path 816 along which the liquid supplied to the second supply path 821 is introduced to a bubble-generating region 811; a movable member 831 that is displaced by pressure produced when a bubble is generated in the bubble-generating region 811; and a partition wall 830 that includes the movable member 831. The first supply path 820 communicates with a first liquid chamber (not shown) where a discharge liquid is retained, and the discharge liquid is supplied from the first liquid chamber. The first liquid flow path 814 communicates with the discharge opening 818 and the first supply path 820. The second supply path 821 communicates with the second liquid chamber (not shown) where a bubble generation liquid is retained to generate bubbles in the bubble-generating region 811, which is located above the heat-generating member 802. The second liquid flow path communicates with the second supply path 821. The movable member 831 faces the bubble-generating region 811, the movable member 831 has a free end close to the discharge opening 818 and a fulcrum at the opposite end, and is so located that it separates the first liquid flow path 814 and the second liquid flow path 816. The movable member 831 is displaced toward the first liquid flow path 814 by pressure produced when a bubble is generated in the bubble-generating region 811 and connects the first liquid flow path 814 to the second liquid flow path 816. The partition wall 830 separates the first liquid flow path 814 and the second liquid flow path 816. The first supply path 820 and the second supply path 821 are not limited to a pipe shape having a circular cross section, and may have a pipe shape having a rectangular cross section. The member for forming the first liquid flow path 814 has the same thermal expansion coefficient as the support member 870.

The structures of the first supply path 820 and the second supply path 821 will now be explained in detail.

Figure 39:
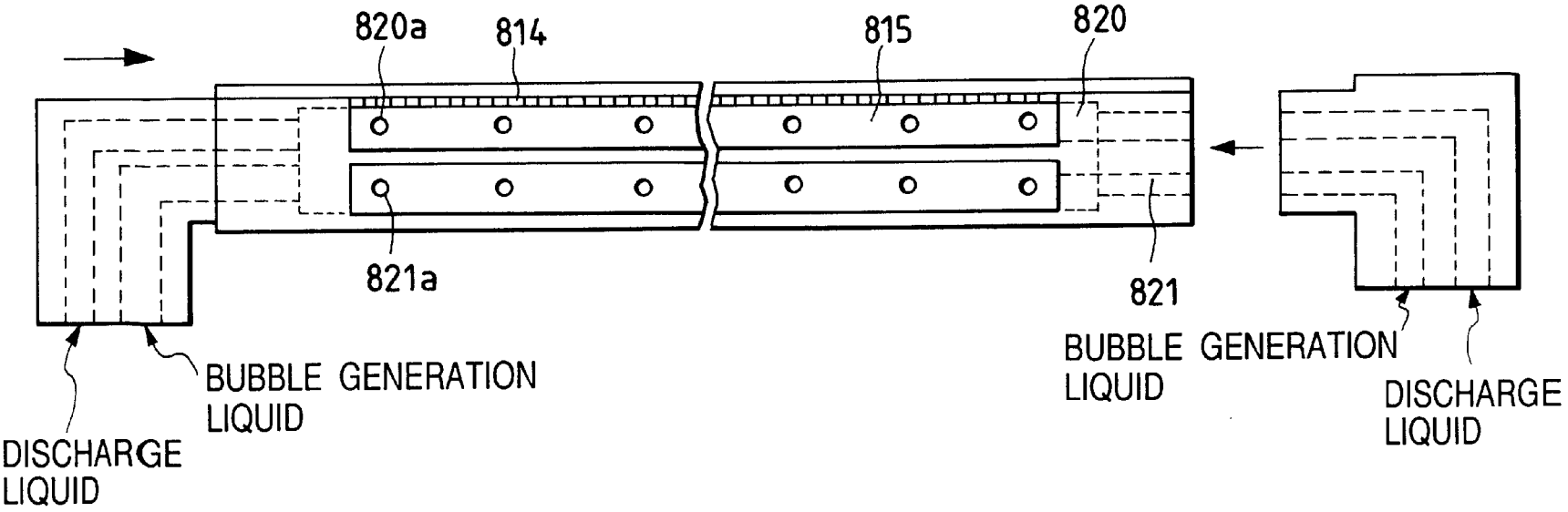
FIG. 39 is a diagram illustrating the structures for the first supply path and the second supply path shown in FIG. 38.

FIG. 39 is a diagram illustrating the structures of the first supply path 820 and the second supply path 821 shown in FIG. 38.

As is shown in FIG. 39, a liquid is supplied, from both sides, to the first supply path 820 and the second supply path 821, both of which have a pipe shape. The liquid is supplied via the first supply ports 820*a* and the second supply ports 820*b* to the first liquid flow path 814 and the second liquid flow path 816.

The above described liquid discharge heads are an elongated type constituted by a plurality of device substrates. The first supply path 820 having a pipe shape and the second supply path 821 are integrally formed, and this assembly is inserted into the head during the manufacturing process. In addition, as is shown in FIG. 39, in the process for forming the first supply path 820 and the second supply path 821, both ends from which the liquid is supplied are assembled after the supply paths 820 and 821 are formed.

The recovery operation of the liquid discharge head will now be explained.

FIGS. 40A to 40D are diagrams for explaining an example recovery operation performed by the liquid discharge head according to the present invention.

Figure 40A:
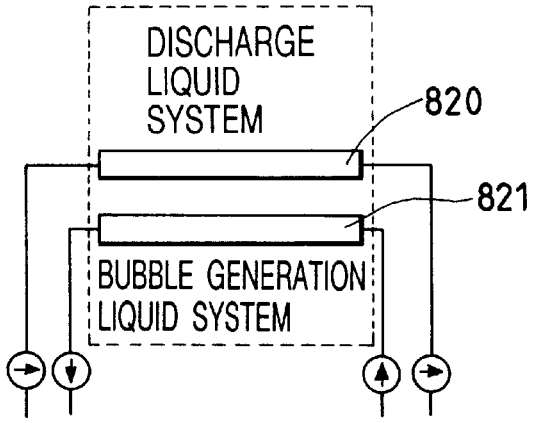
FIGS. 40A, 40B, 40C and 40D are diagrams for explaining one example of recovery operation of the liquid discharge head according to the present invention.

In the recovery operation performed by the liquid discharge head, as is shown in FIGS. 40A to 40D, first, the first supply path 820 to which the discharge liquid is supplied is closed, and circulation recovery is performed for the second supply path 821 to which the bubble generation liquid is supplied (FIG. 40A).

Figure 40B:
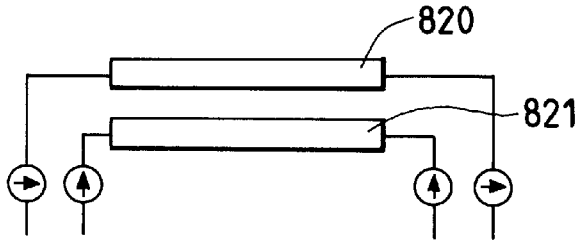

Then, while the first supply path 820 is closed, pressure is applied in the second supply path 821 from both sides to discharge the bubble generation liquid from the second supply ports 821*a* (FIG. 40B).

Figure 40C:
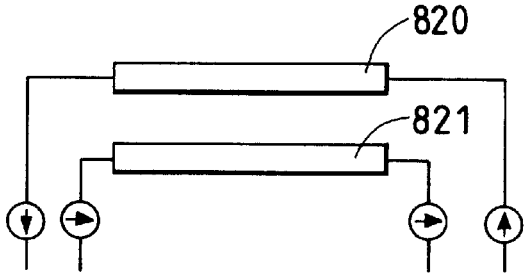

Next, the second supply path 821 is closed, and the circulation recovery is performed for the first supply path 820 (FIG. 40C).

Finally, while the second supply path 821 is closed, the first supply path 820 is pressurized from both sides to discharge the discharge liquid from the first supply ports

Figure 40D:
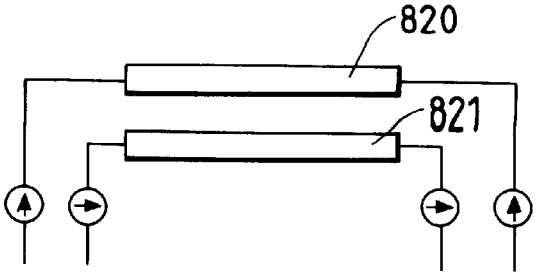

820*a,* and also to discharge the bubble formation liquid that is mixed in the discharge liquid (FIG. 40D).

EXAMPLE 3

Figure 41A:
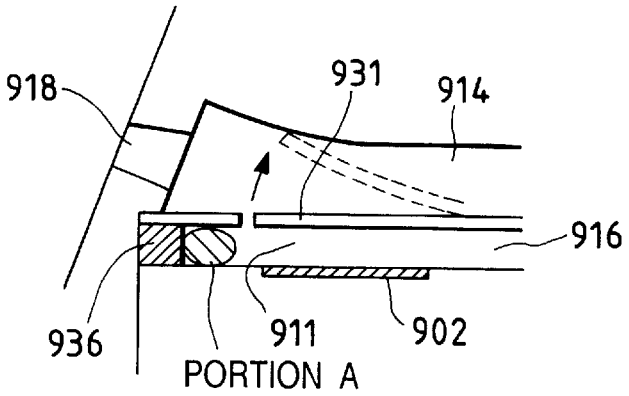
FIGS. 41A, 41B and 41C are diagrams for explaining the third example for the liquid discharge head according to the present invention, with FIG. 41A showing the structure having the portion A where a bubble is retained close to a discharge opening in a second liquid flow path, with FIG. 41B showing the structure where the portion A shown in FIG. 41A at which a bubble is retained is removed, and with FIG. 41C showing the structure where a wall is extended below the movable member.
Figure 41B:
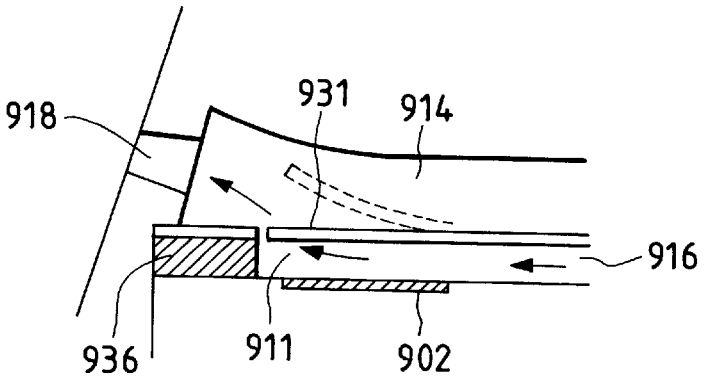
Figure 41C:
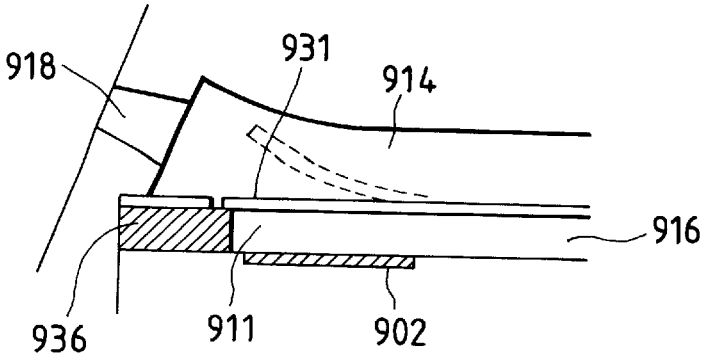
Figure 42A:
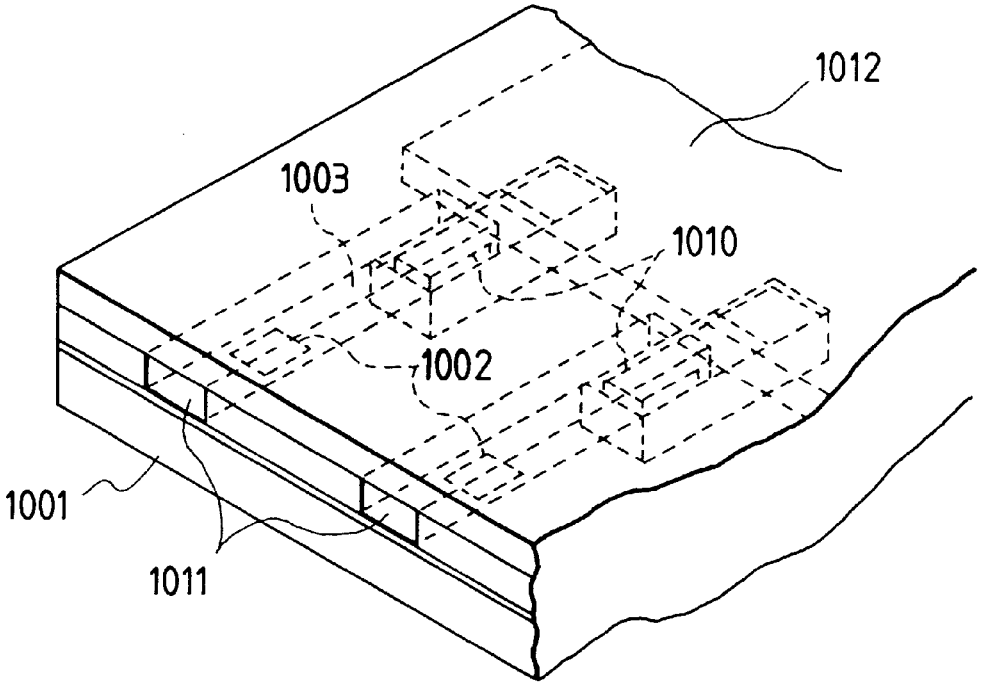
FIG. 42A PRIOR ART
FIGS. 42A and 42B are diagrams for explaining the liquid flow path structure of a conventional liquid discharge head.
Figure 42B:
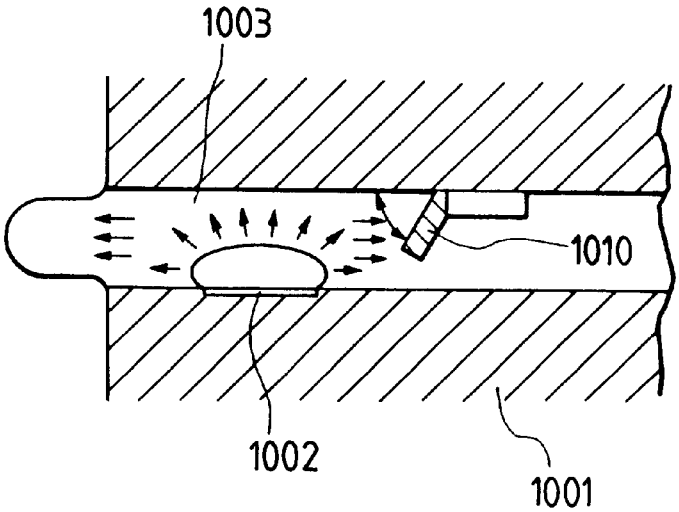
FIG. 42B PRIOR ART

FIGS. 41A to 41C are diagrams for explaining the third example according to the present invention. FIG. 41A is a diagram showing a liquid discharge head in which a bubble is retained near the discharge opening in the second liquid flow path. FIG. 41B is a diagram showing a liquid discharge head from which the portion retaining a bubble has been removed. FIG. 41C is a diagram showing a liquid discharge head in which a wall is extended up to and under a movable member.

As is shown in FIG. 41A, in the liquid discharge head wherein a bubble is generated at a bubble-generating region 911 by the heat provided by a heat-generating member 902, and a movable member 931 is displaced toward a first liquid flow path 914 by the pressure exerted to discharge the liquid in the first liquid flow path 914 through a discharge opening 918, the bubble that is generated at the bubble-generating region 911 is retained at a location nearer the discharge opening 918 (portion A in FIG. 41A) than the movable member 931 in the second liquid flow path 916. The recovery of the supply path is difficult.

Then, as is shown in FIG. 41B, a wall 936 before the bubble-generating region 911 is extended to the location of the free end of the movable member 936, and the portion A shown in FIG. 41A is removed. Therefore, an area does not exist where a bubble that is generated at the bubble-generating region 911 may be retained.

In addition, as is shown in FIG. 41C, when the wall 936 in front of the bubble-generating region 911 is extended up to and under the movable member 931, the wall 936 can serve as a member that restricts the downward movement of the movable member 931. Thus, there is more assurance that the first liquid flow path 914 and the second liquid flow path 916 will be separated, and that accordingly, the discharge liquid and the bubble generation liquid will be held separate.

Since the present invention is structured as described above, the following effects can be obtained.

(1) A liquid to be discharged is introduced from the first liquid chamber to a discharge opening via the first supply path and the first flow paths, and a liquid to generate bubbles is introduced from the second liquid chamber via the second supply path and the second liquid flow path to a bubble-generating region that is formed on a heat-generating member. Since the liquid to be discharged and the liquid for generating bubbles are separated, the liquid to be discharged is not brought into contact with the heat-generating member. Therefore, when a liquid that is easily damaged by heat is to be discharged, no precipitate due to burning is deposited on the heat-generating member.

Thus, kinds of a discharge liquid to be used can be increased, and a liquid that is easily damaged by heat can also be employed.

(2) Even with an elongated head, rapid refilling can be effected uniformly and stably.

(3) For the integral formation of the first and the second supply paths having a pipe shape, a conventional manufacturing method can be employed, even when a liquid discharge head is an elongated type and a plurality of device substrates are provided.

What is claimed is:

1. A liquid discharge head comprising:

a plurality of first liquid flow paths each communicating with an associated discharge opening for discharging liquid;

a plurality of second liquid flow paths corresponding respectively to said first liquid flow paths, each said second liquid flow path having a bubble-generating region in which bubbles are generated in the liquid by heating the liquid;

a movable member located between said first liquid flow path and said bubble-generating region, having a free end on the side of said discharge opening, said free end moving toward said first liquid flow path by pressure exerted by bubbles generated in said bubble-generating region to direct the pressure toward said discharge opening; and wherein a first supply path for supplying the liquid to a first liquid chamber communicating in common with said plurality of first liquid flow paths communicates with said first liquid chamber through a plurality of first supply ports, and wherein a second supply path for supplying the liquid to a second liquid chamber commonly communicating with said second liquid flow paths communicates with the second liquid chamber through a plurality of second supply ports.

2. A liquid discharge head according to claim 1, wherein said second flow path is provided in plural, and wherein a second liquid chamber communicating with said plurality of second flow paths in common, and a second supply path for supplying said liquid to said second liquid chamber are provided.

3. A liquid discharge head according to claim 1, wherein a heat-generating member for generating heat corresponding to said bubble-generating region is provided for said second flow paths.

4. A liquid discharge head according to claim 3, wherein said heat-generating member is provided in a device substrate.

5. A liquid discharge head according to claim 4, wherein a support member for supporting said device substrate is provided.

6. A liquid discharge head according to claim 2, wherein said first supply path and said second supply path are integrally formed.

7. A liquid discharge head according to claim 5, wherein a thermal expansion coefficient for a member for forming said first supply path is almost equal to a thermal expansion coefficient for said support member.

8. A liquid discharge head according to claim 1, wherein a member for forming said first supply path is made of stainless steel.

9. A liquid discharge head according to claim 5 or 7, wherein said support member is composed of aluminum.

10. A liquid discharge head according to claim 5, wherein a plurality of said device substrates are provided on said support member, and a separate wall having said movable member extends over said plurality of device substrates.

11. A liquid discharge head according to claim 5, wherein a plurality of said device substrates are provided on said support member, and a separate wall having said movable member is provided in plural each corresponding to said plurality of device substrates.

12. A liquid discharge head according to claim 1, wherein said plurality of said first supply ports communicate with said first liquid chamber near both ends of said first liquid chamber.

13. A liquid discharge head according to claim 1, wherein said device substrate is provided in plural; wherein said first supply path has a pipe shape and is provided over said plurality of said device substrates; and wherein the liquid to be discharged is supplied to said first liquid flow paths of each of said device substrates through said first supply path.

14. A liquid discharge head according to claim 13, wherein said second supply path has a pipe shape and is provided over said plurality of device substrates, and wherein the liquid for generating a bubble is supplied to said second liquid flow paths of each of said device substrates through said second supply path.

15. A liquid discharge head according to claim 1, wherein said second flow path ends at the location of said free end of said movable member, opposite to the side on which said second flow path communicates with said second supply path.

16. A liquid discharge head according to claim 1, wherein said second flow path ends at the location of a lower portion of said movable member, opposite to the side on which said second flow path communicates with said second supply path.

17. A method for recovering a liquid discharge head, the liquid discharge head comprising a plurality of first liquid flow paths each communicating with an associated discharge opening for discharging liquid, a plurality of second liquid flow paths corresponding respectively to the first liquid flow paths, each of the second liquid flow paths having a bubble-generating region in which bubbles are generated in the liquid by heating the liquid, a movable member located between the first liquid flow path and the bubble-generating region, having a free end on the side of the discharge opening, the free end moving toward the first liquid flow path by pressure exerted by bubbles generated in the bubble-generating region to direct the pressure toward the discharge opening, and wherein a first supply path for supplying the liquid to a first liquid chamber communicating in common with the plurality of first liquid flow paths communicates with the first liquid chamber through a plurality of first supply ports, and wherein a second supply path for supplying the liquid to a second liquid chamber commonly communicating with the second liquid flow paths communicates with the second liquid chamber through a plurality of second supply ports, wherein the device substrate is provided in plural, wherein the first supply path has a pipe shape and is provided over the plurality of the device substrates, wherein the liquid to be discharged is supplied to the first liquid flow paths of each of the device substrates through the first supply path, wherein the second supply path has a pipe shape and is provided over the plurality of device substrates, and wherein the liquid to be discharged is supplied to the second liquid flow paths of each of the device substrates through the second supply path, comprising the steps of:

supplying a liquid to said second supply path while both ends of said first supply path are closed;

applying pressure to said second supply path from both sides thereof while both of said ends of said first supply path are closed;

supplying a liquid to said first supply path while both ends of said second supply path are closed; and applying pressure to said first supply path from both sides thereof while both of said ends of said second supply path are closed, whereby recoveries for said first supply path and said second supply path are performed.

18. A method for producing a liquid discharge head comprising a plurality of first liquid flow paths each communicating with an associated discharge opening for discharging liquid, a plurality of second liquid flow paths corresponding respectively to the first liquid flow paths, each of the second liquid flow paths having a bubble-generating region in which bubbles are generated in the liquid by heating the liquid, a movable member located between the first liquid flow path and the bubble-generating region, having a free end on the side of the discharge opening, the free end moving toward the first liquid flow path by pressure exerted by bubbles generated in the bubble-generating region to direct the pressure toward the discharge opening, wherein a first supply path for supplying the liquid to a first liquid chamber communicating in common with the plurality of first liquid flow paths communicates with the first liquid chamber through a plurality of first supply ports, and wherein a second supply path for supplying the liquid to a second liquid chamber commonly communicating with the second liquid flow paths communicates with the second liquid chamber through a plurality of second supply ports, comprising the step of:

performing formation of said first and said second supply paths in said liquid discharge head by insert formation.

19. A liquid discharge apparatus comprising:

said liquid discharge head of claim 1; and driving signal supply means for supplying a driving signal to discharge a liquid from said liquid discharge head.

20. A liquid discharge apparatus comprising:

said liquid discharge head of claim 1; and recording medium transfer means for transferring a recording medium onto which a liquid is discharged from said liquid discharge head.

21. A liquid discharge apparatus according to claim 19 or 20, wherein recording is performed by discharging ink from said liquid discharge head and landing said ink on a recording sheet.

22. A liquid discharge apparatus according to claim 19 or 20, wherein recording is performed by discharging ink from said liquid discharge head and landing said ink on a fabric.

23. A liquid discharge apparatus according to claim 19 or 20, wherein recording is performed by discharging ink from said liquid discharge head and landing said ink on a plastic.

24. A liquid discharge apparatus according to claim 19 or 20 wherein recording is performed by discharging ink from said liquid discharge head and landing said ink on metal.

25. A liquid discharge apparatus according to claim 19 or 20, wherein recording is performed by discharging ink from said liquid discharge head and landing said ink on wood.

26. A liquid discharge apparatus according to claim 19 or 20, wherein recording is performed by discharging ink from said liquid discharge head and landing said ink on a leather.

27. A liquid discharge apparatus according to claim 19 or 20, wherein said liquid discharge apparatus is constructed for color recording, and color recording is performed by discharging a plurality of color liquids from said liquid discharge head an d by landing said plurality of color liquids on a recording medium.

28. A liquid discharge apparatus according to claim 19 or 20, wherein a plurality of discharge openings are arranged so as to cover all of an effective recording region on a recording medium.

* * * * *

UNITED STATES PATENT AND TRADEMARK OFFICE

CERTIFICATE OF CORRECTION

PATENT NO. : 6,151,049
DATED : November 21, 2000
INVENTOR(S) : Seiichiro Karita, et al.

It is certified that error appears in the above-identified patent and that said Letters Patent is hereby corrected as shown below:

Column 15,
Line 13, "liquid" should read -- liquids --;

Column 19,
Line 32, "polyetheretherketone" should read -- polyetheretherketone --.

Column 28,
Line 36, "silicon" should read -- Silicon --.

Column 43,
Line 43, "i-recording" should read -- recording --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*